US009732523B2

(12) United States Patent
Riccobene et al.

(10) Patent No.: US 9,732,523 B2
(45) Date of Patent: Aug. 15, 2017

(54) CONNECTION SURFACE FOR A STRUCTURAL UNIT AND METHOD OF MAKING SAME

(71) Applicant: Keystone Retaining Wall Systems LLC, Minneapolis, MN (US)

(72) Inventors: Thomas S. Riccobene, Albuquerque, NM (US); Robert A. MacDonald, Plymouth, MN (US)

(73) Assignee: Keystone Retaining Wall Systems LLC, Minneapolis, MN (US)

( * ) Notice: Subject to any disclaimer, the term of this patent is extended or adjusted under 35 U.S.C. 154(b) by 0 days.

(21) Appl. No.: 15/217,406

(22) Filed: Jul. 22, 2016

(65) Prior Publication Data

US 2017/0022710 A1 Jan. 26, 2017

Related U.S. Application Data

(60) Provisional application No. 62/196,748, filed on Jul. 24, 2015.

(51) Int. Cl.
*E02D 29/02* (2006.01)
*E04C 1/39* (2006.01)
(Continued)

(52) U.S. Cl.
CPC ..... *E04C 1/39* (2013.01); *E01C 5/04* (2013.01); *E01F 9/506* (2016.02); *E02D 29/025* (2013.01); *E02D 29/0266* (2013.01)

(58) Field of Classification Search
CPC ... E04C 1/39; E04C 5/04; E01F 9/506; E02D 29/025; E02D 29/0266; E02D 2600/20
(Continued)

(56) References Cited

U.S. PATENT DOCUMENTS 730,150 A 6/1903 Pfahl
888,530 A 5/1908 Pugh
(Continued)

FOREIGN PATENT DOCUMENTS

DE 19747421 4/1999
EP 0117638 9/1984
(Continued)

OTHER PUBLICATIONS

Canyon Stone, CobbleTop and Sereno Stone Brochures, Riccobene Hardscape Innovations, 2010, pp. 1-11.
(Continued)

*Primary Examiner* — Beth Stephan
(74) *Attorney, Agent, or Firm* — Greer, Burns & Crain, Ltd.

(57) ABSTRACT

A connection surface disposed on a face of a structural unit comprises a first segment having a three dimensional surface profile including a plurality of positive outer surfaces extending outwardly along a normal direction from a plane and a plurality of negative outer surfaces extending inwardly along the normal direction from the plane, wherein at least two of the plurality of positive outer surfaces are separated from one another along both vertical and horizontal directions and at least two of the plurality of negative outer surfaces are separated from one another along vertical and horizontal directions. A second segment opposes the first segment with respect to an axis, wherein the second segment is a substantial reflection of the first segment across the axis, but reversed along the normal direction.

21 Claims, 53 Drawing Sheets

(51) Int. Cl.
*E01C 5/04* (2006.01)
*E01F 9/506* (2016.01)

(58) Field of Classification Search
USPC ..... 52/605
See application file for complete search history.

(56) References Cited

U.S. PATENT DOCUMENTS 1,015,584 A 1/1912 Powell
1,166,664 A 1/1916 Dargento
1,453,728 A 5/1923 Fernand
1,969,729 A 8/1934 Damianik
2,605,681 A 8/1952 Trief
3,229,439 A * 1/1966 Strobel ..... E04B 2/12 404/41
3,267,823 A 8/1966 MacRae
3,394,521 A 7/1968 Coleman
3,494,266 A * 2/1970 Baumberger ..... E01C 5/00 404/41
3,537,687 A 11/1970 Adelman
3,875,716 A 4/1975 Eusemann
3,931,700 A 1/1976 Scanni et al.
4,107,894 A 8/1978 Mullins
4,593,513 A 6/1986 Stratton
4,619,560 A * 10/1986 Crinnion ..... E02D 29/025 405/284
4,761,095 A 8/1988 Bartlechner
4,773,790 A * 9/1988 Hagenah ..... E01C 5/06 404/38
5,133,620 A 7/1992 Scheiwiller
5,201,154 A 4/1993 Thomas
5,259,154 A 11/1993 Lilley
5,267,810 A 12/1993 Johnson
5,348,417 A * 9/1994 Scheiwiller ..... E01C 5/00 404/38
5,762,529 A 6/1998 Nizza
5,884,445 A * 3/1999 Woolford ..... B44F 11/04 404/41
5,887,846 A 3/1999 Hupp
5,902,069 A 5/1999 Barth et al.
D425,633 S 5/2000 Hunter
6,073,411 A 6/2000 Ciccarello
6,076,318 A 6/2000 Grimm et al.
6,187,230 B1 * 2/2001 Clarke ..... A23G 9/485 264/28
6,263,633 B1 7/2001 Hagenah
D448,857 S 10/2001 Staten et al.
6,471,440 B1 10/2002 Scheiwiller
D471,990 S 3/2003 Riccobene
6,668,484 B2 12/2003 Riccobene
6,863,469 B2 3/2005 Bolduc et al.
6,907,705 B2 6/2005 Dean et al.
D536,058 S 1/2007 Riccobene
7,637,688 B2 12/2009 Riccobene
7,849,656 B2 12/2010 Mugge et al.
7,908,799 B2 3/2011 Mugge et al.
7,930,865 B2 4/2011 Barlow
8,101,113 B2 1/2012 Castonguay et al.
8,231,304 B2 7/2012 Castonguay et al.
8,336,274 B2 12/2012 Riccobene
8,609,215 B2 12/2013 Riccobene
8,844,228 B2 9/2014 Hamel
D722,391 S 2/2015 Mugge et al.
9,181,714 B2 11/2015 MacDonald et al.
2002/0104288 A1 8/2002 O'Sullivan et al.
2003/0014937 A1 1/2003 Azar
2003/0070384 A1 4/2003 Drost
2004/0045248 A1 * 3/2004 Drost ..... E01C 5/00 52/604
2004/0250495 A1 12/2004 Manthei
2005/0066607 A1 3/2005 Hagenah
2007/0217865 A1 * 9/2007 Castonguay ..... E01C 5/00 404/41
2007/0223993 A1 9/2007 Peterson, Jr. et al.
2008/0095577 A1 * 4/2008 Brun ..... B44C 3/123 404/42
2008/0240857 A1 10/2008 Ciccarello
2008/0307740 A1 12/2008 MacDonald
2010/0322709 A1 12/2010 Ciccarello
2011/0126483 A1 6/2011 Dorado et al.
2014/0140766 A1 * 5/2014 Riccobene ..... E01C 5/00 404/41
2014/0248094 A1 * 9/2014 Walling ..... E02D 29/025 405/286

FOREIGN PATENT DOCUMENTS

EP 0171417 5/1991
EP 0676512 B1 10/2002
KR 200301571 1/2003
WO 03066970 8/2003
WO 2004085755 10/2004

OTHER PUBLICATIONS

Allen + Roth Bertram 12-in L × 4 Retaining Wall Block, retrieved from www.Lowes.com on Apr. 10, 2014, p. 1.
Country Stone 8-in L Tan Black Everest Edging Stone Brochure, retrieved from www.Lowes.com, Aug. 2, 2012, pp. 1-2.

* cited by examiner

CONNECTION SURFACE FOR A STRUCTURAL UNIT AND METHOD OF MAKING SAME

PRIORITY CLAIM

This application claims priority of U.S. Provisional Application Ser. No. 62/196,748, filed Jul. 24, 2015. U.S. Provisional Application Ser. No. 62/196,748 is incorporated by reference in its entirety herein.

FIELD OF THE INVENTION

The subject disclosure relates to pavers, edgers, retaining wall blocks, curbs, caps, precast wall panels, revetment mats, and other structural units, and in particular to connectors for structural units.

BACKGROUND OF THE INVENTION

It is well known to construct pavers, edgers, walls, curbs, caps, precast wall panels, revetment mats, and other structures with structural units. Such structural units can be manufactured from concrete, clay, brick, plastic, or various other materials.

SUMMARY

An embodiment of the present invention provides a connection surface disposed on a face of a structural unit, the face of the structural unit extending generally along a plane. The connection surface comprises a first segment having a three dimensional surface profile including a plurality of positive surface features extending outwardly along a normal direction from the plane and a plurality of negative surface features extending inwardly along the normal direction from the plane, wherein at least two of the plurality of positive surface features are separated from one another along both vertical and horizontal directions and at least two of the plurality of negative surface features are separated from one another along vertical and horizontal directions. A second segment opposes the first segment with respect to an axis, wherein the second segment is a substantial reflection of the first segment across the axis, but reversed along the normal direction. When like connection surfaces face and engage one another in the same vertical orientation, the positive outer surfaces of the first segment nest with the negative outer surfaces of the second segment, and the positive outer surfaces of the second segment nest with the negative outer surfaces of the first segment. Structural units having connection surfaces are also provided.

Other embodiments of the invention provide a method for providing a connection surface for a structural unit. A primary surface is provided having a three dimensional surface profile along a plane including a plurality of positive outer surfaces extending outwardly along a normal direction from the plane and a plurality of negative outer surfaces extending inwardly along the normal direction from the plane, wherein at least two of the plurality of positive outer surfaces are separated from one another along both vertical and horizontal directions and at least two of the plurality of negative outer surfaces are separated from one another along vertical and horizontal directions. A secondary surface is provided, where the secondary surface is a reflection of the primary surface and reversed along a normal direction. The primary and secondary surfaces are assembled according to a surface reflection pattern along the plane to provide a surface texture. The provided surface texture is formed on a surface of the structural unit.

DETAILED DESCRIPTION

Figure 1:
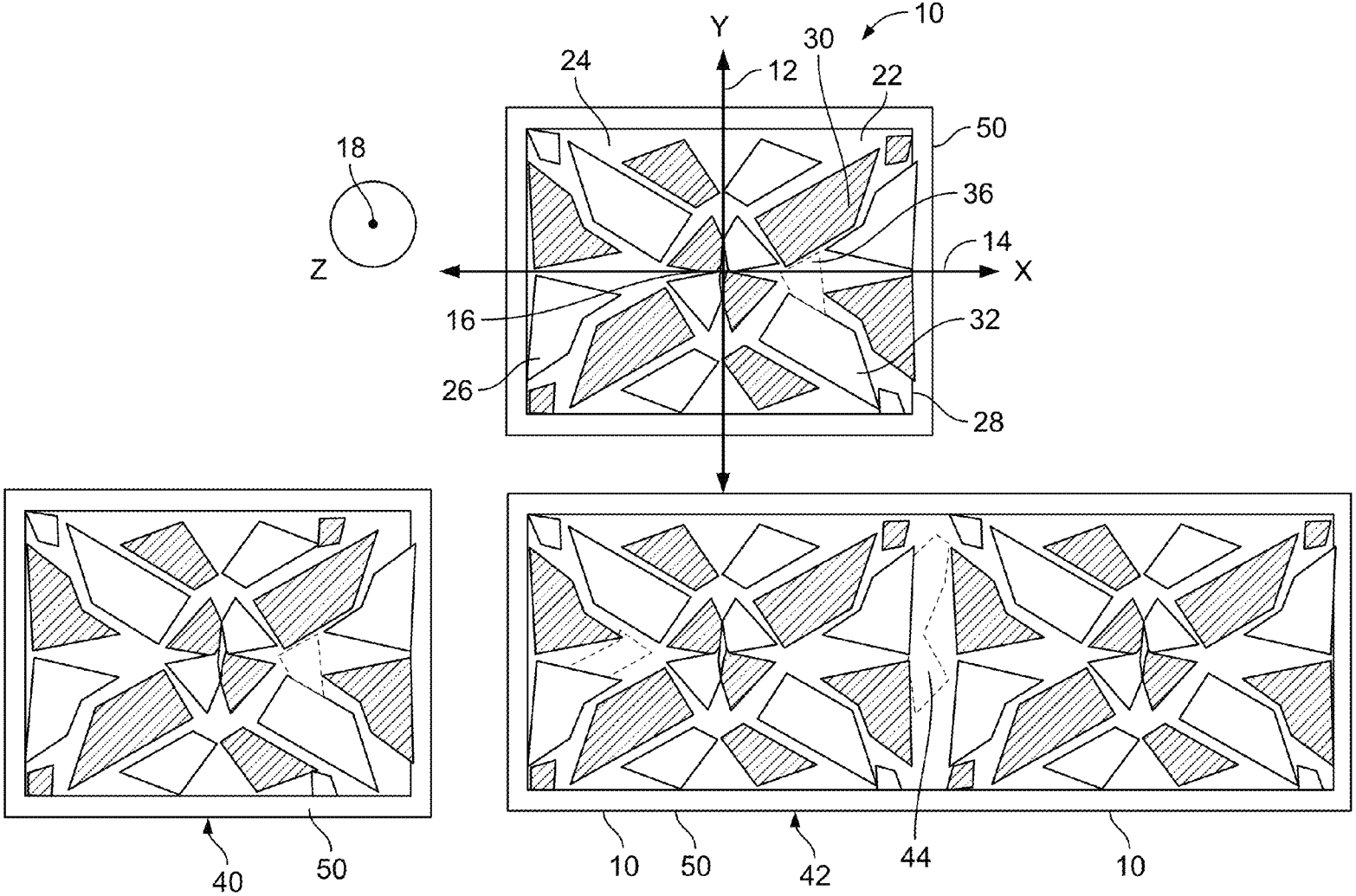
FIG. 1 is a plan view of mosaic patterned connection surfaces according to first, second, and third embodiments of the invention.

It is desirable to provide surface features for structural units that can be consistently manufactured and that nest for handling to reduce or minimize rubbing or scuff marks on textured faces in factory or other environments, or for assembly, alignment, structural connections, etc. in installation. It is also desirable to provide an outer surface for a structural unit that is aesthetically pleasing, natural-looking, or both. For example, for handling or transport, it can be useful to bring multiple, e.g., two, three, or more, structural units together with texture interlocks and move them. Moving can include moving along a plane and/or lifting, inverting, handling, turning, pushing, or other movement as may be necessary. Often, structural units are clamped or otherwise constrained against one another for handling purposes or transport.

However, outer portions of the surfaces of adjacent structural units, e.g., of protruding faces, can contact one another during movement. This can cause relative movement of the structural units, resulting in unnecessary separation, shearing of one or both surfaces (which can remove surface features), scuffing or rubbing of the textured surfaces, or allowing one or more structural units to more easily become disengaged. Such contact between outer portions can also occur when structural units are assembled to form a structure, causing undesirable movement of the structural units, or wear of surfaces. The gaps created by mismatched outer portions do not allow nesting, thereby increasing the overall area required to hold the structural units for transport. If the surfaces are configured to have a more complex, irregular, and/or natural appearance, shear caused by contacting surfaces can wear away surface texture features, lessening the desired effect. Further, misaligned or non-interconnecting surfaces can cause failure while handling by clamping and lifting into positions because the surfaces can slip against one another.

Example structural units are provided herein having connection surfaces that allow adjacent structural units to mate or nest with another. This allows the structural units to be interlocked within the textured faces, and to be moved (including lifting) together, and to be assembled in a way that provides increased shear resistance and stability, while allowing combinations of multiple shapes and/or sizes of structural units. Also, adjacent structural units can nest more tightly with one another for transport, e.g., packing, allowing for a smaller overall combined size during moving or packaging, and limiting or avoiding wear of outer surfaces during packaging, movement, or assembly. Example connection surfaces can be relatively simple in configuration or be more complex, and can include geometric shapes and/or natural surface features.

Embodiments of the invention provide, among other things, a connection surface disposed on at least a portion of a face of a structural unit. Methods for forming such connection surfaces are also provided herein. It will be understood that illustration and description of connection surfaces and molds, masters (both physical and computer generated), or molding or manufacturing methods for forming such connection surfaces will be applicable to illustrate and describe connecting methods, and vice versa. Methods of arranging, assembling, packaging, or transporting connected structural units are also provided. "Structural unit" refers to any unit that can used to form part of a structure, including both visible aesthetics and/or hidden structural connections. A preferred structural unit is a concrete, plastic, wood, fiberglass, glass, plaster, metal (or any material that can be molded, machined, or sculpted) building unit, including but not limited to pavers, concrete masonry units, retaining wall blocks, patio stones, pavers, edgers, curbs, caps, fence panels, precast wall panels, wall coverings, interior wall panels, and revetment mats.

An example connection surface comprises four segments that are arranged as quadrants with respect to first and second perpendicular axises, where the first and second axises meet at a center point. A first quadrant has a first, three-dimensional complex surface profile or contour (surface profile) comprising positive and negative surface features (e.g., projections and depressions, or convexities and concavities), which together form local peaks and valleys. By "complex," it is intended that the connection surface have multiple positive and/or negative surface features, or at least one irregular positive or negative surface feature. The surface profile can be defined by the outermost portion of the structural unit, e.g., a skin, or by an outermost portion of a surface fixed to a face of the structural unit.

For example, given a general planar extension of a surface of a structural unit (e.g., an end, side, top, bottom, etc.), an x-y plane can be defined that is parallel to the general planar extension. In an example connection surface, the three-dimensional connection surface in the first quadrant includes at least two distinct positive (in the z-direction) outer surfaces disposed above the x-y plane (that is, in the normal or z-direction), which are separated from one another by the x-y plane and along both vertical and horizontal directions, at least two negative (in the z-direction) outer surfaces below the x-y plane (which are separated from one another by the x-y plane and along both vertical and horizontal directions), a combination of at least one positive (in the z-direction) outer surface and at least one negative (in the z-direction) outer surface (which are separated from one another by the x-y plane), or at least one positive or negative irregular surface. Multiple positive and negative surface features in combination, or irregular positive or negative surface features, can also be provided in the first quadrant connection surface along each of multiple horizontal, vertical, or even oblique sections. The number of combined positive and negative surface features in the first quadrant, either along the x-y plane, or along each of one or more sections, can be one or more, two or more, three or more, five or more, ten or more, one hundred or more, etc.

A second quadrant has a second surface profile that is generally complementary to the first surface profile. More particularly, the second surface profile is a reflected image of the first surface profile, but reversed in the z-direction or normal direction, which image can be formed by rotating the three-dimensional first surface profile 180° about the first axis. The surface profile of the second quadrant can also be defined in other ways, as explained below. A third quadrant has a surface profile that is a rotated image of the first surface profile but reversed in the z-direction, which can be formed by rotating the first surface profile 180° in a plane about the center point (or defined in other ways, as explained below). A fourth quadrant has a fourth surface profile which is a reflected image of the first surface profile but reversed in the z-direction, which can be formed by rotating the first surface profile 180° about the second axis. It will be observed that the fourth surface profile can alternatively be formed by rotating the second surface profile 180° in a plane about the center point, or by rotating the third surface profile 180° about the first axis.

The connection surface can be defined based on the surface profile in any one of the four quadrants. For example, the surface profile in each quadrant can be a reflected image of a surface profile in an orthogonally adjacent quadrant but reversed in the z-direction, and can be formed by rotating the surface profile 180° about the axis separating the two adjacent quadrants. The surface profiles in quadrants disposed in opposing corners can be formed by rotating one of the surface profiles 180° in a plane about the center point. When identical (or substantially identical) connection surfaces for two structural units face one another, the first, second, third and fourth surface profiles of the first structural unit line up with and engage the (complementary) second, first, fourth, and third surface profiles of the second structural unit, respectively. This engagement forms a nested connection between the two structural units, constraining the nested connection surfaces along two dimensions (e.g., vertical and horizontal directions). In this example embodiment, but not in all embodiments disclosed herein, a nested connection also is provided if one of the structural units is inverted. For example, if the second structural unit is inverted top-to-bottom, the first and second surface profiles of the first structural unit would engage and nest with the fourth and third surface profiles of the second structural unit, respectively, and the third and fourth surface profiles of the first structural unit would engage and nest with the second and first surface profiles of the second structural unit, respectively.

It is preferred, though not required, that the surface profiles in the first, second, third, and fourth quadrants are not perfectly reflected images of one another, and it is preferred, but not required, that the surface profiles not be perfectly reflected images of one another. For example, material can be removed from one or more surfaces, while still providing substantially complementary (nesting) surface profiles. Removing material can provide a more natural and/or aesthetically pleasing appearance for structural units, and can also be used to adjust one or more surface profiles during manufacturing, for instance. Example methods for selective removal of material are disclosed herein. However, in other examples, the surface profiles are near-perfectly reflected or rotated images of one another.

In other example connection surfaces, a first segment is provided similarly to the first quadrant above, and a second segment is provided similarly to the second quadrant above. The two segments are arranged to oppose one another with respect to a first axis, which can be either a horizontal or a vertical axis, or other as disclosed herein. In such a connection surface, the first segment and second segment are reflections of one another across the central axis but reversed in the z-direction, and can be folded along one direction and across the central axis to mate with one another. Further, in such embodiments, adjacent connecting surface may need to remain in the same orientation (i.e., not inverted), while in other embodiments one connecting surface can be inverted and still provide a nested connection. Some particular examples of such connection surfaces form book-folds.

Connection surfaces can also include arrangements of multiple sets of quadrants or segments as disclosed above, while still permitting nesting of facing units (and in some embodiments, inverted facing units). It will be appreciated that surface features described herein with respect to connection surfaces are likewise applicable to molds for forming such connection surfaces, and vice versa.

Turning now to the drawings, FIG. 1 illustrates a connection surface 10 according to an embodiment of the invention, which can be formed on (or in) a face of a structural unit. "On a face" as used herein is intended to also refer to surfaces being formed in a face. The example connection surface 10 is a mosaic surface, which is useful for illustrating certain inventive aspects, though other connection surfaces can be more irregular, examples of which are disclosed elsewhere herein. The connection surface 10 can be generally divided into four quadrants by perpendicular first 12 and second 14 axises, which meet at a center point 16. For convenience of illustration, the first axis 12 is represented by a Y-axis, and the second axis 14 is represented by an X-axis. The Y-axis 12 can be, for instance, a vertical centerline of the connection surface 10, and the X-axis 14 can be, for instance, a horizontal centerline of the connection surface, where vertical and horizontal are with respect to the orientation shown in FIG. 1. In an example embodiment the Y-axis 12 can extend generally along a vertical direction of a face of a structural unit, and the X-axis 14 can extend generally along a horizontal face of a structural unit, but this is not required. The connection surface 10 can be on any face of the structural unit, and oriented in any direction on the face of the structural unit, including non-parallel and non-perpendicular directions, and can provide the entire surface of a particular face, or a portion of the face (as shown in FIG. 1).

In some example embodiments, but not all, the X-axis 12 and the Y-axis 14 can be defined by seams in the surface. A chamfer, bezel, or other outer portion can surround the connection surface 10. An x-y plane can be defined by the x- and y-axises, parallel to a general extension of a face of a structural unit. A Z-axis 18 can be considered the direction normal to the face of the structural unit, which in FIG. 1 would be the direction into (e.g., negative z) and out of (e.g., positive z) the figure.

The connection surface 10 includes first, second, third, and fourth surface profiles 22, 24, 26, 28 disposed in first, second, third, and fourth quadrants, respectively. The first surface profile 22 includes a topography or surface contour having various positive surface features, providing peaks (e.g., local maxima, outwardly extending surfaces, etc.) 30, represented by hatched lines, and negative surface features, providing valleys (e.g., local minima, inwardly extending surfaces, etc.) 32, represented by non-hatched shapes. The first surface profile 22 can be, for example, provided by convex surfaces, concave surfaces, flat portions of a surface, or any combination. Transitions between peaks 30 and valleys 32 along the surface contour can be continuous or discontinuous, in any combination. For purposes of illustration, the first surface profile 22 (and other example surface profiles) can be defined by X, Y, and Z coordinates. In an example embodiment, the x-y plane (i.e., z=0) can be defined along a flat surface of the face of the structural unit, though the x-y plane can otherwise be defined at a different plane parallel to the flat surface.

The second surface profile 24, in the second quadrant, is complementary to the first surface profile 22. As used herein the term "complementary" means that the two surface profiles, e.g., surface profiles 22, 24 are configured such that a surface profile of one unit can substantially nest with a complementary surface profile of a facing unit. The "complementary" surfaces need not be identical. "Substantially" or "generally" does not require perfect configuration or location of features, but can vary based on, for example, manufacturing tolerances, or based on intentional methods to provide more natural or aesthetically pleasing features (removing certain material from the surface, distressing the surface, etc.).

In an example embodiment, the second surface profile 24, horizontally (in FIG. 1) adjacent to the first surface profile 22, is a reflection of the first surface profile about the Y-axis 12, but reversed along the normal or Z-direction. The second surface profile 24 can be formed, for example, by rotating the first surface profile 22 180° about the Y-axis 12, for instance so that the X-coordinates and the Z-coordinates of the second surface profile are reversed with respect to the X-coordinates and the Z-coordinates of the first surface profile. In this way, the first surface profile 22 and the second surface profile 24 engage one another when facing and lined up with one another.

The third surface profile 26, vertically (in FIG. 1) adjacent to the second surface profile 24, is a rotational image of the first surface profile 22, and can be formed by rotating the first surface profile 22 in a plane 180° about the center point 16, so that the X and Y coordinates are reversed with respect to the first surface profile. The third surface profile 26 is also a reflection of the second surface profile 24 (with respect to the X-axis), but reversed in the Z-direction. The third surface profile 26 can be formed by rotating the second surface profile 24 180° about the X-axis 14, for instance so that the Y-coordinates and the Z-coordinates of the third surface are reversed with respect to the Y-coordinates and the Z-coordinates of the second surface profile.

The fourth surface profile 28, horizontally (in FIG. 1) adjacent to the third surface profile 26 and vertically adjacent to the first surface profile 22, is a rotational image of the second surface profile 24. The fourth surface profile 28 can be formed by rotating the second surface profile 24 in a plane 180° about the center point 16, so that the X-coordinates and the Y-coordinates of the fourth surface profile 28 are reversed with respect to the X-coordinates and the Y-coordinates of the second surface profile. The fourth surface profile 28 is also a reflection of the first surface profile 22 but reversed in the Z-direction, and can be formed by rotating the first surface profile about the X-axis 14. The fourth surface profile 28 further is a reflection of the third surface profile 26 but reversed in the Z-direction, and can be formed by rotating the third surface profile about the Y-axis 12.

In the horizontal direction as shown in FIG. 1, the first and second surface profiles 22, 24, being complementary, can define an S-connection, and the third and fourth profiles 26, 28 can define an S-connection. An "S-connection" refers to a connection between facing complementary surface profiles where each surface profile includes a continuous portion that begins at a first location along the normal direction, transitions both below and above the first location (in either order), and returns substantially to the first location, such that along the S-connection, a positive surface feature of one surface profile extends into a negative surface feature of the complementary surface profile, and vice versa. Similarly, in the vertical direction as shown in FIG. 1, the first and fourth complementary surface profiles 22, 28 can define an S-connection, as can the second and third 24, 26 surface profiles. Thus, in both the horizontal and vertical directions (in the orientation shown in FIG. 1), the connection surface 10 includes at least one S-connection, which provides a double-S connection for connecting to, and nesting with, facing structural units. Examples of such double-S connections are shown and described herein.

Note that the overall connection surface 10 can be defined with respect to any of the four surface profiles 22, 24, 26, 28 by rotating or reflecting the surface profiles as shown and described herein. Reference to ordinal numbers such as "first," "second," "third," or "fourth" are for convenience of illustration only.

The first and third surface profiles 22, 26, being (generally) rotational images of one another, can be provided using a copy of the first (or the third) surface profile, and rotating the copy of the surface profile about the center 16 to provide the other. Similarly, the second and fourth surface profiles 24, 28, being (generally) rotational images of one another, can be provided using a copy of the second (or fourth) surface profile, and rotating the copy of the surface profile about the center 16 to provide the other. The first and second surface profiles are mirrors of one another, as are the third and fourth surface profiles.

Referring again to FIG. 1, in the connection surface 10, a portion 36 of the surface is removed, such as by any material removal method known to those of ordinary skill in the art, or by otherwise forming the connection surface without the removed portion. In this example, the removed portion 36 is near or on the X-axis 14. Thus, the first and fourth surface profiles 22, 28 are not perfect image rotations or reflections, but are substantial image rotations or reflections. Portions of connection surfaces can be removed to make the overall surface appear more natural or for other aesthetic benefits, to smooth out the surface, to provide variations of connections surfaces that still nest with one another, to define gaps, or for other reasons. A connection surface 40 without a removed portion is also shown in FIG. 1 (bottom left).

FIG. 1 further shows a combined connection surface 42 including two adjacent connection surfaces 10. These adjacent connection surfaces 10 can be formed using two copies of connection surface 10. A portion 44 is removed from the combined connection surface 42. The two connection surfaces 10 can be considered to oppose one another with respect to a vertical axis between them. Though in this example, the connection surfaces are adjacent, they can also be separated from one another and still connect.

Figure 2:
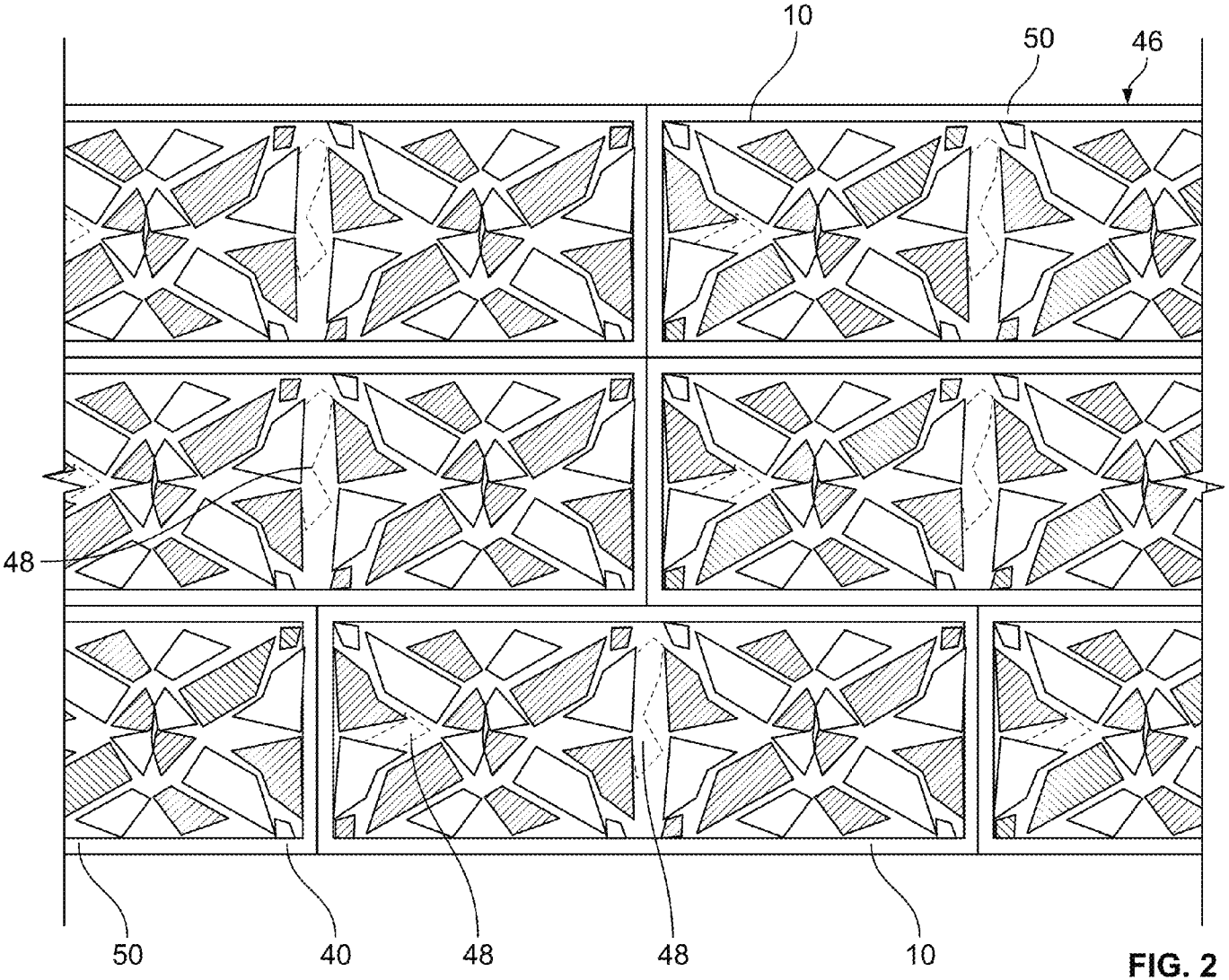
FIG. 2 is a plan view of a combined mosaic connection surface including a two-dimensional array of connection surfaces, according to a fourth embodiment of the invention.

Further, even with multiple connection surfaces 10 arranged horizontally, or vertically, facing combined connection surface can still mate. FIG. 2 shows a combined connection surface 46 including a two-dimensional array of four-quadrant connection surfaces 10. Various portions 48 are removed from the combined connection surface 46, which does not interfere with the nesting connection between mating surfaces. In FIGS. 1 and 2, a bezel 50 surrounds individual connection surfaces 10.

Figure 3:
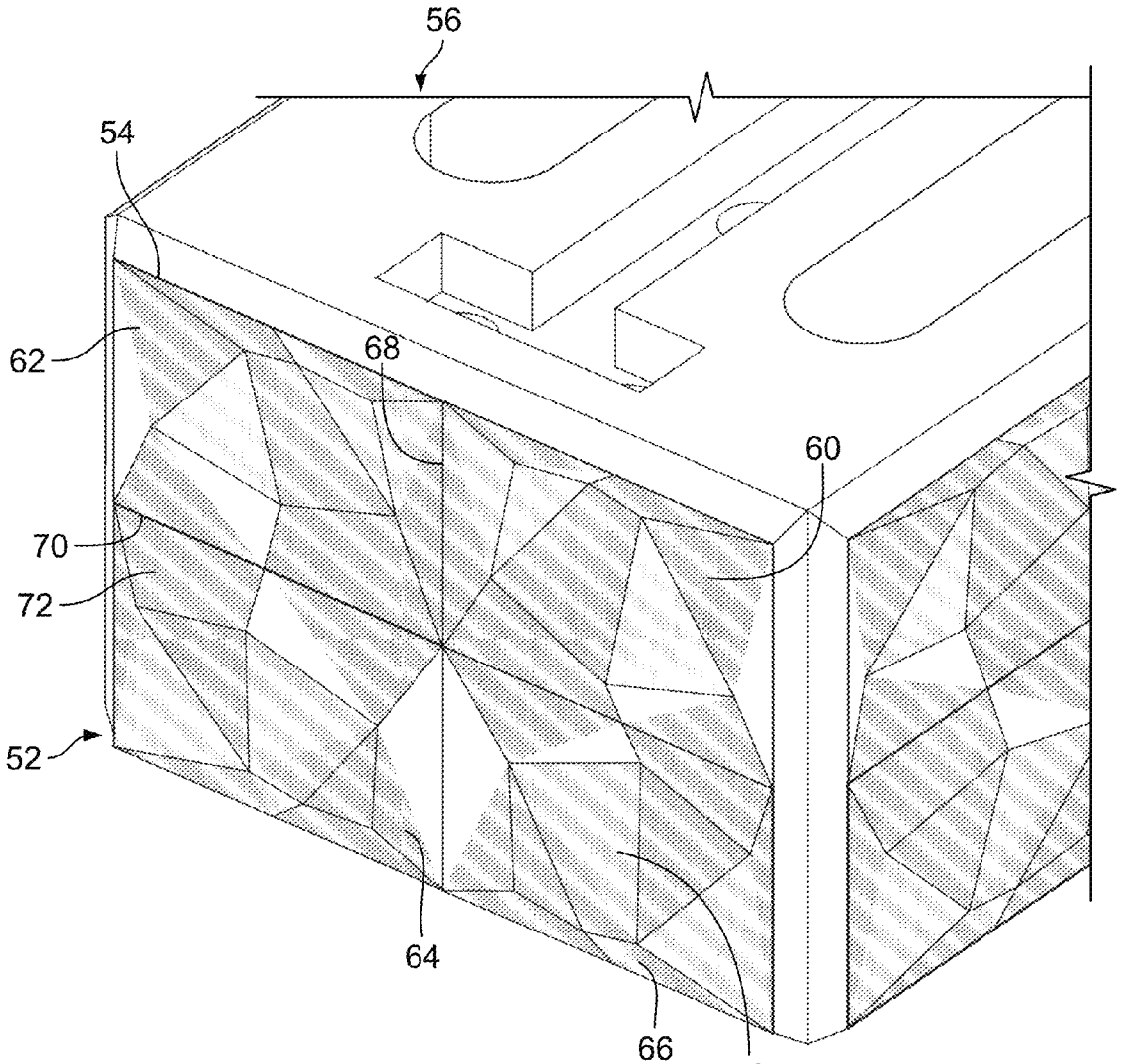
FIG. 3 is a perspective view of a connection surface disposed on a face of a structural unit, according to a fifth embodiment of the invention.

FIG. 3 shows another example connection surface 52 disposed on an end face 54 of a structural unit 56. As with the connection surface 10, the connection surface 52 includes a first surface profile 60, a second surface profile 62, a third surface profile 64, and a fourth surface profile 66, which are disposed in quadrants generally defined by two axises provided by a vertical centerline 68 and a horizontal centerline 70. The surface profiles 60, 62, 64, 66 are complementary to one another similarly to the surface profiles 22, 24, 26, 28. For example, the second surface profile 62 is a reflection of the first surface profile 60 with respect to the vertical centerline 68, but reversed in the normal direction. The surface profiles 60, 62, 64, 66 can be defined, for instance by depths (in the direction normal to the face 54) of positive and negative surface feature portions at various horizontal and vertical locations along the connection surface. In the example connection surface 52, patterns 72 formed by combinations of adjacent complementary surfaces are viewable. If it is desired to provide a more natural overall surface, or for other reasons, portions (not shown) of these patterns 72 can be removed.

Figure 4:
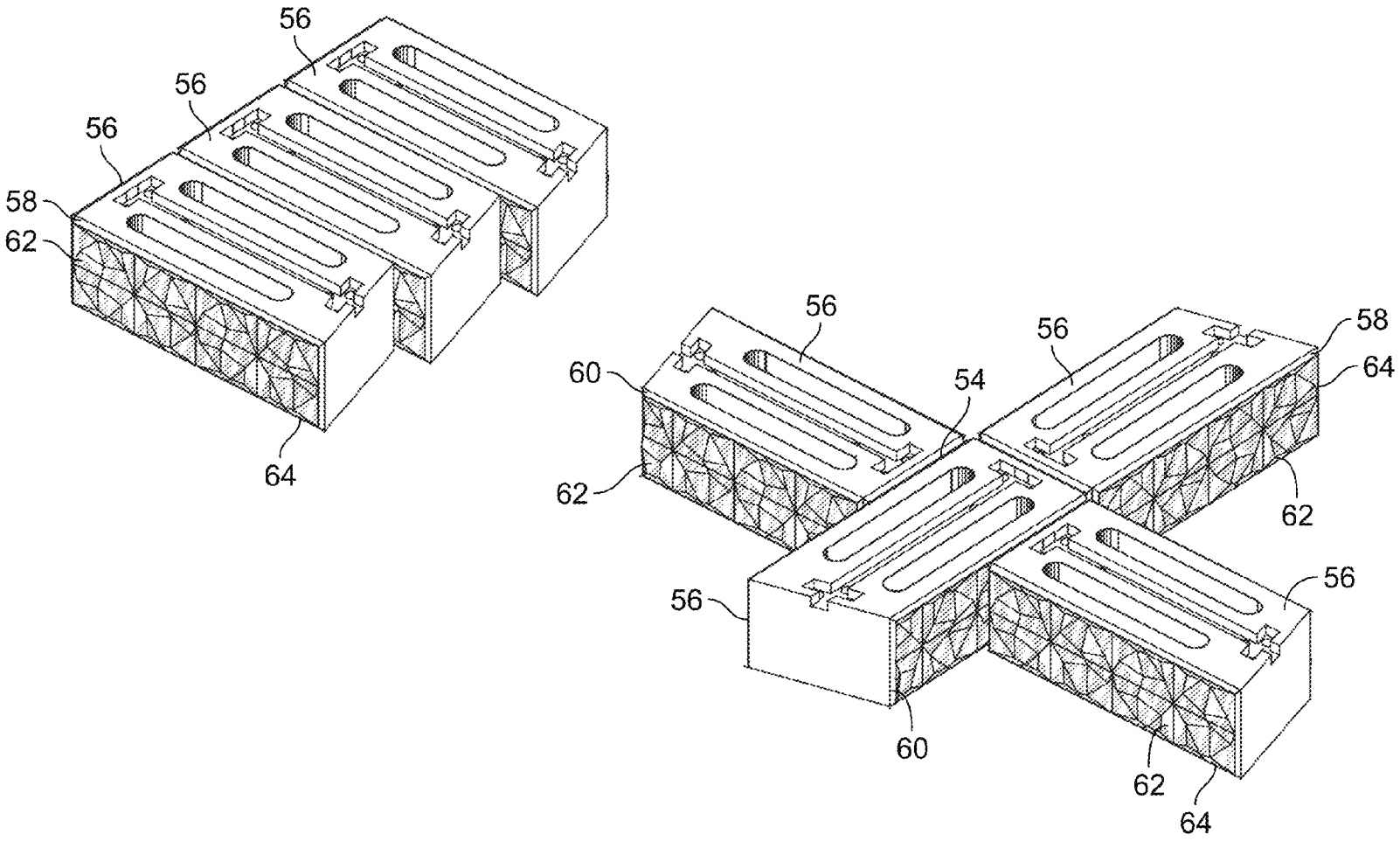
FIG. 4 shows perspective views of two example arrangements of the structural unit of FIG. 3, illustrating various connections between connection surfaces.
Figure 5:
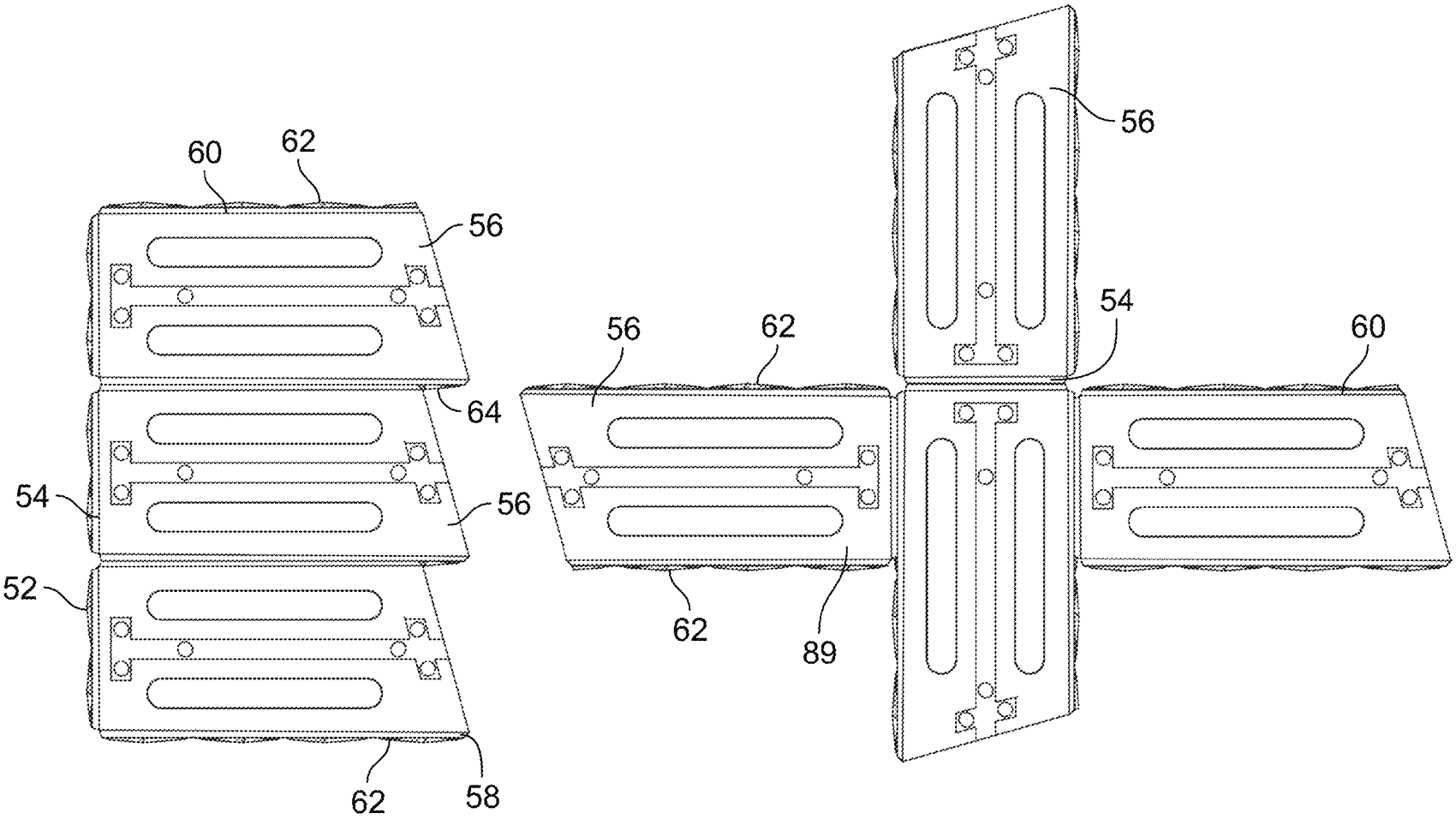
FIG. 5 shows top plan views of the two example arrangements of FIG. 4.

FIGS. 4-5 show two example arrangements of the structural unit 56, illustrating various connections between connection surfaces. A front face 58 and rear face 60 of the structural unit 56 include a connection surface 62 formed by disposing two adjacent connection surfaces 52 adjacent to one another. Because the front face 58 is longer than the rear face 60 in this structural unit 56, the front face 58 includes an outer portion 64 of the connection surface, and the rear face 60 connection surface is truncated. As shown in FIG. 4, the rear face 60 of one structural unit 56 can engage and nest with the front face 58 of an adjacent structural unit. Further, because the connection surface 62 is formed by duplicating the connection surface 52 on the end face 54, the end face can also mate and nest with either the front face 58 or the rear face 60, as also shown in FIGS. 4-5. It will be appreciated that these arrangements are merely exemplary, and that many other arrangements are possible. Arranged structural units 56 can be part of a formed structure, a pallet layout, or other desired arrangement. Facing connection surfaces nest with one another, avoiding relative movement of the blocks and shearing of the surfaces. Further, the overall required area for a layer of nested units on a pallet can be reduced due to the nesting.

Figure 7:
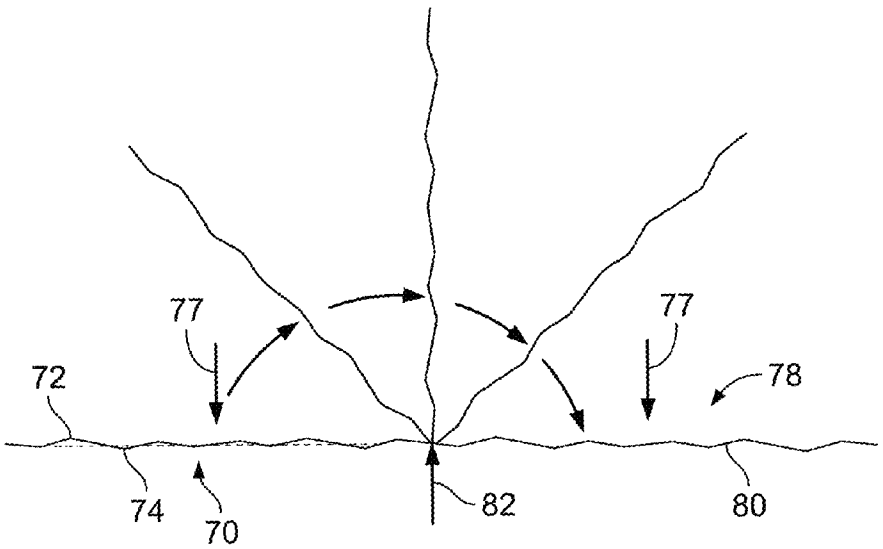
FIGS. 6-8 show sections taken through example connection surfaces in stages as a (left) half is rotated 180 degrees over a (right) half (FIG. 6); as the combined surface in FIG. 6 is rotated 180 degrees over a (right) half (FIG. 7); and as the complete surface in FIG. 7 is combined with a mating surface (FIG. 8).
Figure 6:
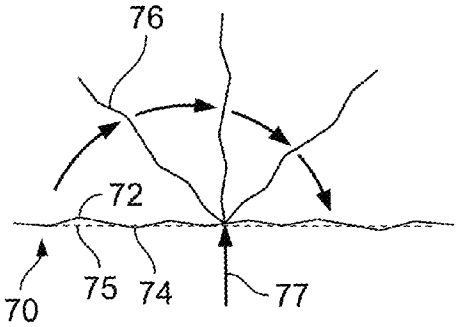
Figure 8:
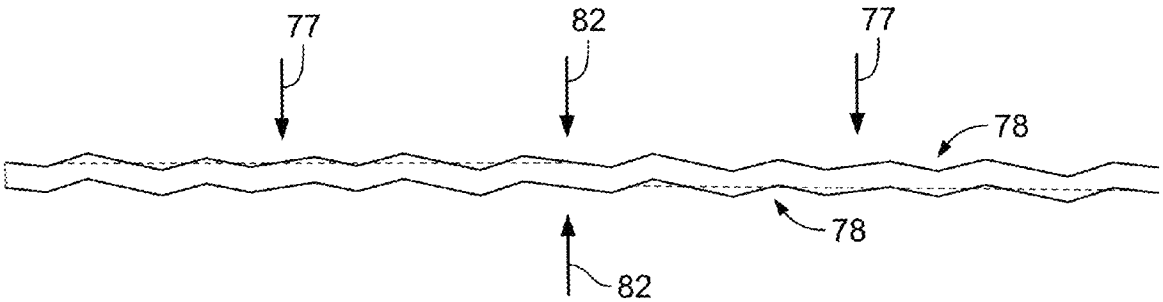
Figure 9:
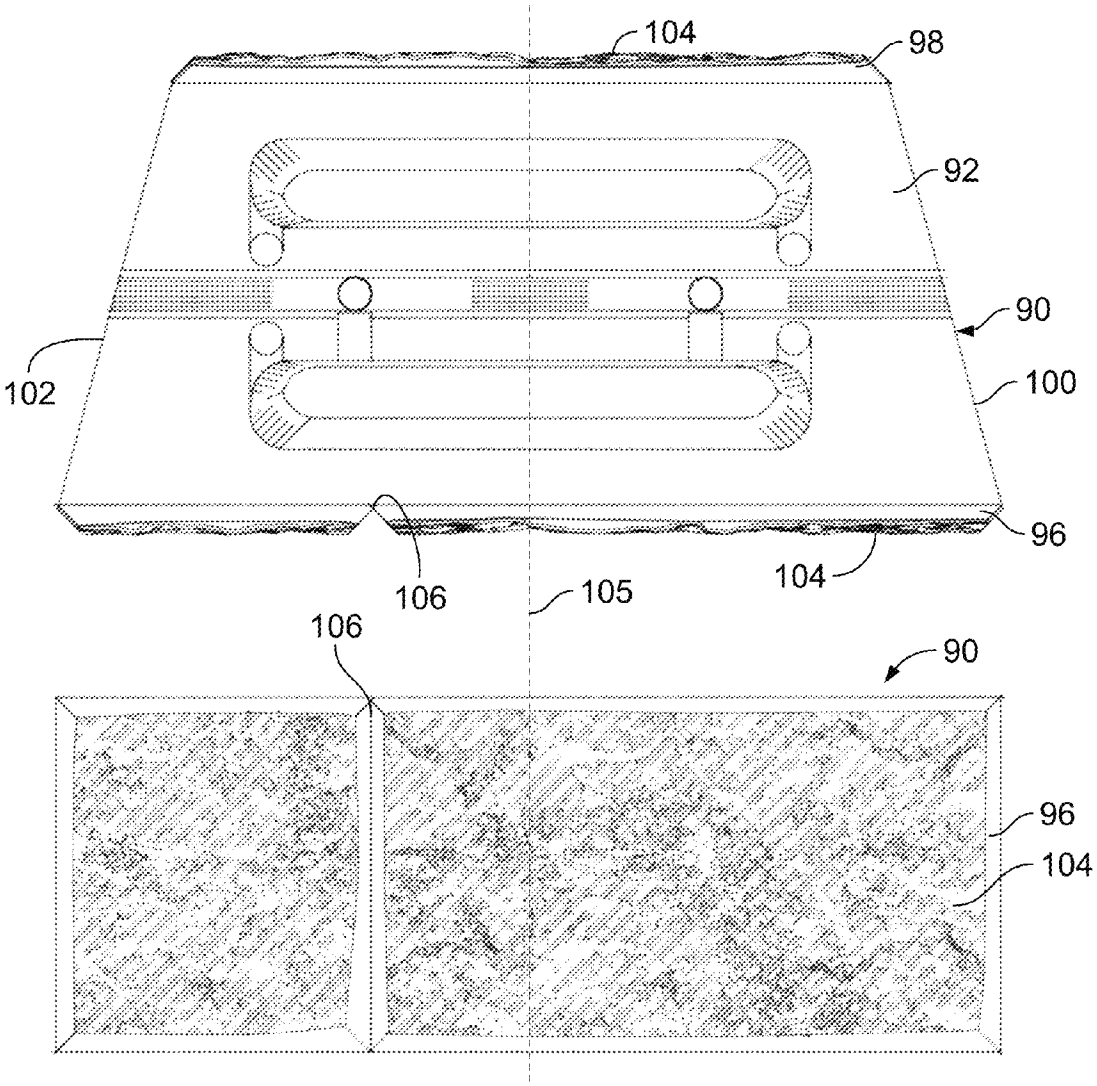
FIG. 9 shows a top plan view and a side elevation view of a trapezoidal structural unit having connecting surfaces according to a sixth embodiment of the invention.
Figure 10:
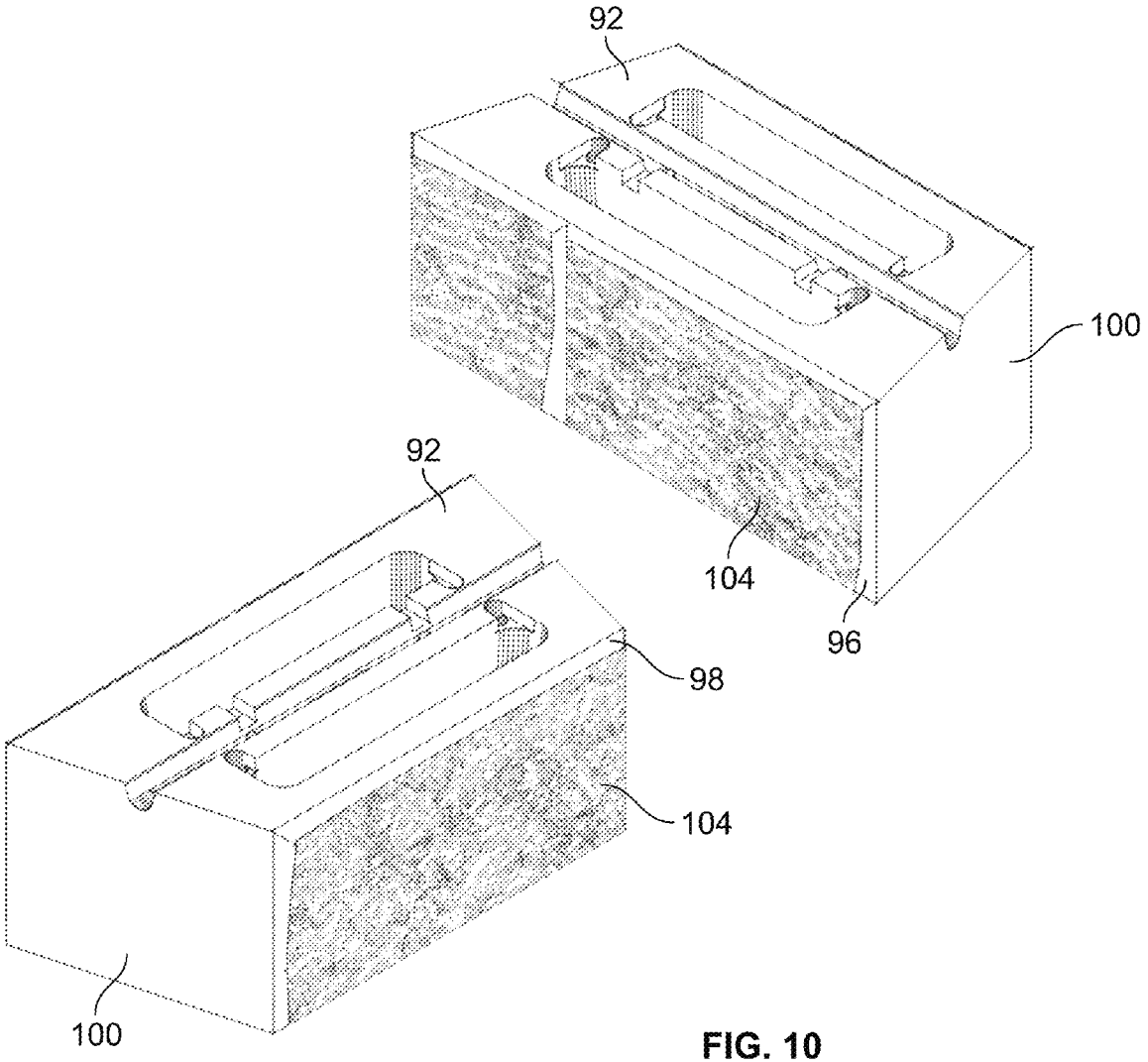
FIG. 10 shows front and rear perspective views of the structural unit of FIG. 9.

FIGS. 6-8 show various horizontal sections taken through an example connection surface. As shown in FIGS. 6-8, the connection surface 70 along each section includes a plurality of positive 72 and negative surface features 74, where positive surface features extend outwardly from a plane 75, and the negative surface features extend inwardly from the plane. In FIG. 6, the left half 76 of the surface is rotated 180 degrees over the right half, about a center point 77. In FIG. 7, a combined surface 78 is shown. The left half of the combined surface 78, formed by duplicating the complete surface 70 shown in FIG. 6 (i.e., both left and right halves of the FIG. 6 surface), is rotated 180 degrees over the right half 80, about a center point 82. FIG. 8 shows the combined surface 78 in FIG. 7 (i.e., both left and right halves of the FIG. 7 surface), and a second, identical combined surface 78 facing the first combined surface. As shown in FIG. 7, the mating sectional surfaces 70 shown in the horizontal sections are 180 degree rotations with respect to a centerline 77, and both left and right halves, respectively, are 180 degree rotations with respect to the centerline (center point 82) of the respective halves. This allows for facing connection surfaces to nest, as shown in FIG. 8, reducing movement and shear between mating connection surfaces, and reducing a required combined area for structural units.

Connection surfaces can be fabricated or molded into various surfaces of structural units. FIGS. 9-13 show a structural unit embodied in a trapezoidal structural wall unit 90. The wall unit 90 includes a top face 92 and opposed bottom face 94 (see FIG. 12), first and second opposed side faces 96, 98, and first and second opposed end faces 100, 102. The side faces 96, 98 include a connection surface 104. The connection surface 104 on the longer side face 96 is longer than that of the shorter side face 98. The connection surface 104 on the shorter side face 98 may be formed by truncating each end of the connection surface from the longer side face 96 with respect to a centerline 105. A false joint 106 is provided on the longer side face 96, but false joints or other features can be disposed at any location or locations and along any directions, without affecting the surface connection. In this wall unit, the end faces 100, 102 are not provided with a connection surface, though in other embodiments all sides, or even upper and lower surfaces, can include connection surfaces.

Figure 11:
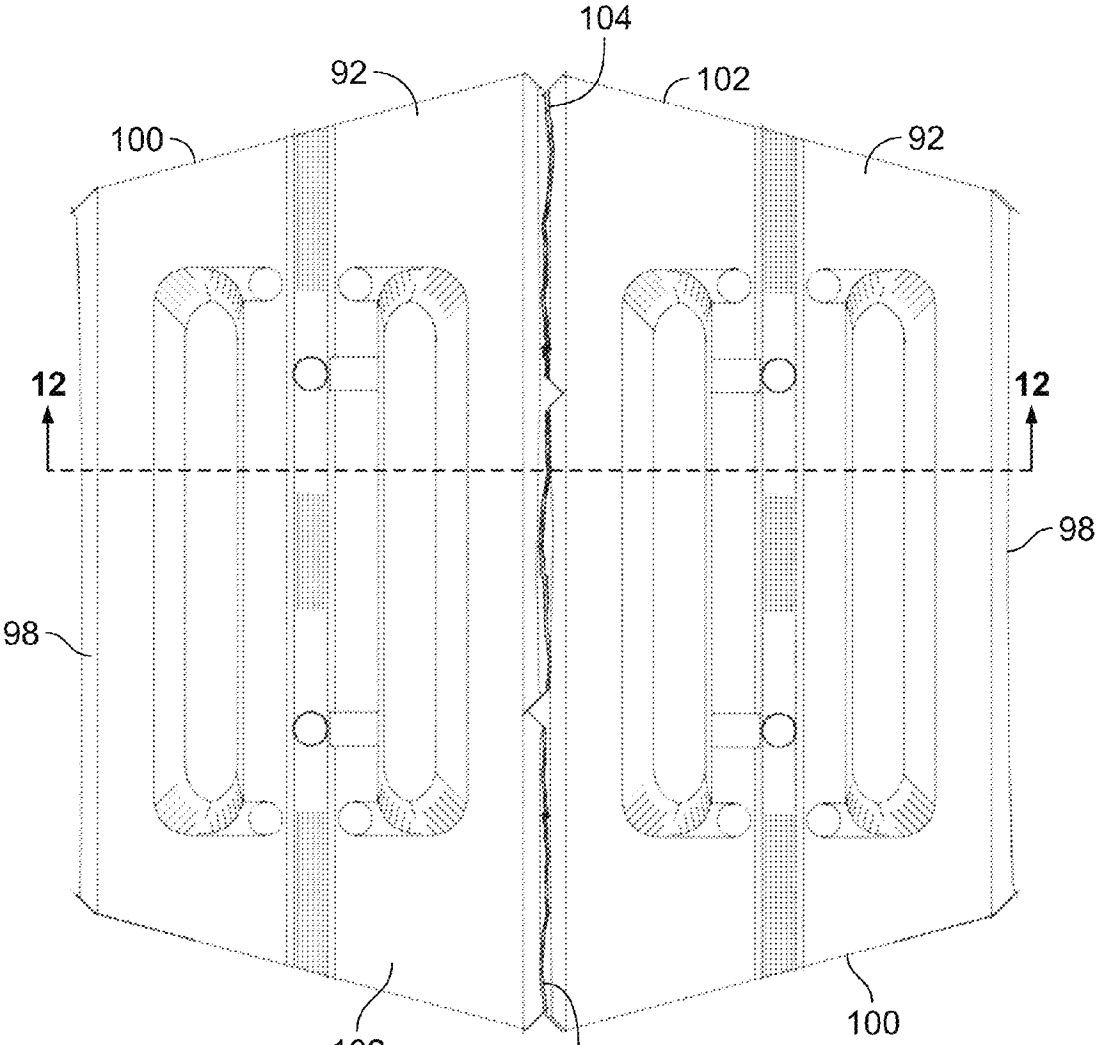
FIG. 11 is a top plan view of two structural units according to FIG. 7 joined to one another at front faces.
Figure 12:
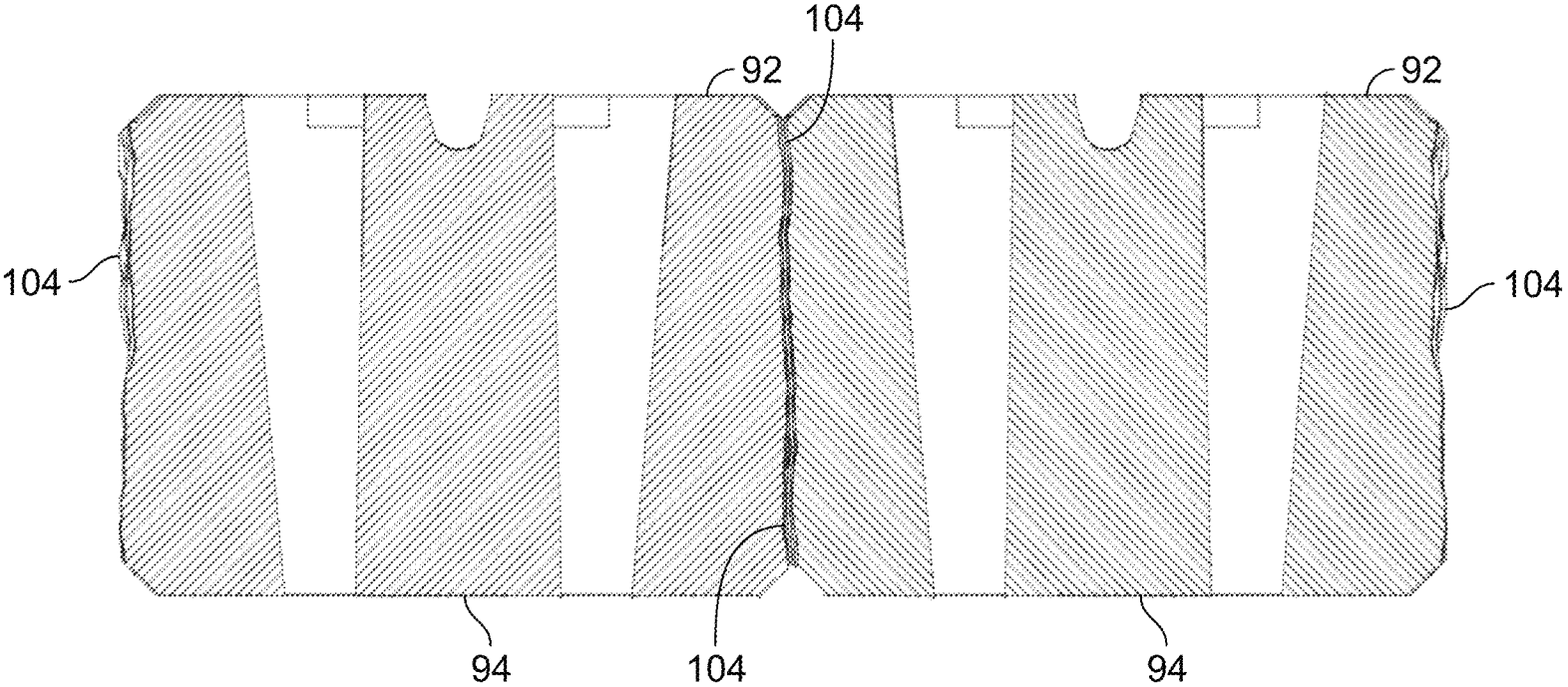
FIG. 12 is a sectional view of the two joined structural units of FIG. 9, taken along section 12-12 in FIG. 11.
Figure 13:
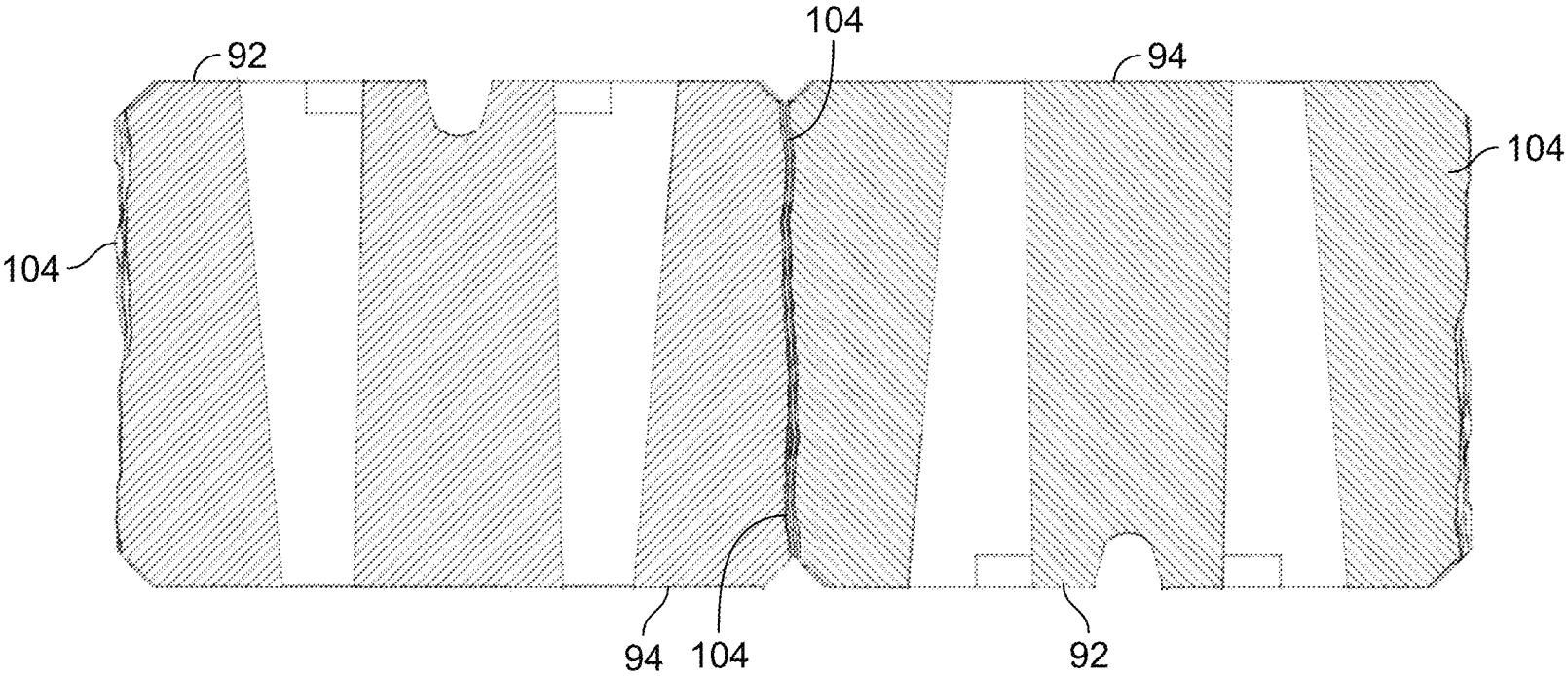
FIG. 13 is a sectional view of two structural units according to FIG. 9 joined to one another at front faces, where one of the structural units is inverted.

The connection surface 104 is significantly more complex and irregular in its surface features than the connection surfaces 10, 52, and the surface has a more "random" and natural appearance. However, facing connection surfaces 104 still mate and nest with one another, as shown in FIGS. 11-13. For example, as shown in FIGS. 11-12, the mated connection surfaces 104 on the facing wall units 90 form connection profiles along both the horizontal and vertical directions that are 180 degree rotations, as with the connection surface 52. Further, due to the symmetry provided by the connection surfaces 104, as seen in the cross-section of FIG. 12, even when one of the wall units 90 is inverted with respect to a facing wall unit, the connection surfaces 104 still mate, as shown in FIG. 13. The false joint 106 does not interfere with the connection. Though FIG. 12 illustrates a near-perfect nesting, it is also contemplated that the nesting between connection surfaces 104 may not be near-perfect in all cases, for example at points where material has been intentionally removed as disclosed elsewhere herein.

Figure 14:
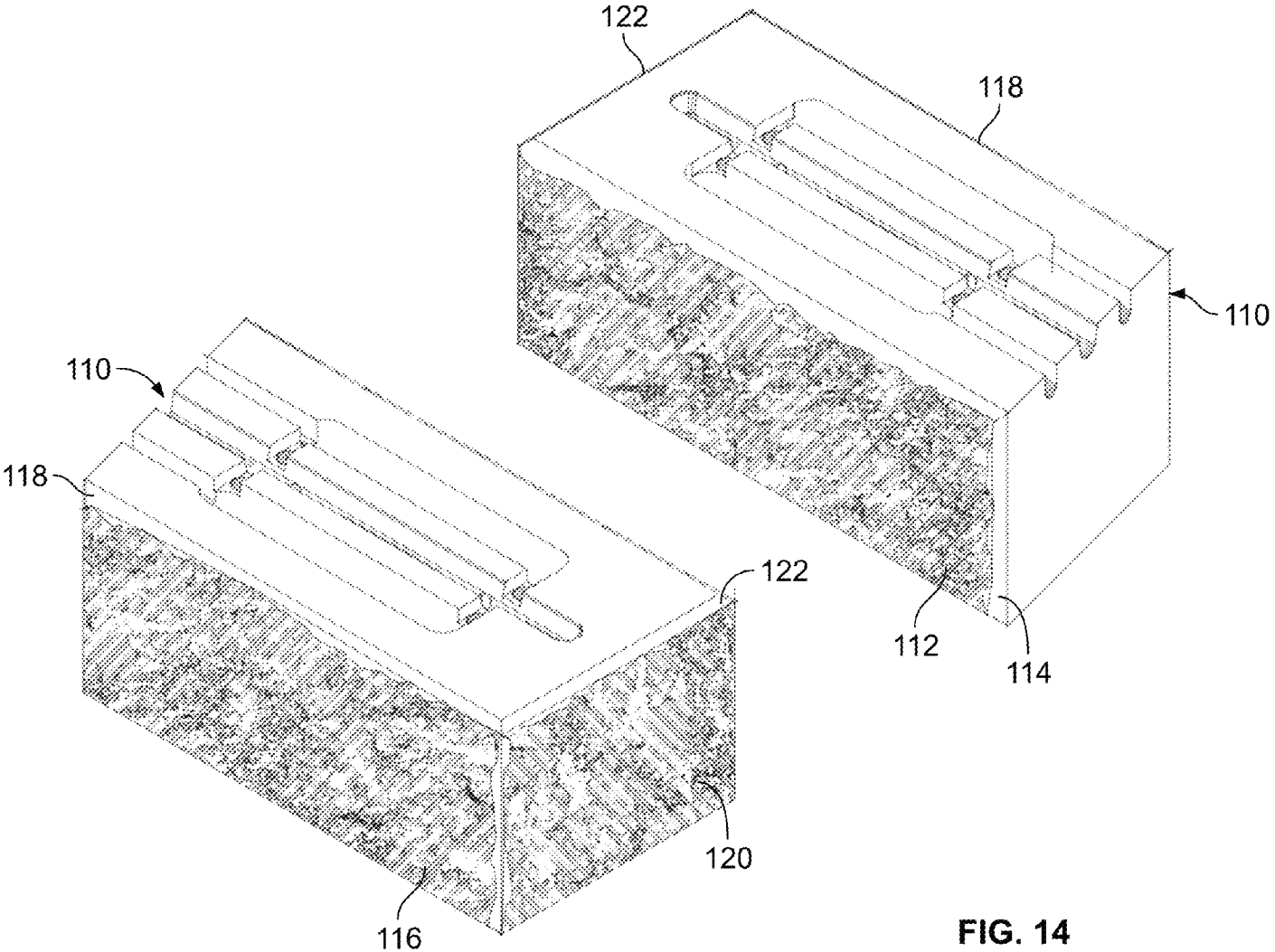
FIG. 14 shows front and rear perspective views of an orthogonal structural unit having example connection surfaces according to a seventh embodiment of the invention.
Figure 15:
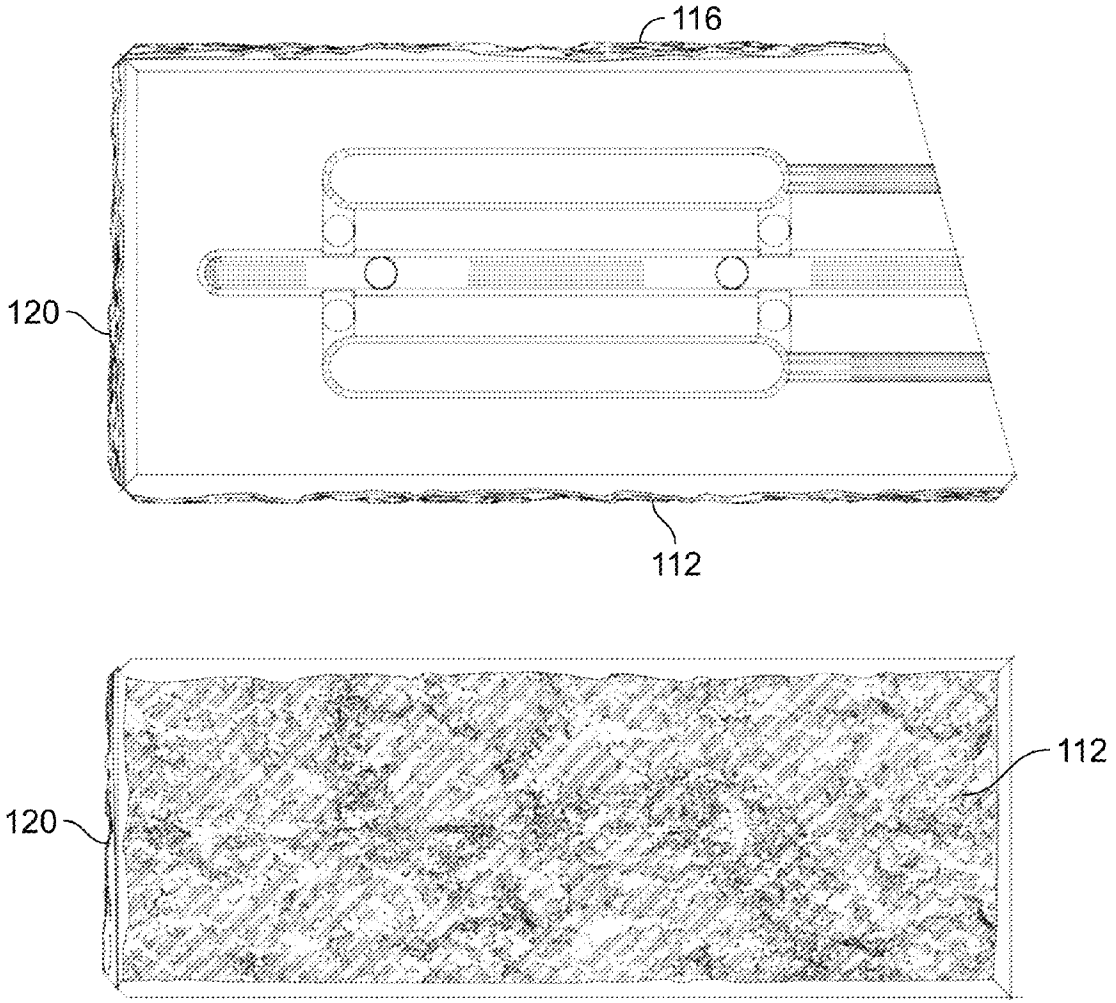
FIG. 15 shows top plan and front elevation views of the orthogonal structural unit of FIG. 14.
Figure 16:
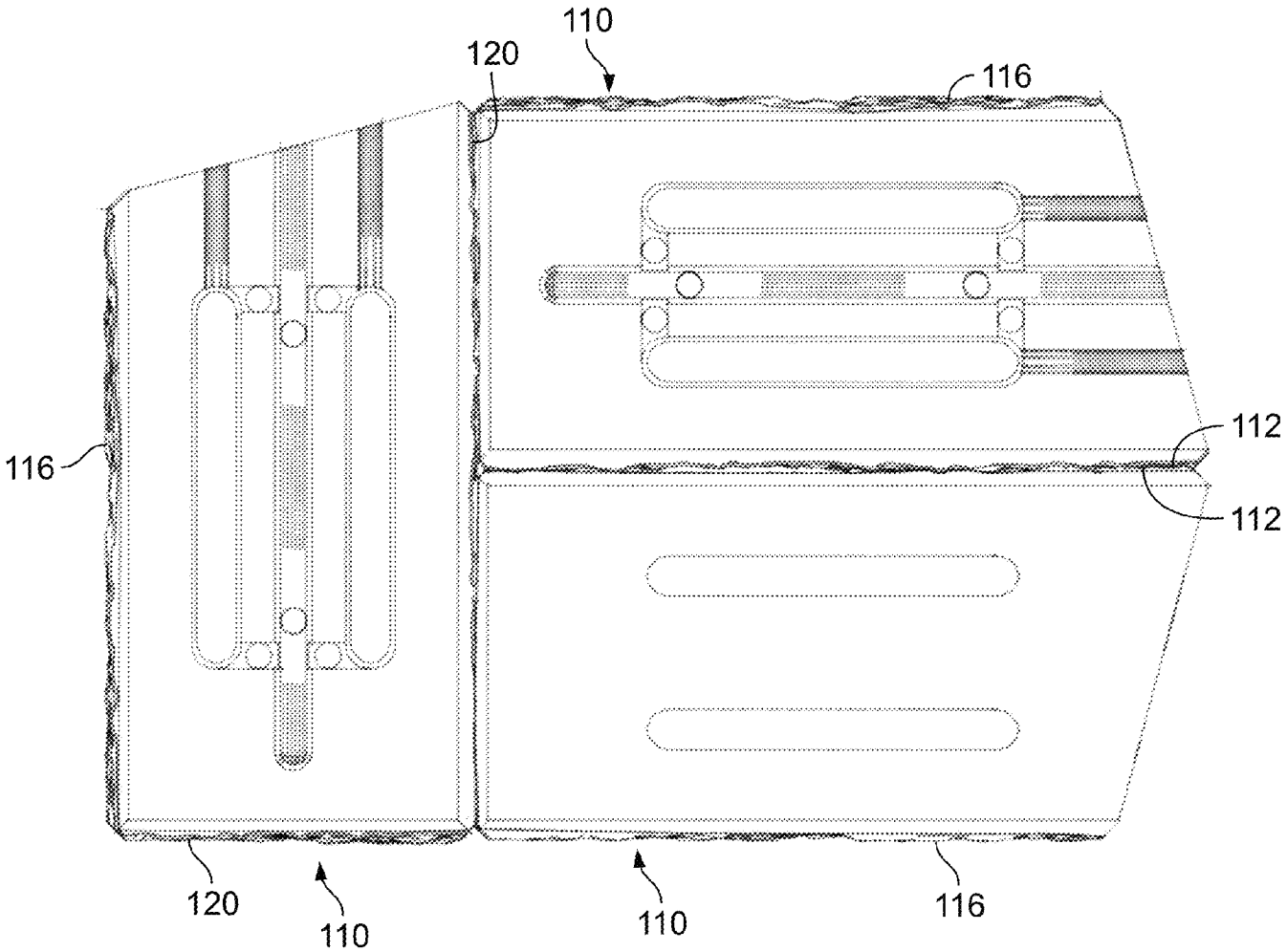
FIG. 16 is a top plan view of an example arrangement of connected orthogonal structural units according to FIG. 15, where one of the units is inverted.

FIGS. 14-16 show an orthogonal wall unit 110 according to another embodiment, in which a connection surface 112 is formed on a (longer) first face 114, a (truncated) connection surface 116 is formed on a (shorter) second face 118, and a connection surface 120 is formed on an orthogonal end face 122. In this example wall unit 110, the first face 114 is twice the length of the end face 122. Further, in this example wall unit 110, the connection surface 120 is formed from four quadrants similarly to connection surface 52, the (eight segment) connection surface 114 is formed by duplicating the four quadrants and positioning the two sets of four quadrants adjacent to one another, and the connection surface 116 is formed using the connection surface 114, but removing a portion on one end. The eight segment connection surface 112 can be configured similarly to the connection surface 104, or in other ways.

As shown in FIG. 16, orthogonal wall units 110 may be arranged so that two end connection surfaces 120 (e.g., having four segments each) can mate with the connection surface 112 of the first face 114 (or, alternatively, with the connection surface 116 of the (shorter) second face 118, though a portion of one of the connection surfaces 120 would be exposed), even when one of the units is inverted. As also shown in FIG. 16, the connection surface 116 of the second face 118 can mate with the connection surface 112 of the first face 114, with a portion 124 of the connection surface 112 being exposed due to the difference in lengths between the first and second faces 114, 118.

Figure 17:
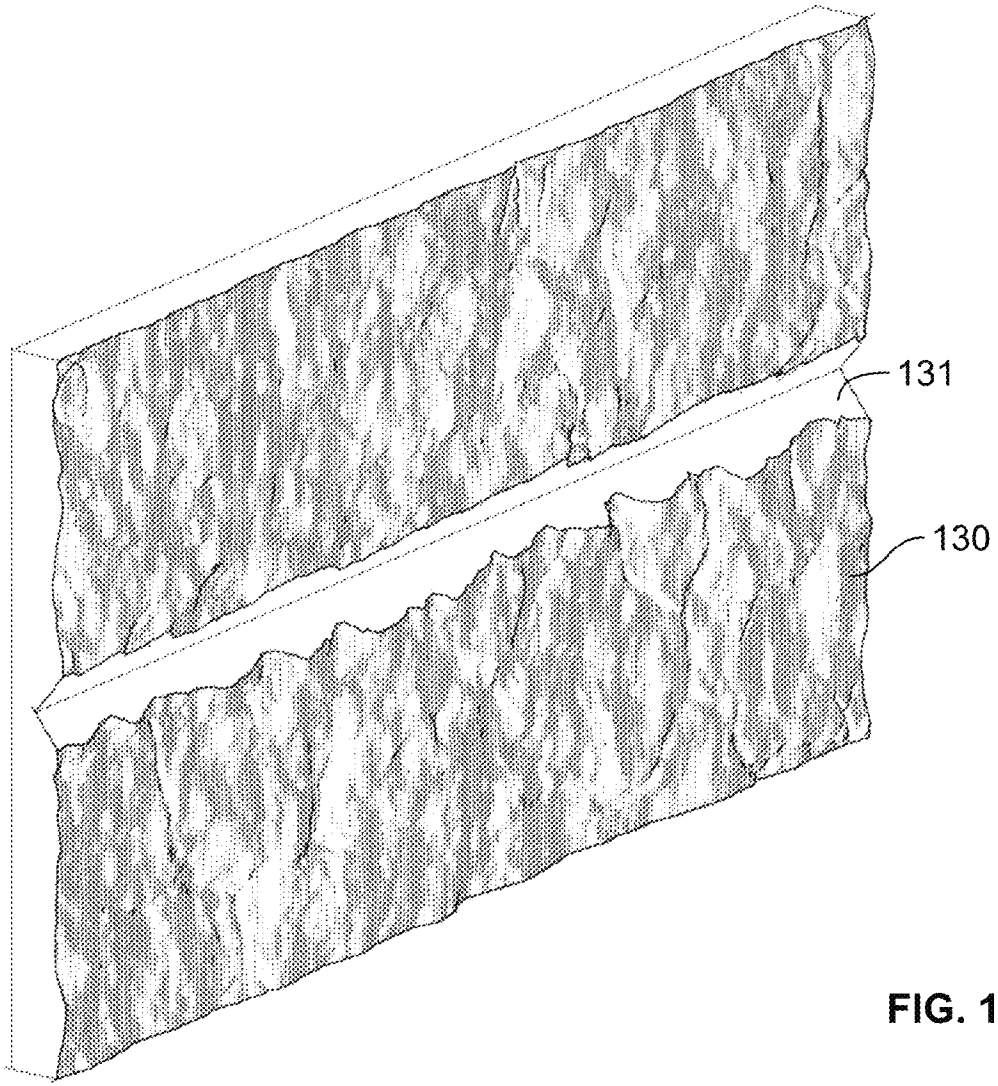
FIG. 17 is an enlarged view of the front connection surface of the structural units of FIGS. 9-16, with a false joint provided.
Figure 18:
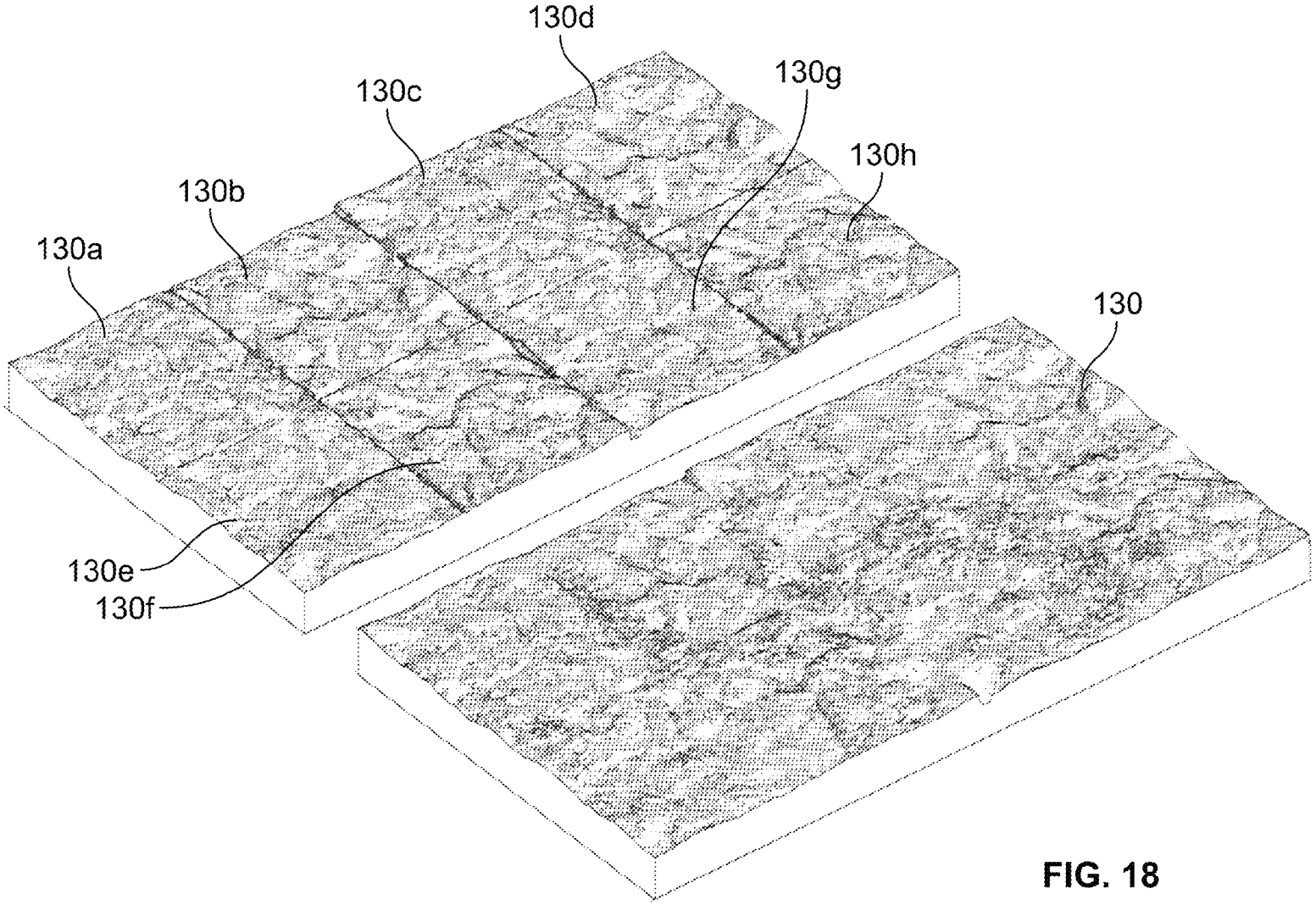
FIG. 18 shows enlarged perspective views of the front connection surface of the structural units of FIGS. 9-16, where the top view shows the surface before seams between sections are removed, and the bottom view shows the surface after seams between sections are removed.
Figure 19:
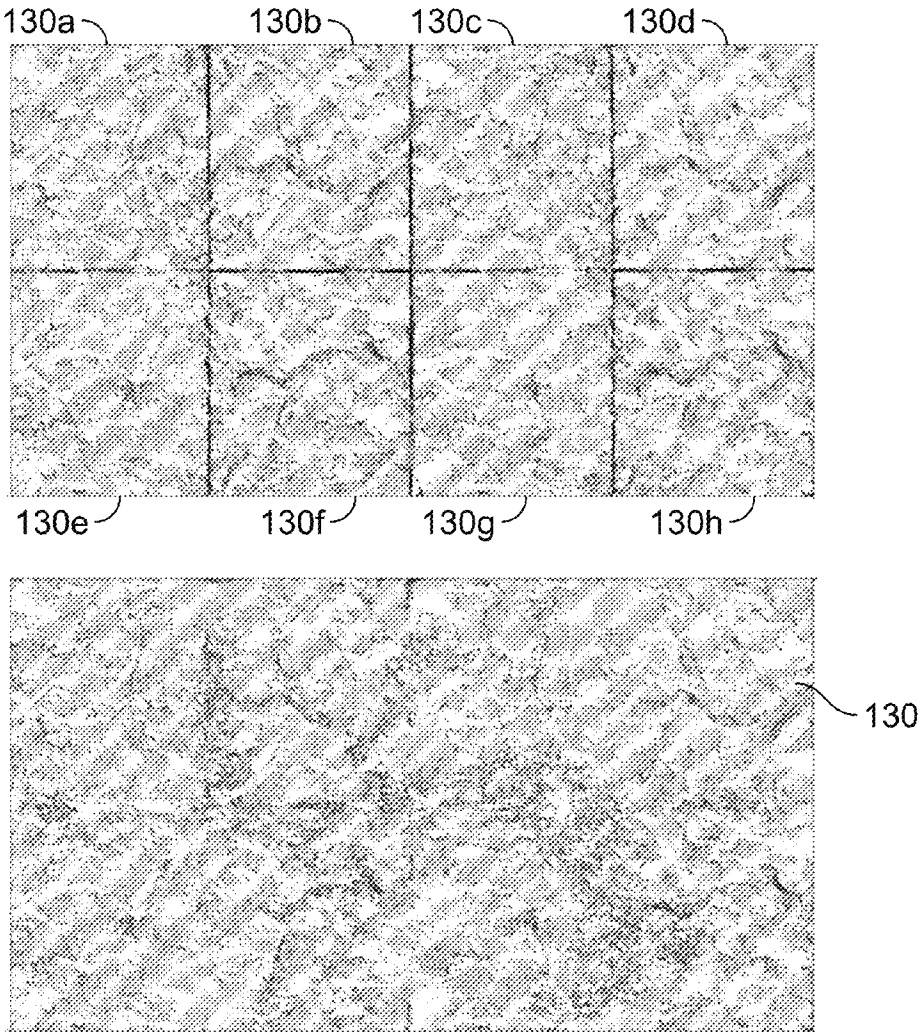
FIG. 19 shows top plan views of the enlarged front connection surfaces in FIG. 18.

FIGS. 17-19 show an example complex connection surface 130, which may be configured similarly to the connection surfaces 104, 112. As shown in FIG. 17, the connection surface 130 appears largely random and natural, and has a horizontal false joint 131 extending through the center, though any combination of false joints may be used, or no false joints. However, as shown in the left connection surface 130 in FIG. 18 and the top connection surface in FIG. 19, the connection surface 130 is divided, both conceptually and physically by seams, into eight segments 130*a*-130*f* as disclosed above, where pairs of segments 130*a* and 130*d*, 130*b* and 130*c*, 130*e* and 130*h*, 130*f* and 130*g*, 130*a* and 130*e*, 130*b* and 130*f*, 130*c* and 130*g*, and 130*d* and 130*h* are respectively complementary to one another. In an example embodiment, the group of segments 130*a*, 130*b*, 130*e*, 130*f* is duplicated by the group of segments 130*c*, 130*d*, 130*g*, 130*h*, forming two equal groups of segments. The right connection surface 130 in FIG. 18 is identical to the left connection surface 130, but with the surfaces adjacent to the seams partially removed and minimized to blend adjacent surfaces together, obscuring the seams and providing a more natural, rock-like appearance.

Figure 20:
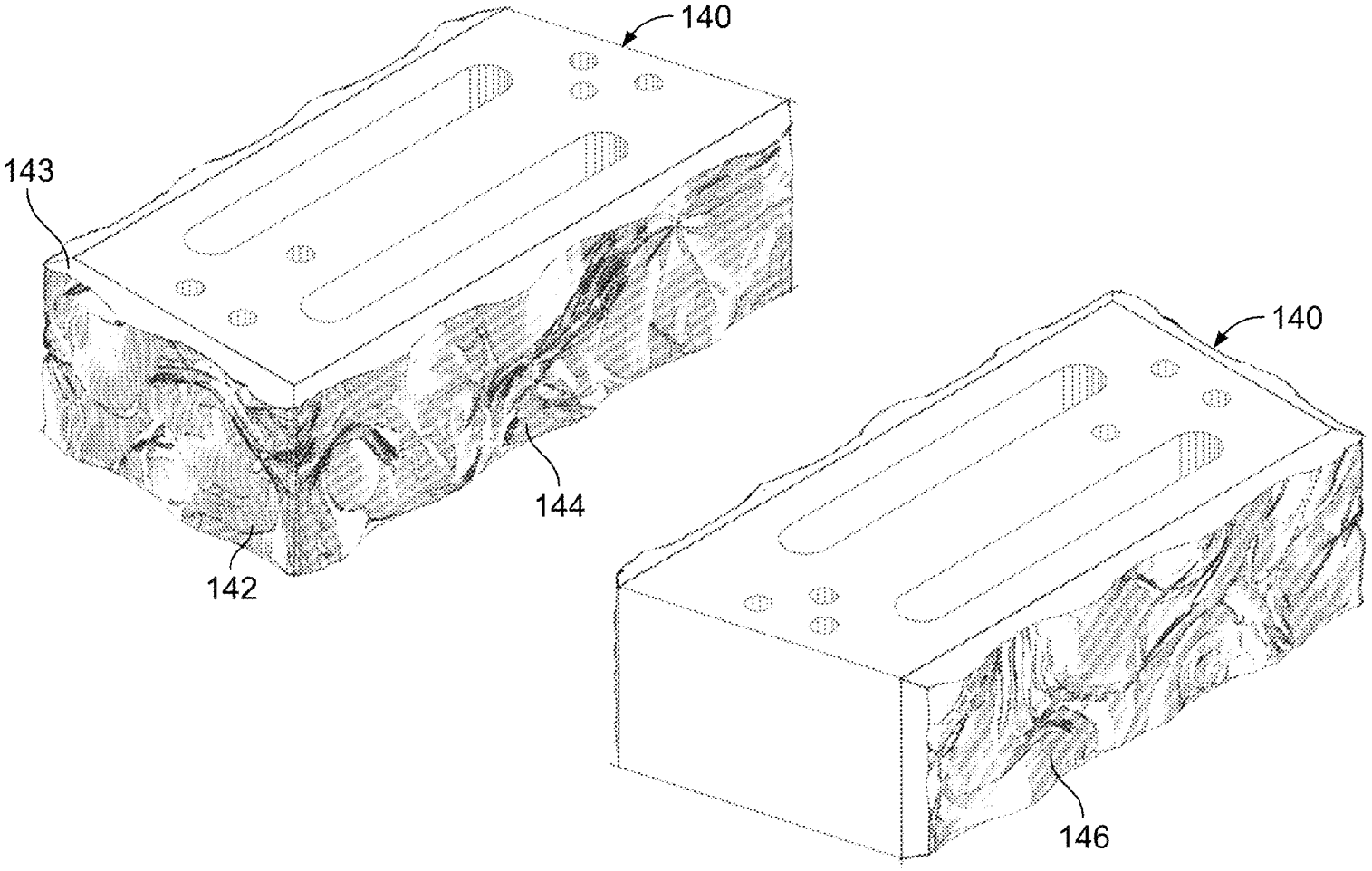
FIG. 20 shows front and rear perspective views of a trapezoidal structural unit having sinusoidal connection surfaces, according to an eighth embodiment of the invention.
Figure 21:
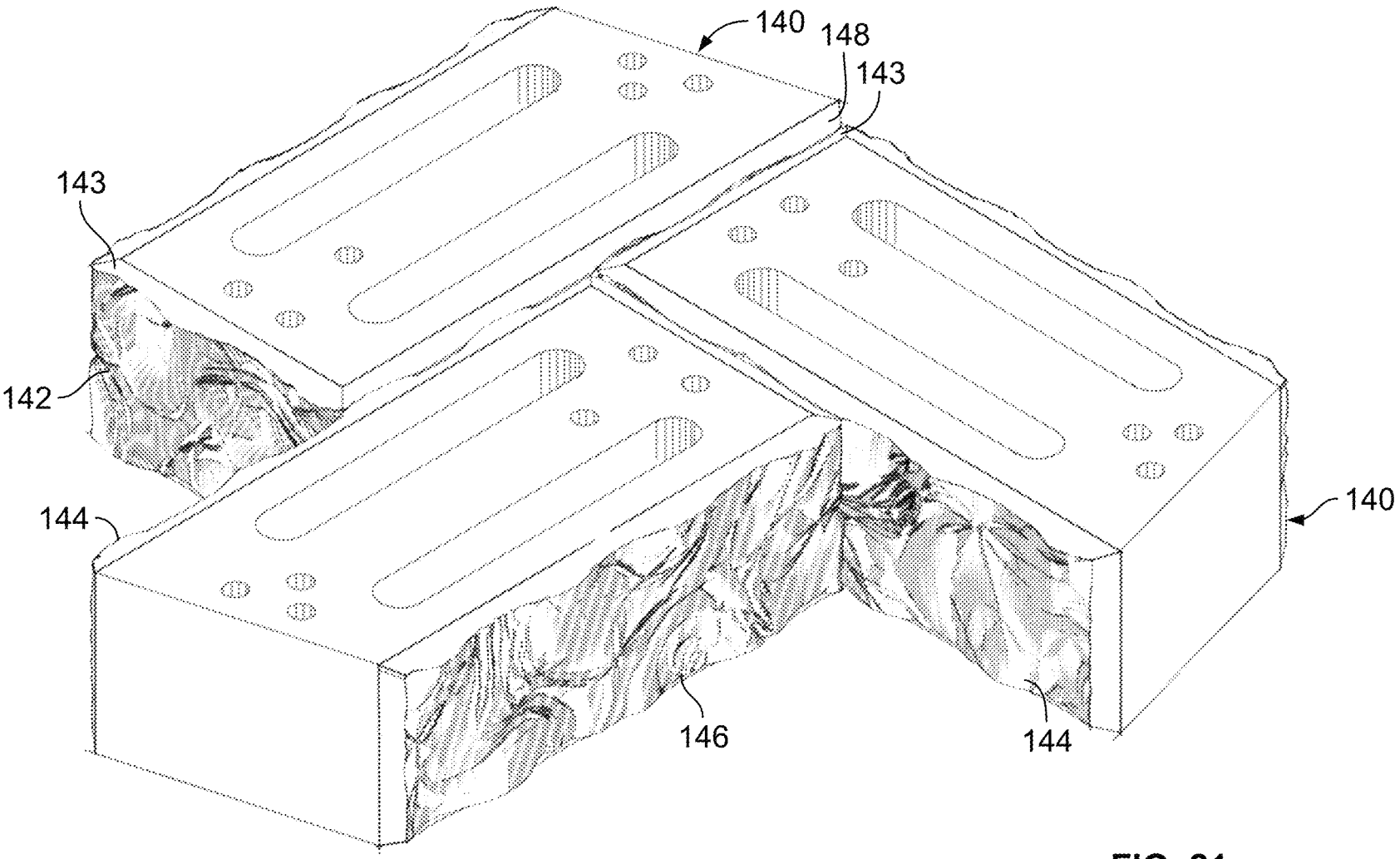
FIG. 21 is a perspective view of an example arrangement of joined structural units according to FIG. 20, illustrating both end and side connections.
Figure 22:
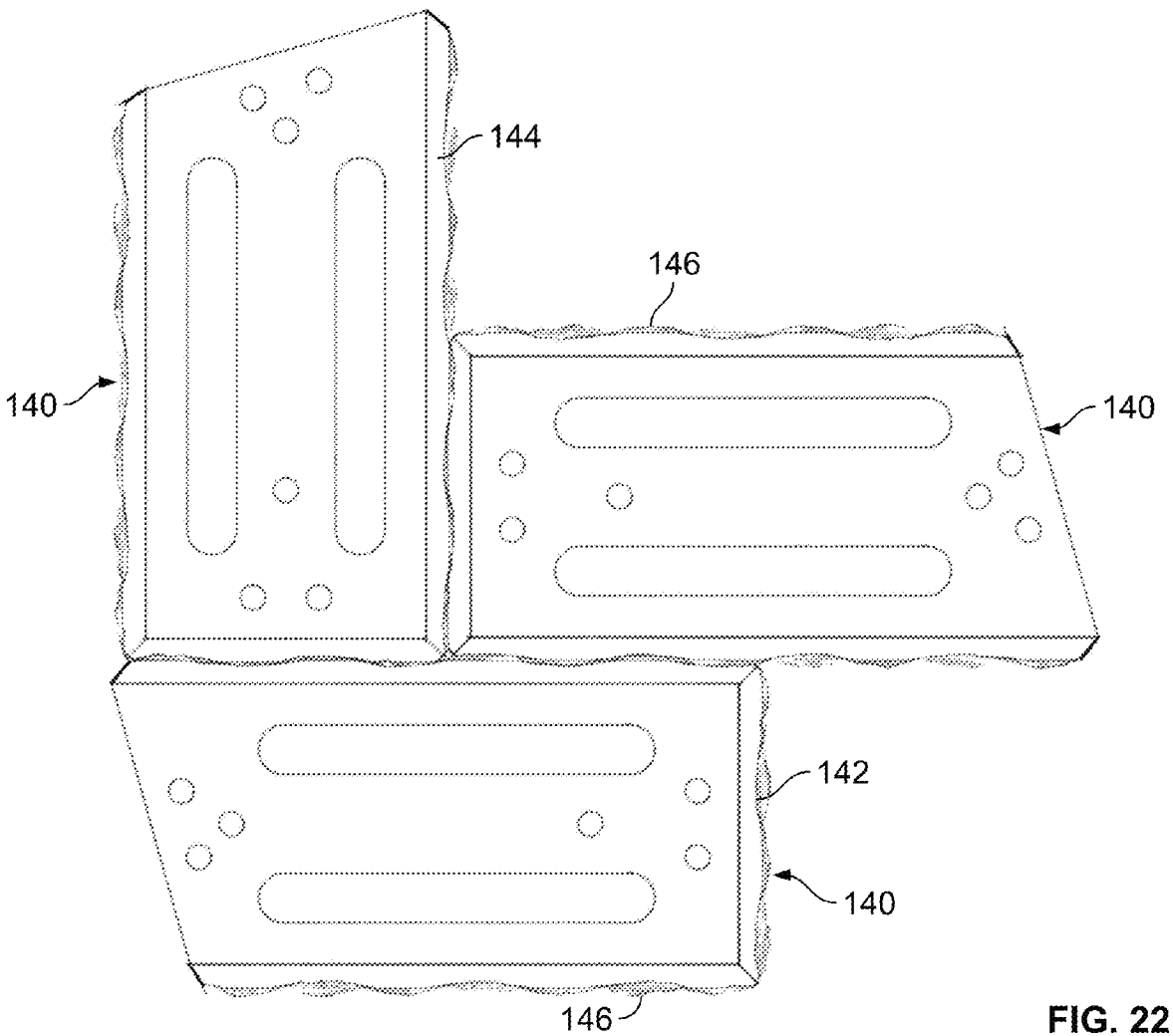
FIG. 22 is a top plan view of the example arrangement of FIG. 21.

FIGS. 20-22 show a structural wall unit 140 according to another embodiment of the invention, which is an orthogonal unit similar to orthogonal wall unit 110, but with connection surface 142 at an end face 143 and first and second side face connection surfaces 144, 146 at first and second sides 148, 149 that have generally sinusoidal contours, illustrating smooth-flowing connection surfaces and additional variations in depths of features. As with the connection surfaces 112, 116, 120, the end face connection surface 142 can be divided into four quadrants, the longer side face connection surface 144 can be formed by duplicating and joining two of the end face connection surfaces 142, and the shorter side face connection surface 146 can be formed by removing an end portion of the longer side face connection surface.

FIGS. 21-22 show an example arrangement of the wall units 140. In this example arrangement, a portion (e.g. half) of a first side face connection surface 144 of a first wall unit 140 and an end face connection surface 142 of a second wall unit 140 together mate with an entire first side connection surface 144 of a third wall unit 140. An end connection surface 142 of the first wall unit 140 also mates with a portion (e.g., half) of a first side face connection surface 144 of the second wall unit 140. These connections are possible because the first side connection surface 144 is provided by twice duplicating the end connection surface 142 and positioning them adjacent to one another. This interlocking connection of arranged wall units 140 reduces overall space of the connected wall units and resists relative movement of the wall units.

Example methods for providing connection surfaces and forming connection surfaces on structural units are disclosed herein. In designing or selecting the connection surface, it may be desirable to provide particular connection surface features based on criteria such as but not limited to a desired or required structural connection, required amount of protection for connected structural units, or a depth of surface. Given the design criteria, connection surfaces may be generated by methods such as hand sculpting or carving; digital sculpting; parametric surface generation; reverse engineering of existing surfaces; extracting from photographs or other images; generating or extracting contour maps; scanning surfaces using a scanning bed; scanning surfaces using photogrammetry or handheld scanners; physically copying a surface, e.g., casting; generating spectral data; or any combination of the above.

Given a particular generation method or combination of methods, it is useful to design the connection surface based on one or more design parameters. Connection surfaces can vary in multiple ways. For example, a surface of a particular segment, and thus the surfaces of complementary and duplicated segments, can vary in shapes in all three dimensions (e.g., x, y, z dimensions as set out above). Particular surface segments in some example generation methods can be formed by scanning or otherwise extracting existing surface features. The arrangement or pattern of segments can also vary, and example segment arrangements and patterns are set out herein.

Further, the connection surface may be selected, designed or configured based on a desired nesting between connected structural units. For example, irregular or partial nesting may be desired. A particular spacing between units may be desired. The nested connection may also be targeted structurally, for example to reduce shear or impact among connected units, to assist in nesting, etc.

Figure 23:
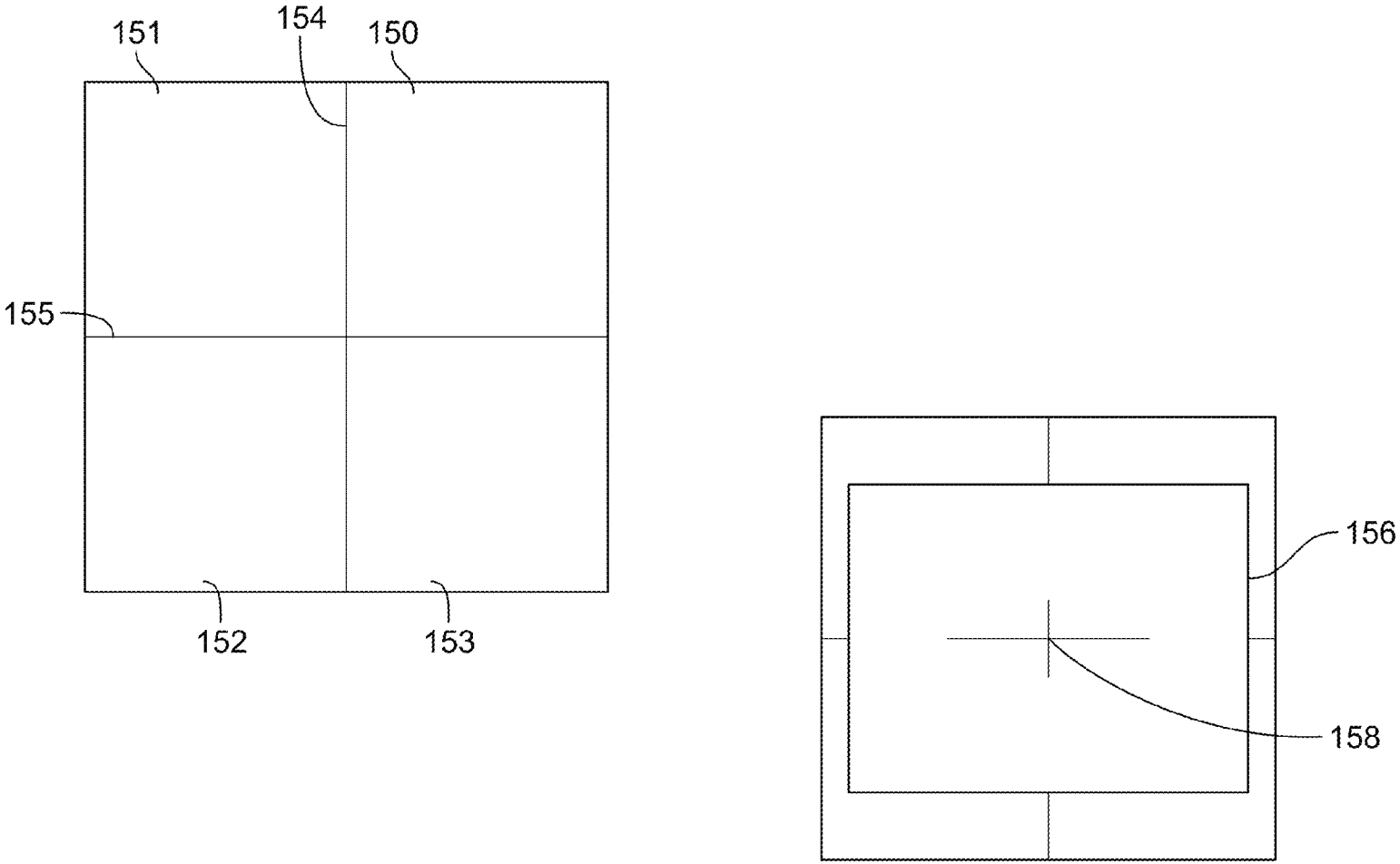
FIG. 23 shows steps in an example method for forming a connection surface on a structural unit.

A particular example method for forming one or more connection surfaces on a structural unit will now be described. Referring to FIG. 23, generally, a primary panel 150 and a complementary secondary panel 151 are formed side-by-side into a single unit. The secondary panel can be provided by mirroring the image from the primary panel. Complex three-dimensional images may also be used to form primary and secondary panels.

The primary panel and the secondary panel are generally mirror images (180 degree rotations) of one another, opposing one another with respect to an axis 154, and providing complementary segments as disclosed above. The additional panels 152, 153 can be formed from the combined panels 150, 151 by taking a mirrored image of the combined panels, and rotating them 180 degrees along a horizontal axis 155.

A single primary panel and a secondary panel, or multiples of a primary and secondary panel, can form a connection surface. In FIG. 23, two sets of primary and secondary panels 150, 151, 152, 153 are arranged with respect to two perpendicular axises 145, 155 to form four quadrants as described above. In other examples, two sets of primary and secondary panels can be arranged along a single line to provide a book fold configuration. For other connection surfaces, arrays of four primary panels and four secondary panels, arranged in two adjacent sets of quadrants, are formed.

A central interior portion of the arranged primary and secondary panels 150, 151, 152, 153 can be sized or clipped to provide a desired connection surface 156 for a particular face about center point 158. This new connection surface can be used to populate desired faces of a structural unit, using methods described above and herein, which will be appreciated by those of ordinary skill in the art. After forming the connection surface on a face, the surface can be chamfered or blended as desired.

Figure 24:
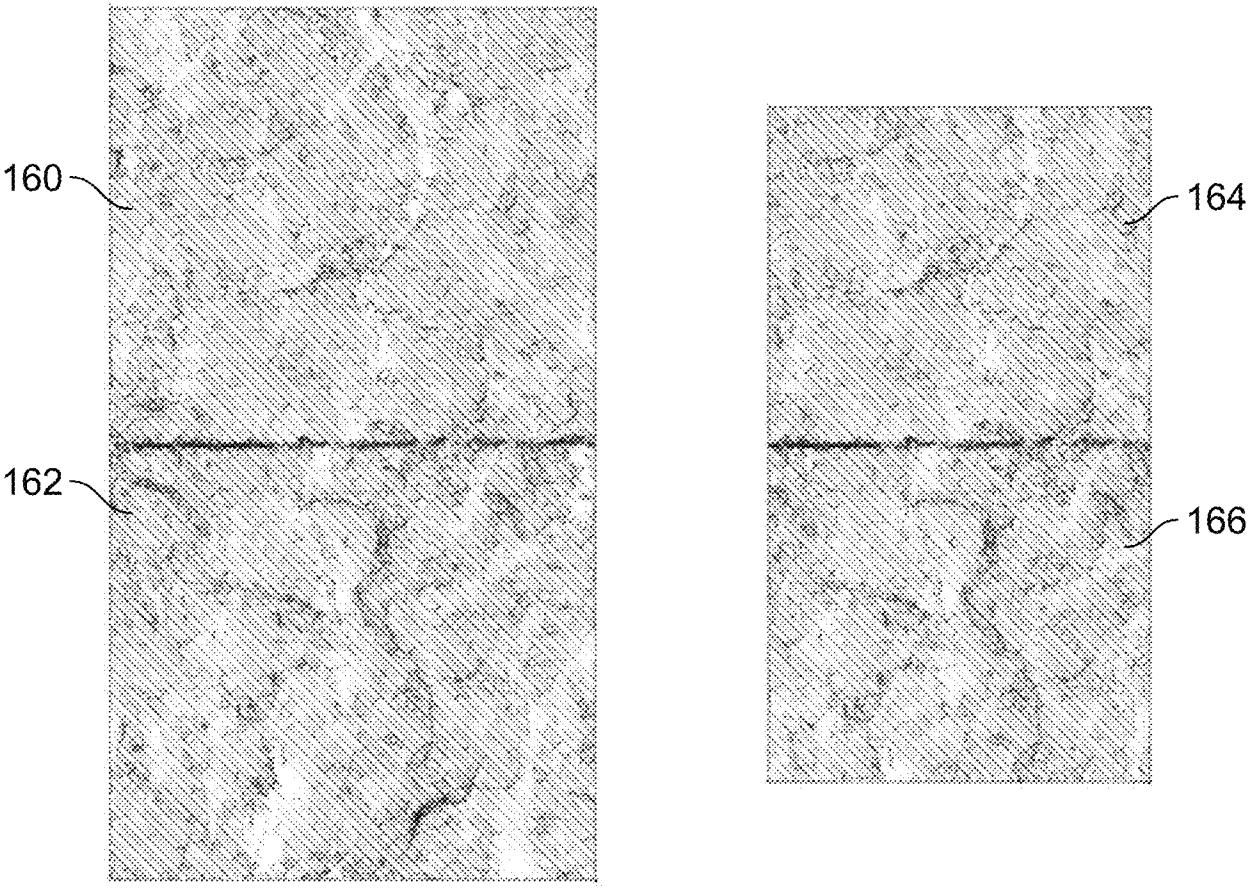
FIG. 24 shows top plan views of joined first and second symmetrical surface panels including a primary panel and a secondary panel mirroring the primary panel for forming a connection surface, before (left) and after (right) the panels are trimmed.
Figure 25:
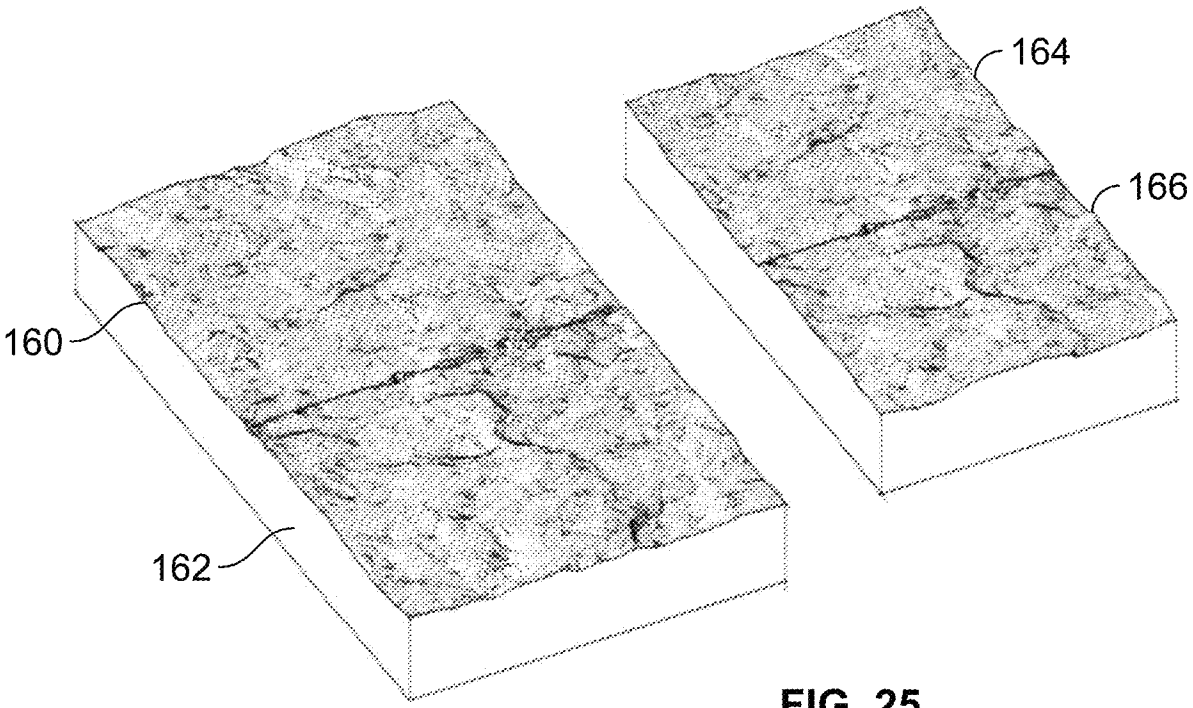
FIG. 25 shows perspective views of the joined first and second symmetrical surface panels of FIG. 24.

For example, FIGS. 24-25 show a primary panel 160 and an adjacent secondary panel 162 that mirrors the primary panel for providing a connection surface. The primary and secondary panels 160, 162 in FIGS. 24-25 have natural-appearing surface features, which can be provided from various surfaces, including but not limited to carved, formed, or otherwise rendered surfaces. Primary and secondary panels can also be provided using software, e.g., computer aided design (CAD) software, as further described herein. The primary and secondary panels 160, 162 are trimmed as desired to form trimmed primary and secondary panels 164, 166, which are viewable on the right of FIGS. 24 and 25.

Figure 26:
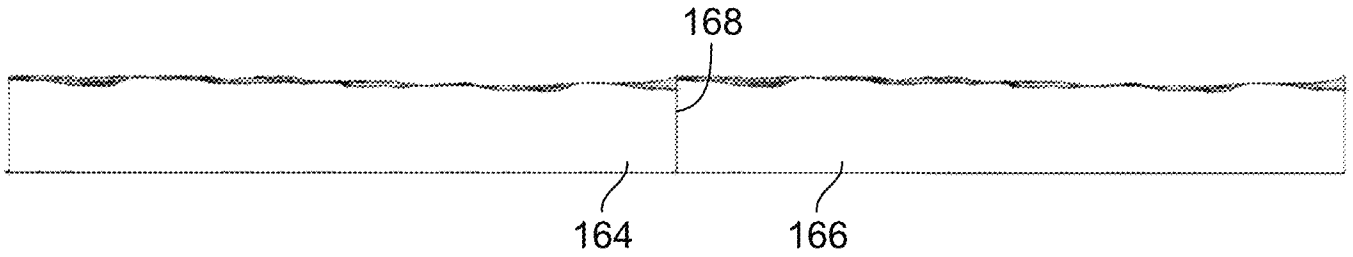
FIG. 26 is a side elevation view of the joined first and second symmetrical surface panels, illustrating a sectional contour formed as a 180-degree rotation about a centerline.

FIG. 26 shows the trimmed primary and secondary panels 164, 166, matched with one another. The trimmed primary and secondary panels 164, 166 are arranged as with the first and second segments or first and second quadrants of the connection surfaces described above. This provides an example connection surface. As shown in FIG. 26, the edges of the trimmed primary and secondary panels 164, 166 form a profile that is a 180-degree rotation about a central axis 168 defined by a seam between the panels.

Figure 27:
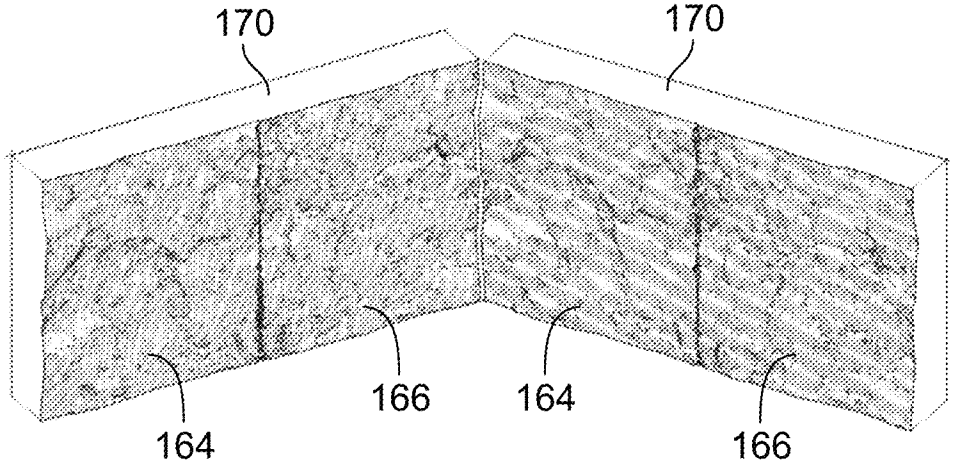
FIG. 27 is a front perspective view of two adjacent and matching pairs of the joined first and second symmetrical surface panels according to FIG. 26, angled toward one another in a first position.
Figure 28:
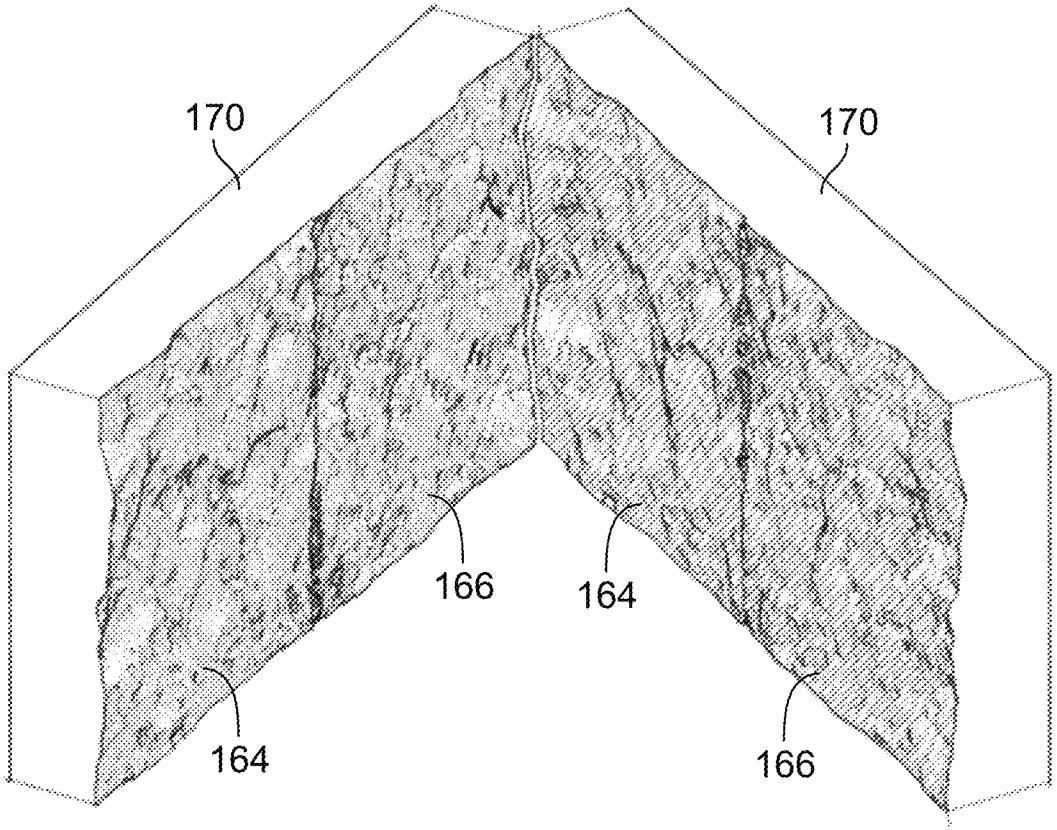
FIG. 28 is a front perspective view of the two adjacent pairs of FIG. 27, rotated further towards one another to a second position.
Figure 29:
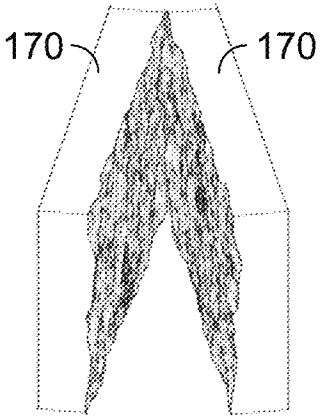
FIG. 29 is a front perspective view of the two adjacent pairs of FIGS. 27 and 28, rotated further towards one another to a third position.
Figure 30:
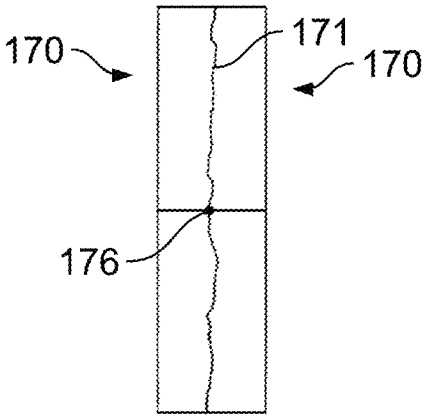
FIG. 30 is a front perspective view of the two adjacent pairs of FIGS. 27-29, rotated to a fourth position to join at their surfaces and nest in a book fold configuration, illustrating an angled connection section that forms a 180-degree rotation about a centerline.
Figure 31:
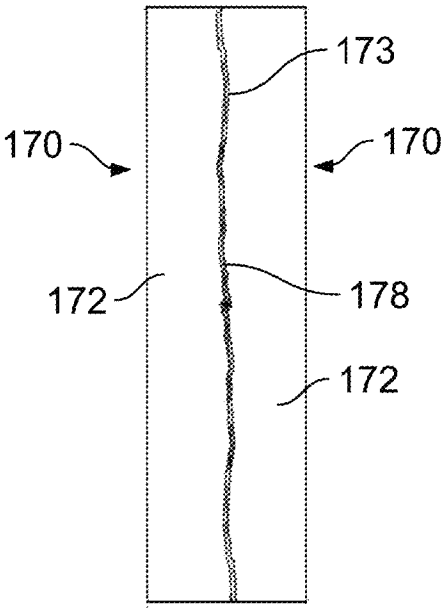
FIG. 31 is a top plan view of the two adjacent pairs joined as in FIG. 30, illustrating a top connection section that forms a 180-degree rotation about a centerpoint.

Next, the trimmed primary and secondary panels 164, 166 are matched with duplicates to form two sets 170, as shown in FIG. 27. Each set 170 includes the primary and secondary panels 164, 166, and provides a connection surface that can be mated with a similar, facing connection surface of the other set. For example, FIGS. 27-30 show a sequence in which the sets 170 are folded towards one another (180 degrees total). FIGS. 30 and 31 show the folded sets 170 mating with one another in a book fold configuration, providing nested surfaces. FIG. 30 illustrates a surface connection profile 171 formed by mating the sets 170 along a section that is at an oblique angle to the (perpendicular) edges of the sets 170. FIG. 31 illustrates a surface connection profile 173 formed by the mating sets along a section that is parallel to one of the edges of each set 170. Both the surfaces connection profiles 171, 173 define a 180-degree rotation about a center point, e.g., center point 176 in FIG. 30 and center point 178 in FIG. 31.

Figure 32:
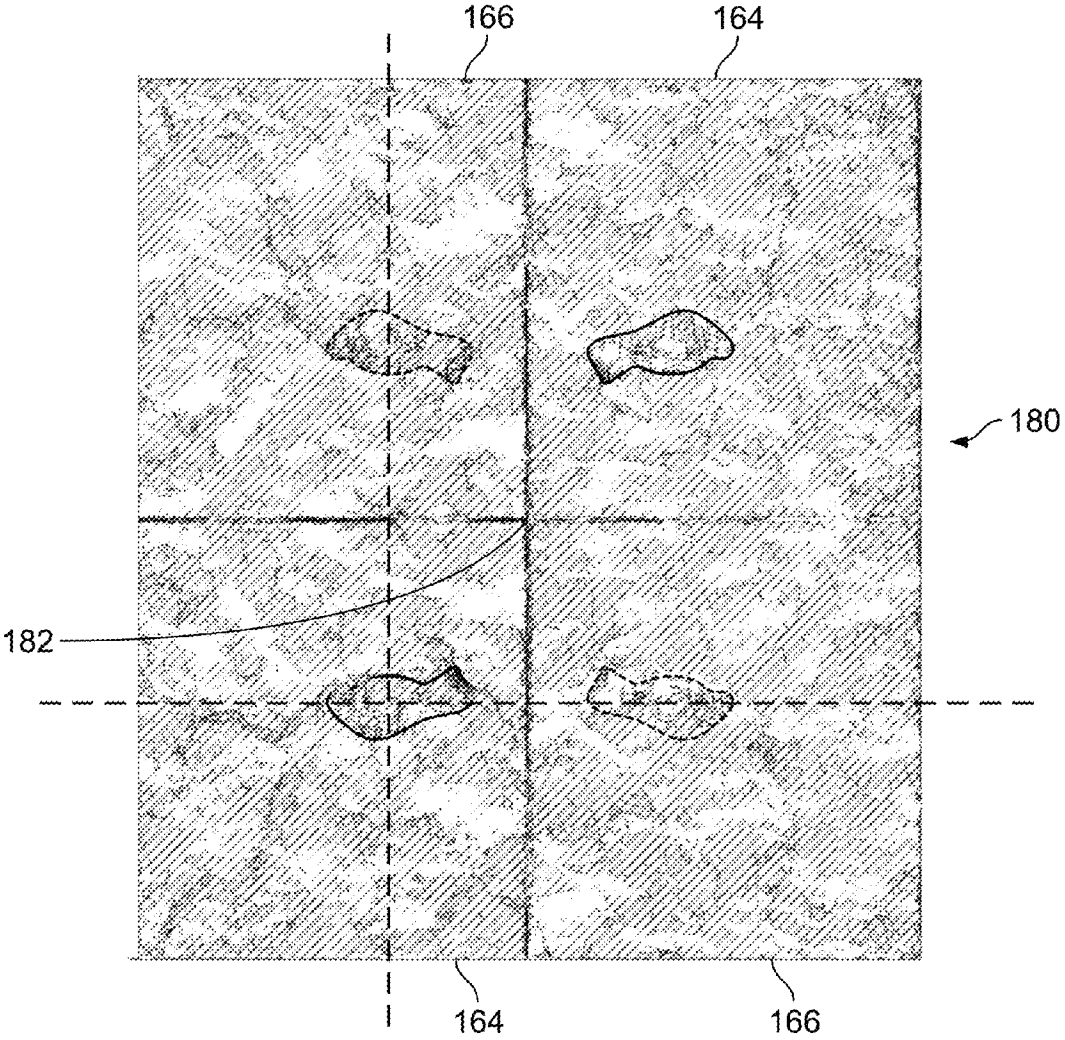
FIG. 32 is a top plan view of two adjacent pairs of the panels of FIG. 24, arranged in a square, and including marked surface portions in four quadrants.
Figure 33:
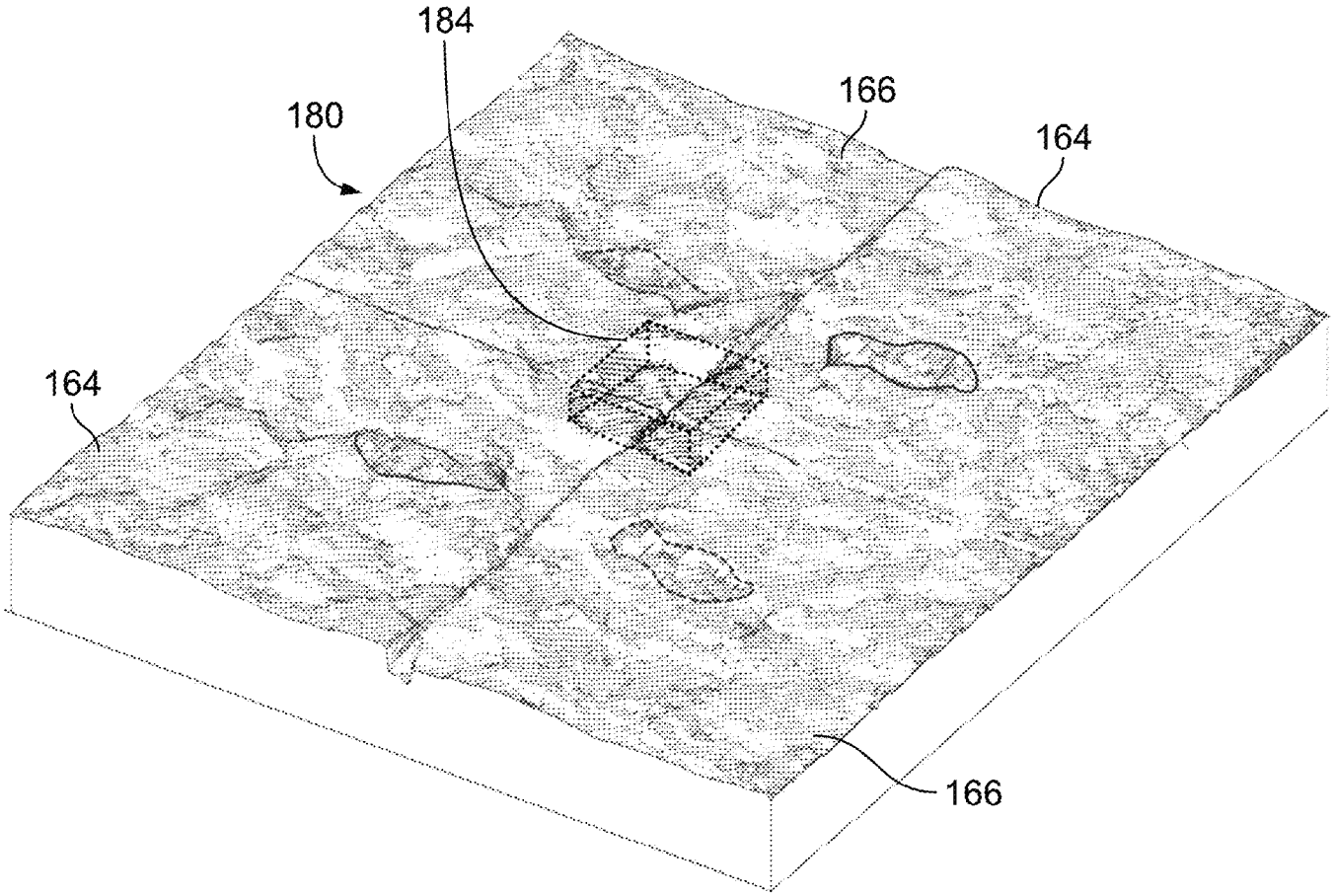
FIG. 33 is a perspective view of the square of FIG. 32, further including a highlighted central surface volume.

To provide a connection surface having four quadrants and to allow for 180-degree rotation, the trimmed primary and secondary panels 164, 166 are duplicated and fit into a four segment panel 180, as shown in FIGS. 32-33. For example, for complementary (trimmed) primary and secondary panels 164, 166, a first quadrant could include the primary panel 164 in a first position, a second quadrant could include the secondary panel 166 positioned so that the secondary panel is a reflection of the primary panel across a vertical centerline (and, due to its formation, reversed in the normal direction), a third quadrant could include the primary panel 164 rotated 180° from the first quadrant about a center rotation point 182, and a fourth quadrant could include the secondary panel 166 rotated 180° from the second quadrant about the center rotation point 182. FIG. 32 further shows highlighted portions on each quadrant, in which dashed portions are generally lowered with respect to the overall plane of the quadrant, and portions in solid lines are generally raised with respect to the overall plane of the quadrant, and are complementary to the dashed portions.

Figure 34:
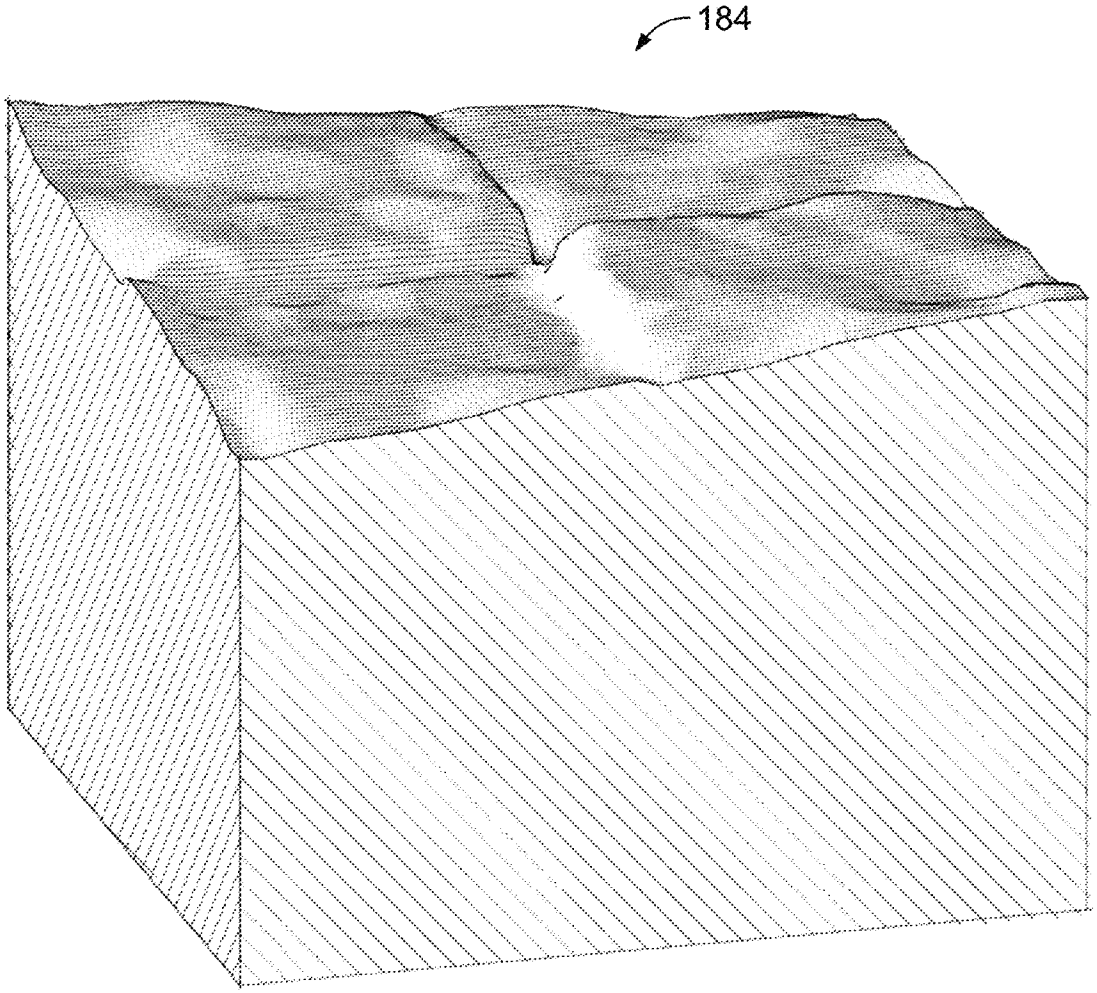
FIG. 34 is an enlarged perspective view of the highlighted central surface volume of FIG. 33.
Figure 35:
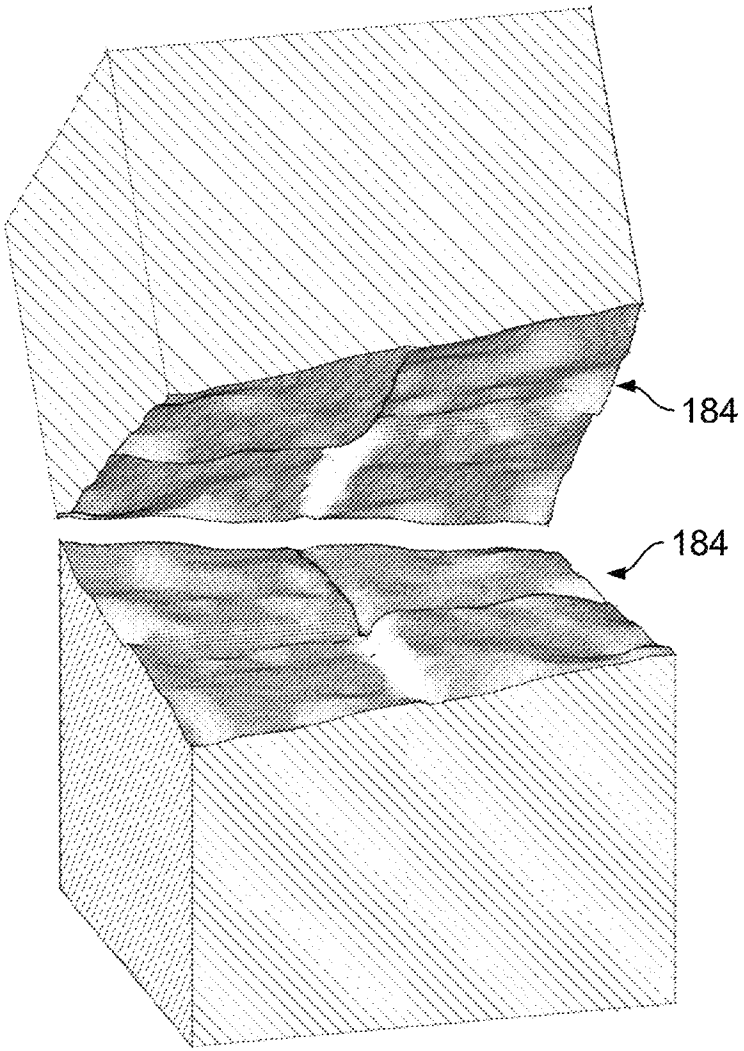
FIG. 35 is an enlarged perspective view of two identical central surface volumes according to FIG. 34, facing one another for mating.
Figure 36:
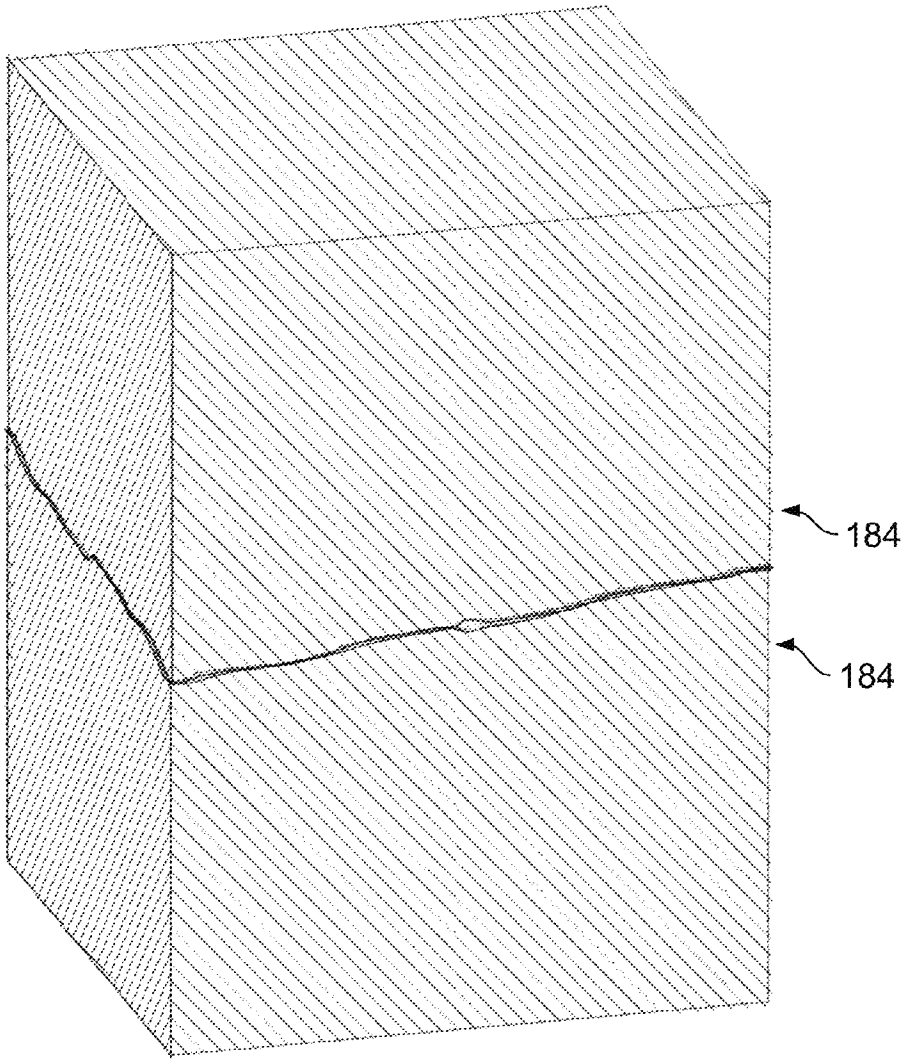
FIG. 36 is an enlarged perspective view of the two central surface volumes according to FIG. 35, joined and mating (nesting) with one another to form a connection.

For further illustrating symmetry of the example panel 180, FIG. 33 includes a central highlighted portion forming a box about the center rotation point 182. FIG. 34 shows the connection surface 184 of this central highlighted portion enlarged, and FIGS. 35-36 show like connection surface 184 facing and mating with one another. The symmetry of the enlarged connection surface 184 continues throughout the four segment panel 180, extending outwardly from the center point, to provide a connection surface throughout the panel, even though the surface appears to be random and/or natural.

Figure 37:
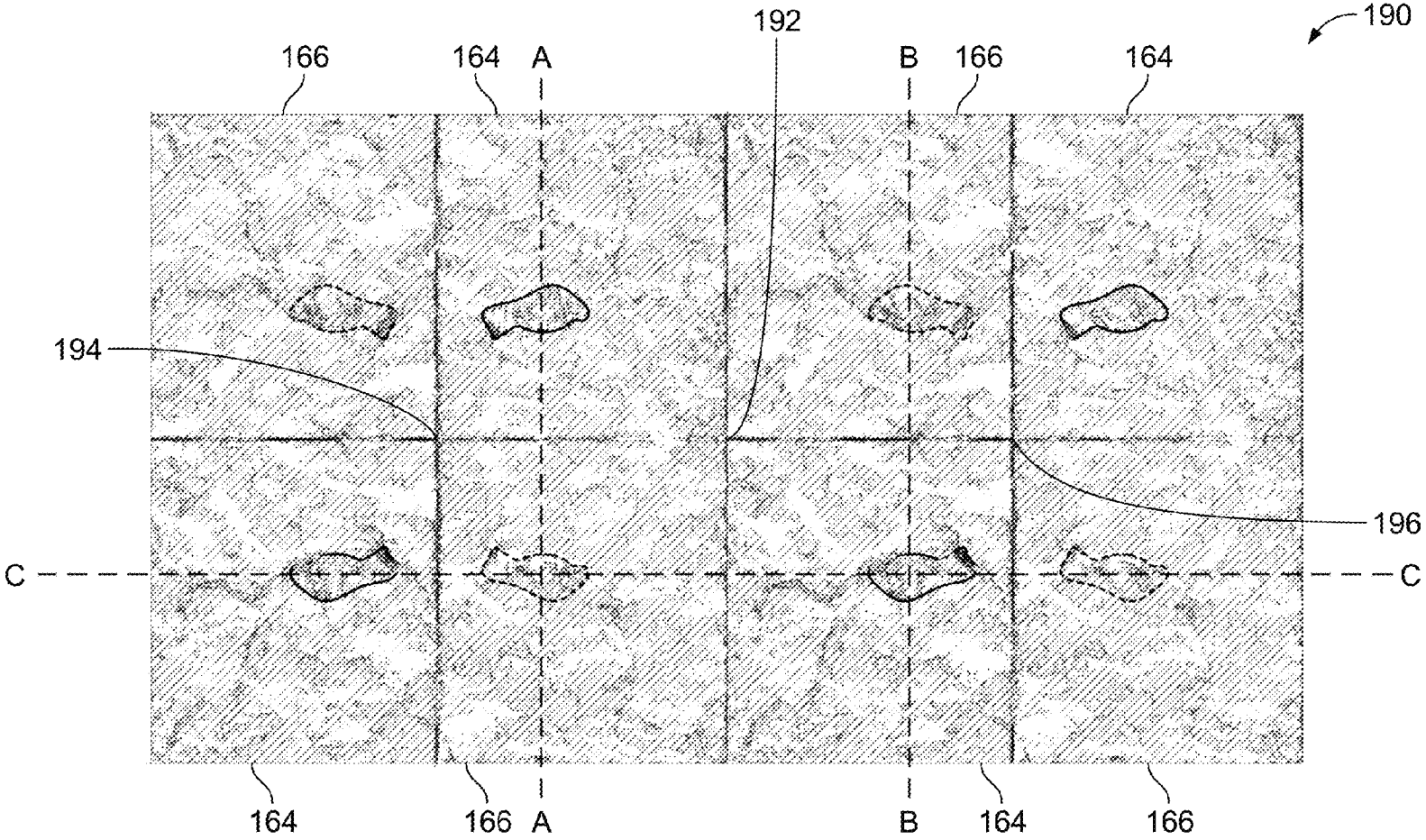
FIG. 37 is a top plan view of an example surface formed as an arrangement of eight panels (segments) by duplicating the square connection surface of FIG. 32.

Larger connection surfaces can be provided by arranging and combining the four segment panels 180. FIG. 37 shows an eight panel connection surface 190 formed by matching and assembling two four segment panels 180 (i.e., two sets of four quadrants) side to side with one another. In some embodiments, the center four quadrants may be provided with a different width than the outer four quadrants by trimming the inner edges of the interior quadrants along a vertical line about a new center rotation point (e.g., one other than the center of the four quadrants before trimming), and matching the new center rotation point of the trimmed sets to an overall center rotation point 192 to create the eight segment panel. Alternatively, the outer edges of the exterior quadrants may be trimmed. FIG. 37 shows the overall center rotation point 192 of the eight segment panel 190 as well as the center rotation points 194, 196 for left and right sets of four quadrants, respectively.

Other connection surfaces can be prepared using the eight segment connection surface 190, for example by duplicating the eight segment surface (physically or digitally) with selective material removal to provide multiple and unique, but still mating, surfaces. These surfaces, or portions thereof, can be used to form one or more faces of structural units, in any combination, for example by taking all or portions of master connection surfaces (e.g., cutting and sizing all or portions to be disposed on selected sides of structural units, then placing selected portions on sides of structural units (e.g., attach digitally or manually), optionally trimming to fit, and optionally adding any additional details such as but not limited to false joints, chamfers, etc., to provide example connection surfaces on selected surfaces and areas of the structural unit.

Figure 38:
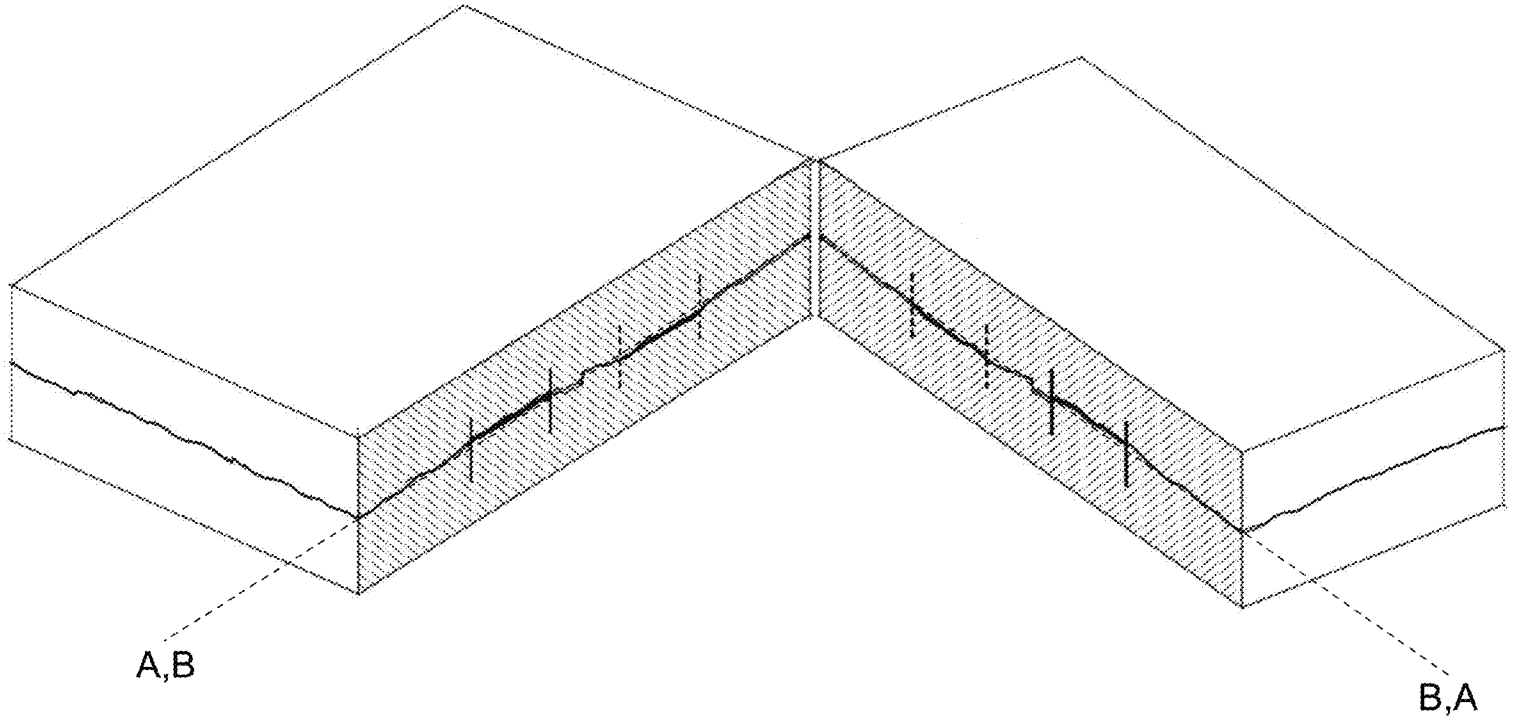
FIG. 38 is a perspective view of the surface of FIG. 37, cut along the two vertical lines A-A and B-B as shown in FIG. 37 and split along a vertical centerline, in which the outer two portions of the surface are then folded over one another and the inner two portions are folded over one another, illustrating sectional connections that are 180 degree rotations in vertical section.
Figure 39:
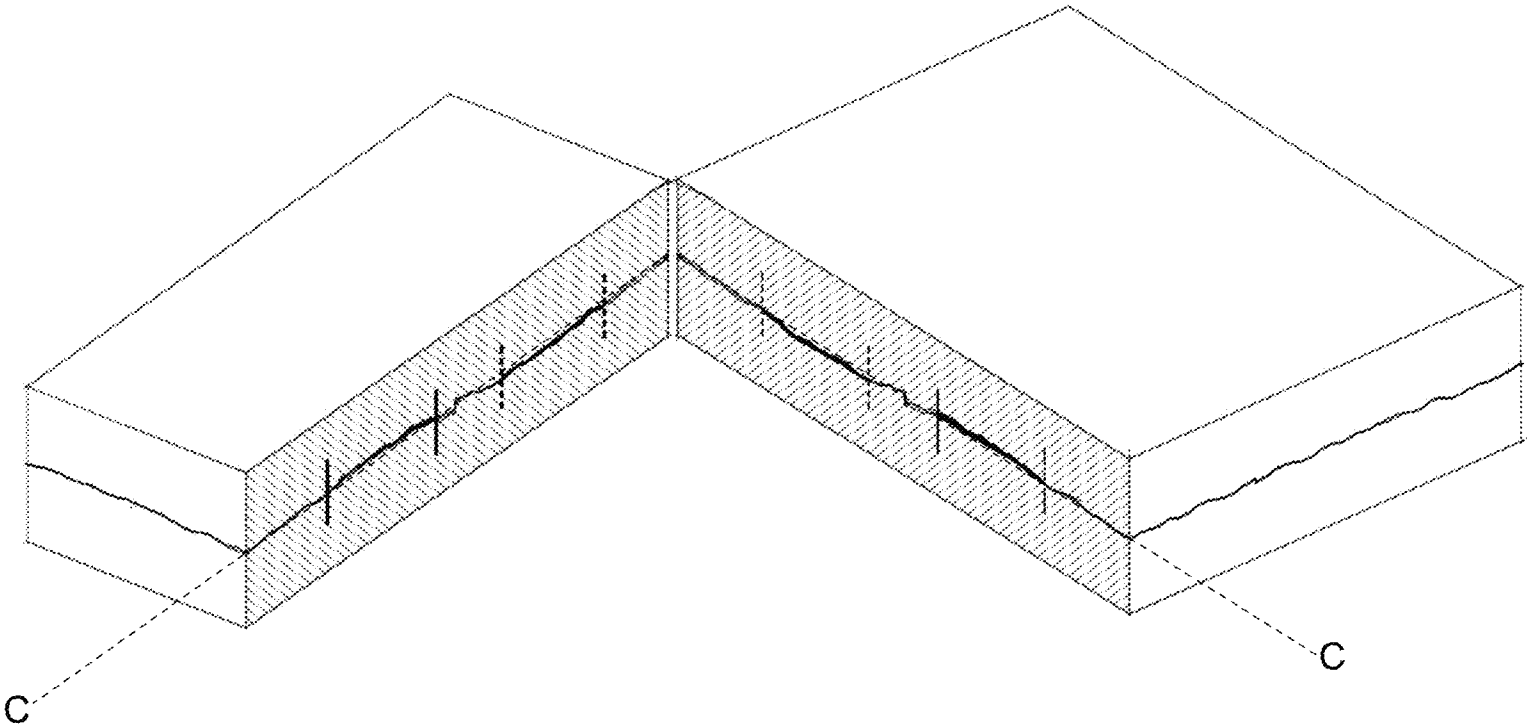
FIG. 39 is a perspective view of the surface of FIG. 37, in which the left and right halves of the surface are folded over one another with respect to the horizontal centerline and then cut along the horizontal line C-C, illustrating sectional connections that are 180 degree rotations in horizontal section.

To illustrate features of the example eight segment connection surface 190, FIG. 38 shows the eight segment connection surface in FIG. 37 split along a vertical centerline and cut as indicated in vertical cut lines A-A and B-B in FIG. 37 to form pairs of inner and outer portions. In FIG. 38, the outer portions are folded over one another (rotated 180 degrees) in the left portion of FIG. 38, and the inner portions are folded over one another (rotated 180 degrees) in the right portion of FIG. 38. The portions of the surface profile corresponding to the highlighted surface portions above are also marked in section. Similarly, FIG. 39 shows the eight segment connection surface 190 split along a horizontal centerline, folded upon itself over the horizontal centerline, and then cut as indicated in line C-C to form pairs of inner and outer portions.

Figure 40:
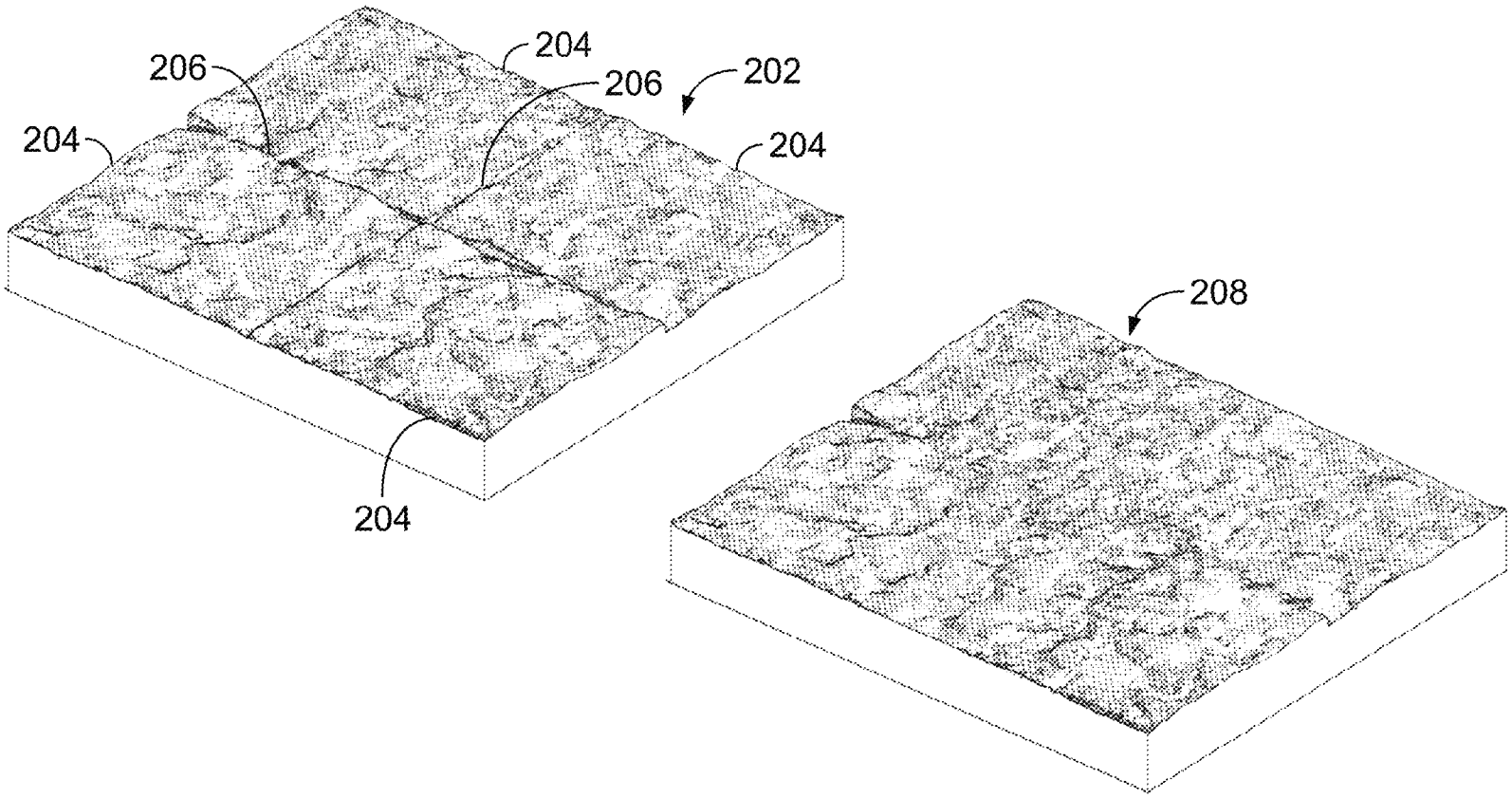
FIG. 40 shows two perspective views of the square of FIG. 32, before (left) and after (right) inner seams are removed by removing surface material.

Patterns formed by the assembled quadrants can be used in the final connection surface as part of an intentional design, and/or repeated shapes (e.g., irregular shapes) can be obscured by removing (e.g., carving) material from a solid unit after molding. Removing material from each panel can hide nested details. This removing of material can hide repeating irregular shapes, or hide regular shapes whether or not repeating. Further, surface peaks from adjacent quadrants can cause a discontinuity in the surface along the seams (e.g., along horizontal and vertical center lines). In an example embodiment, material can be removed near the seams, using methods that will be appreciated by those of ordinary skill in the art, to hide these discontinuities or to change the appearance of the surface. FIG. 40, left, shows a set 202 of four assembled quadrants 204, in which seams 206 are visible between the quadrants. FIG. 40, right, shows a treated set 208, in which material has been removed or added to minimize or obscure seams. Material removal or addition can be performed on a panel, mold, or on the molded structural unit.

Figure 41:
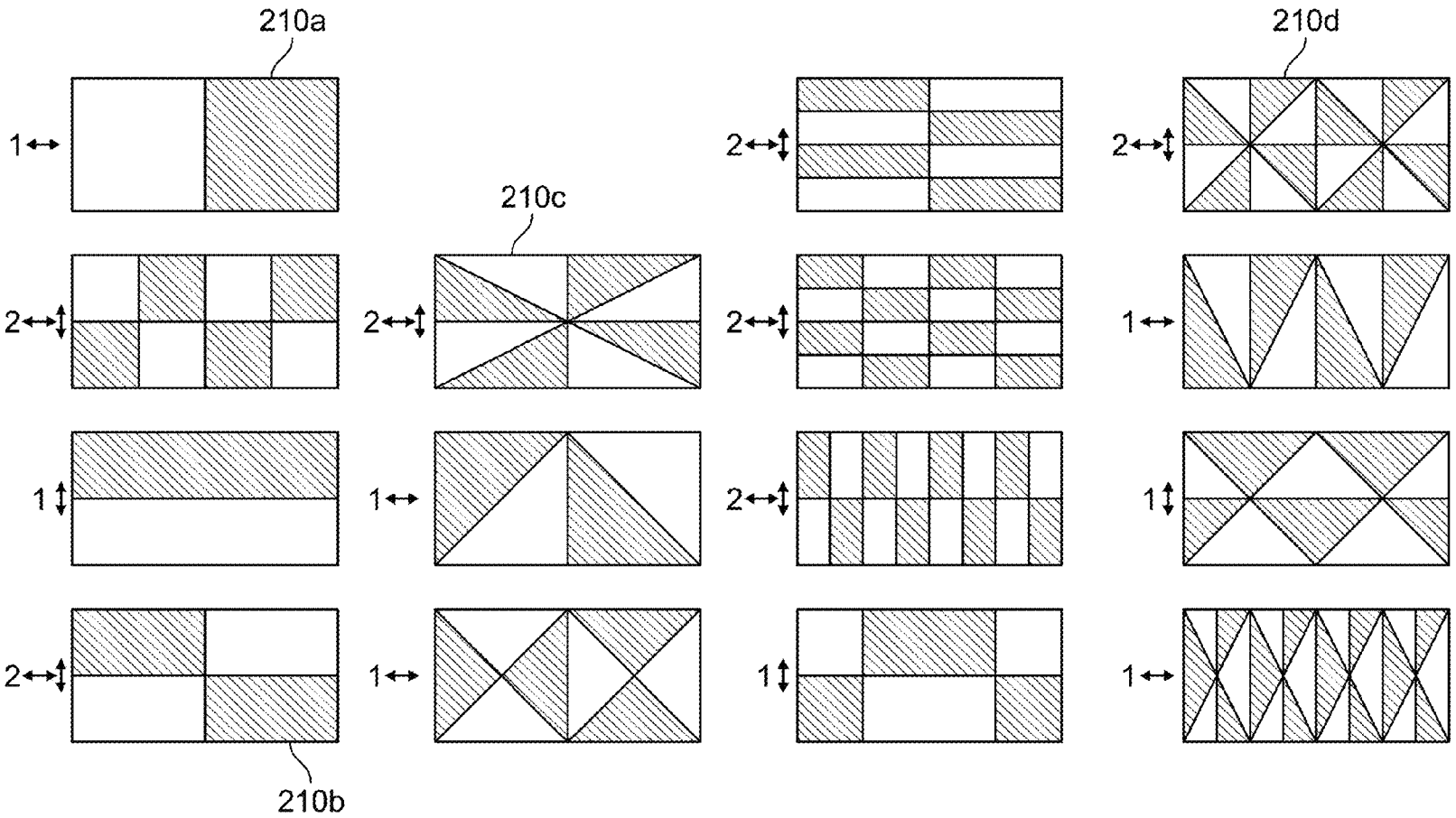
FIG. 41 shows example surface patterns for arrangements of connection surfaces, in which hatched and non-hatched portions are inverse reflections of one another.

Another example method for creating or providing a connection surface uses computer generation. A pattern or grid for segments in the connection surface is selected, including a pattern or surface reflection. Example two-dimensional panels are shown in FIG. 41, where solid and hatched surfaces are complementary to one another. In FIG. 41, the arrow(s) beside each pattern illustrate whether facing connection surfaces according to that pattern mate when folded together along a horizontal direction or vertical direction. The number beside each arrow indicates whether the facing connection surfaces folded along that direction need to be in the same orientation to mate and nest, or whether they can be reversed (inverted) along that direction. For example, the pattern 210*a* is a book fold pattern, which mates with a like facing pattern along the horizontal direction, but will not mate if one of the patterns is inverted. The pattern 210*b* is a four-quadrant pattern, which mates with a like facing pattern along two directions, and mates even if one of the units is inverted. The example patterns further indicate that all axises between complementary surface segments need not be at vertical or horizontal axises, but instead can be oblique, such as in pattern 210*c*.

Figure 42:
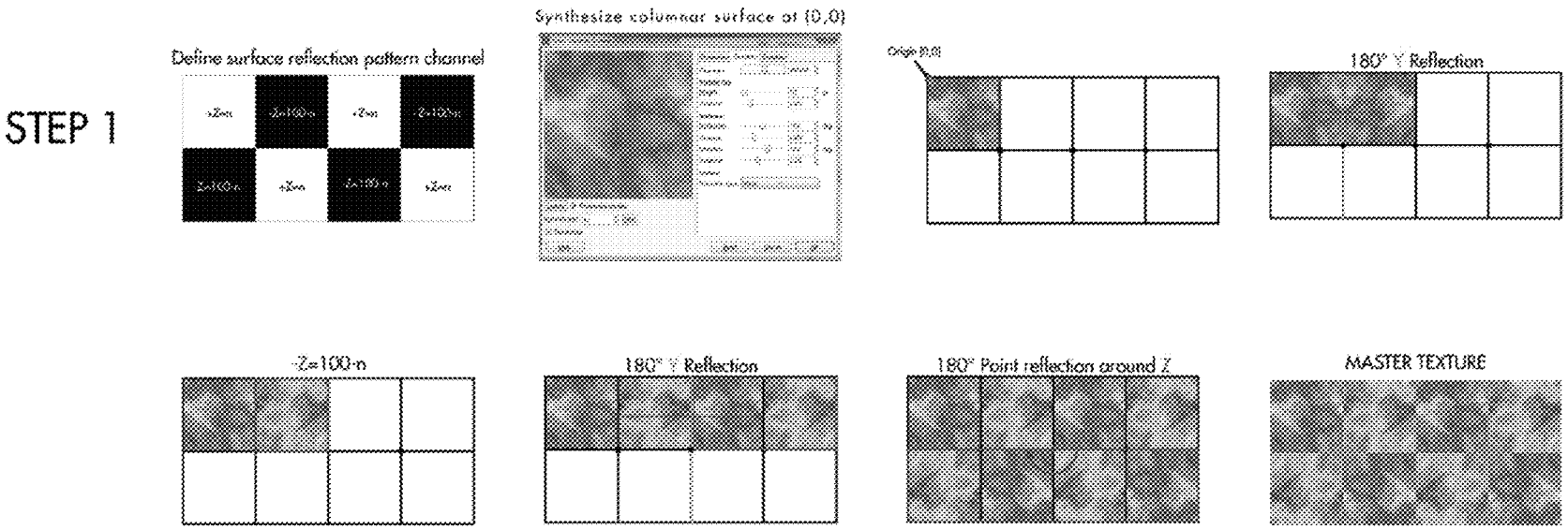
FIG. 42 shows steps in an example computer-based method for creating a master texture for a connection surface.

A surface can be provided by extracting based on an existing surface, or by other methods. One example method is synthesizing a surface using parametric generation, which can generate a topography of x, y, and z coordinates forming various shapes. Given a surface reflection panel, and a synthesized surface, the synthesized surface is incorporated into the selected pattern by reflecting the surface into the pattern to provide a master texture. In FIG. 42, for example, for preparing an eight-segment pattern, the synthesized surface is placed into the top left corner of the pattern, reflected 180 degrees about a Y-axis, and the Z-coordinates are reversed to provide two top left segments. The two top left segments are then rotated 180 degrees about a central Y-axis to provide four top segments, and a 180-degree point reflection of the four top segments around the Z-axis is performed, resulting in a master texture.

Figure 43:
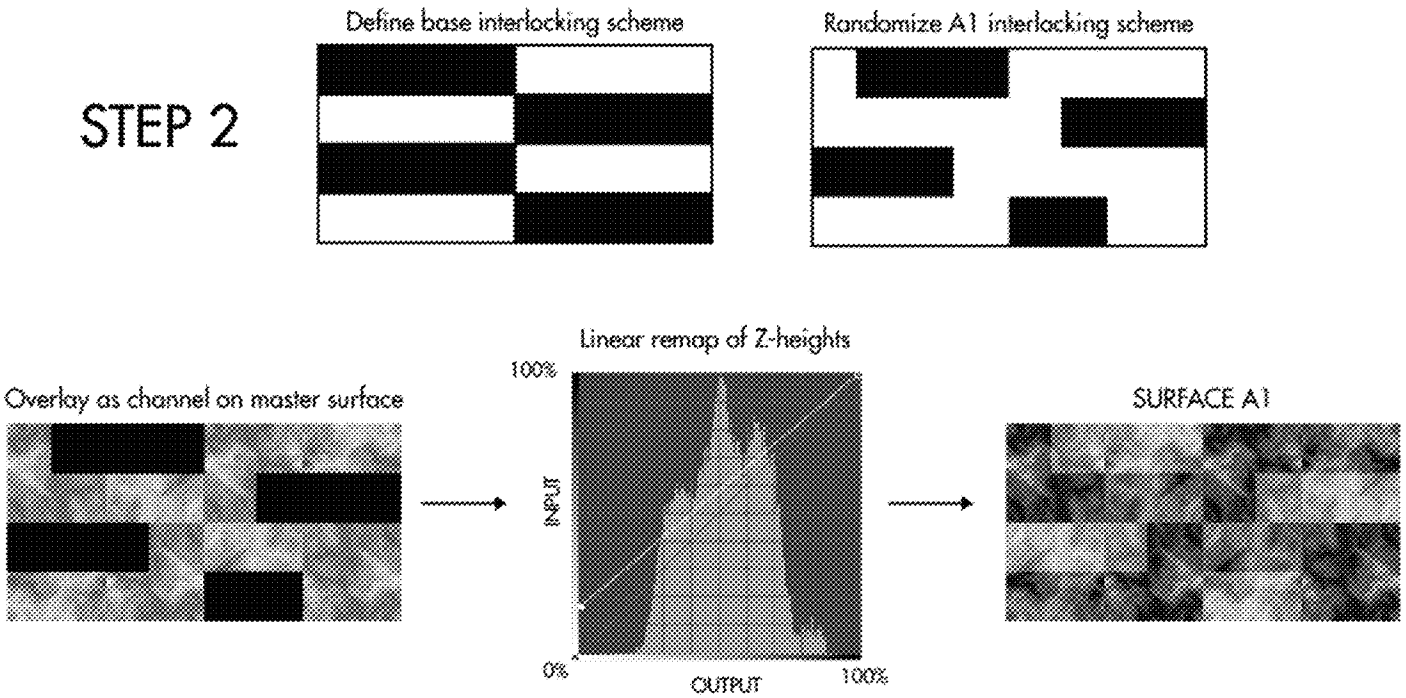
FIG. 43 shows steps in an example method for customizing portions of the master texture of FIG. 42.
Figure 44:
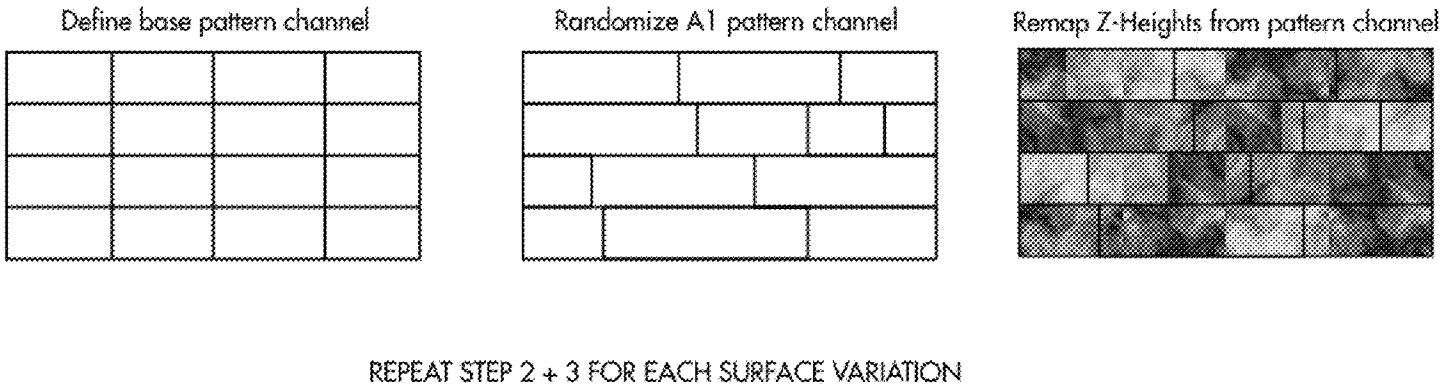
FIG. 44 shows steps in an example method for further customizing portions of the customized texture of FIG. 43.
Figure 45A:
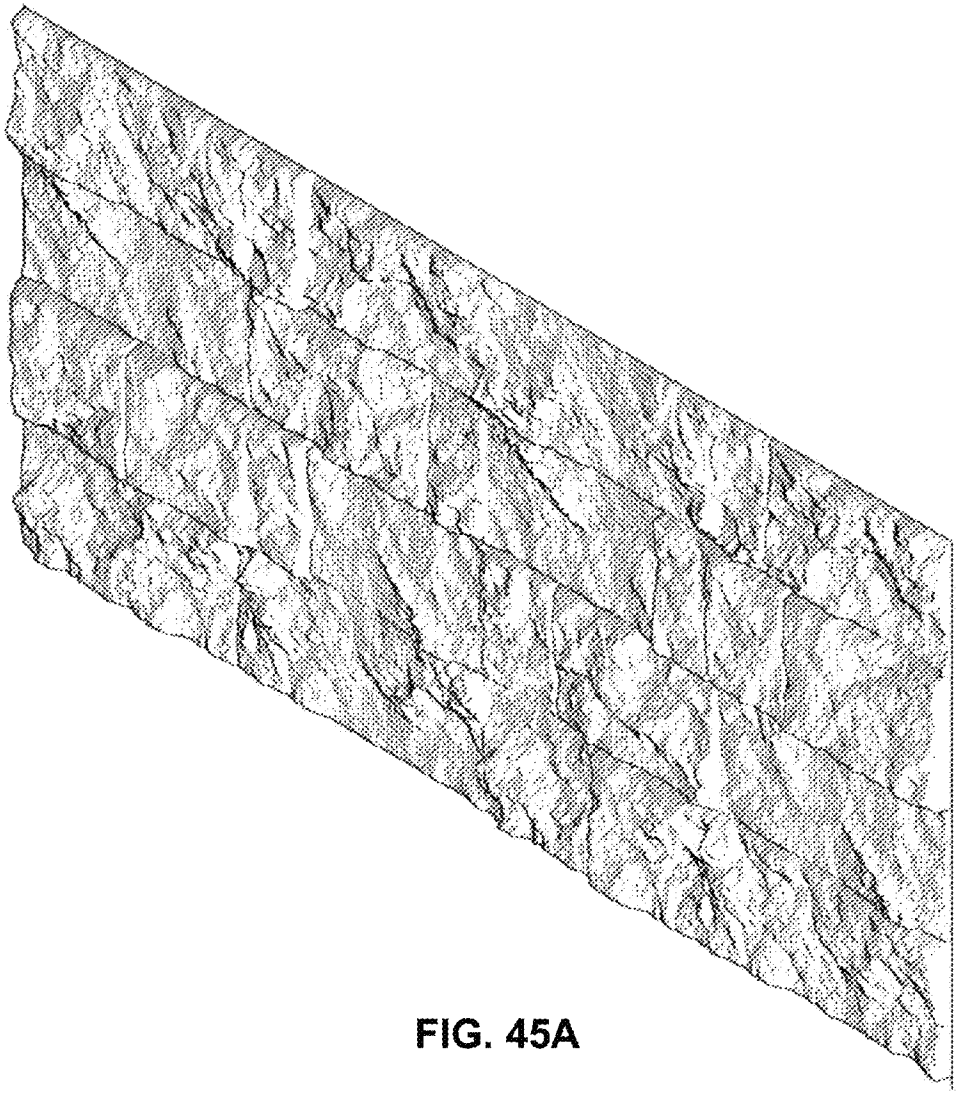
FIGS. 45A-B show a stacked stone surface formed using the steps of FIGS. 42-44.
Figure 45B:
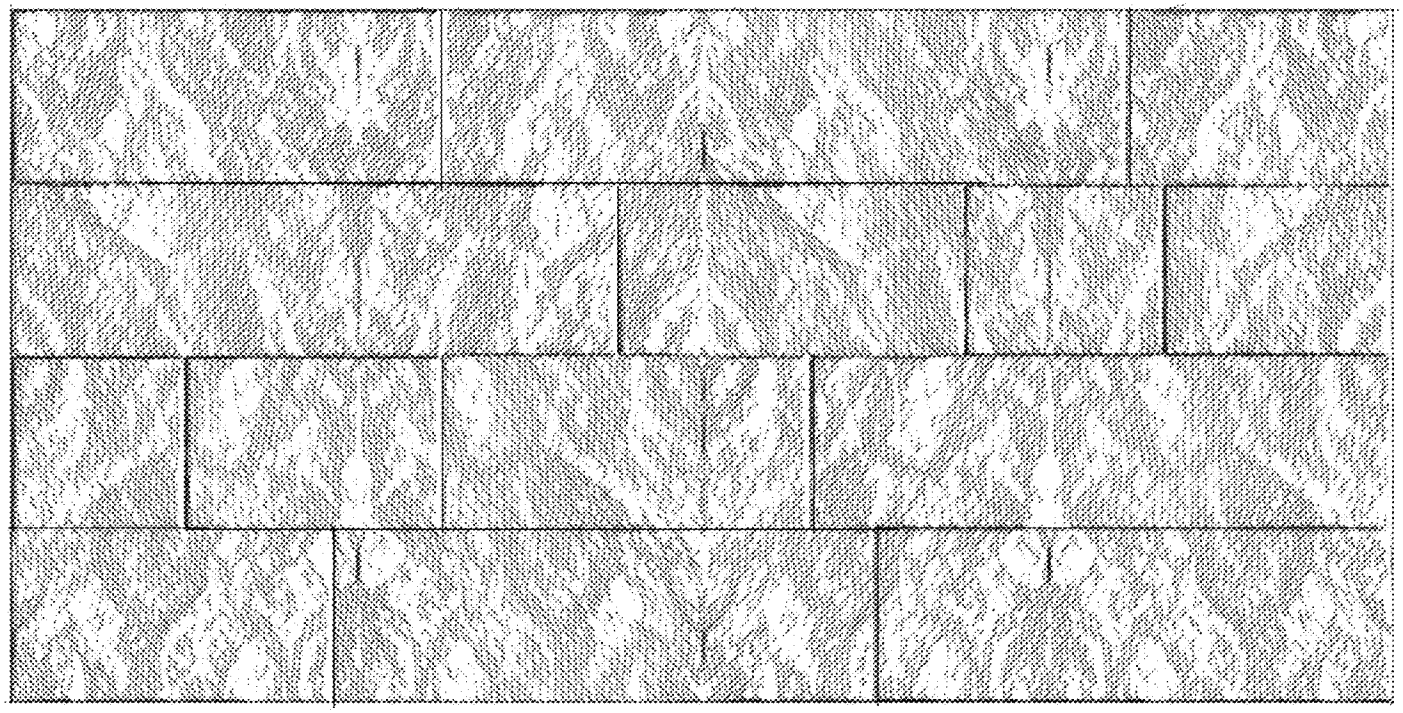

The master texture may then undergo multiple surface variations. For example, in FIG. 43, an optional secondary interlocking scheme (base interlocking scheme) to provide a stacked stone pattern is defined and randomized. The randomized interlocking scheme is overlaid as a channel onto the master texture surface, and input to a linear remap of Z-heights to provide a first variant surface. In FIG. 44, to optionally add score lines, false joints, etc., a base pattern channel is defined, and a pattern channel for the first variant surface is randomized. Next, Z-heights are remapped from the randomized pattern channel. The steps in FIGS. 43 and 44 are repeated for each surface variation. FIGS. 45A and 45B show an example surface texture using the steps shown in FIGS. 42-44.

The resulting derived surface pattern is then formed on a surface of a structural unit. Connection surfaces may be formed on surfaces and/or sidewalls of structural unit. Example methods for forming the derived surface pattern on the structural unit include but are not limited to cutting or forming the derived surface pattern directly into a product or into a mold or model using methods such as 3D printing, milling (positive or negative), wire electrical discharge machining (EDM), and others. Molds or models can be used to produce a final structural unit using methods that will be appreciated by those of ordinary skill in the art.

Figure 46:
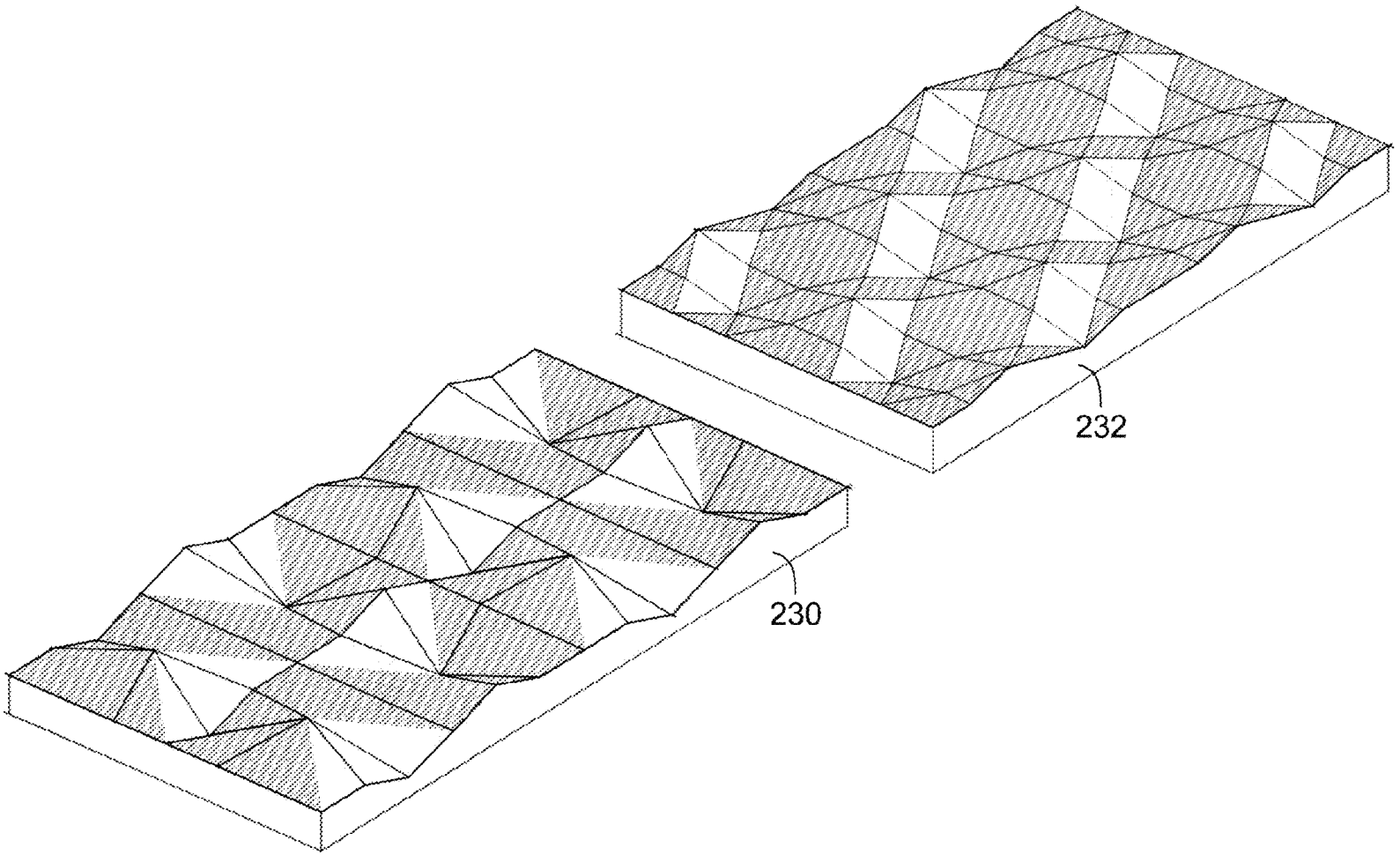
FIG. 46 shows perspective views of connection surfaces for angled connections according to ninth (left) and tenth (right) embodiments of the invention.
Figure 47:
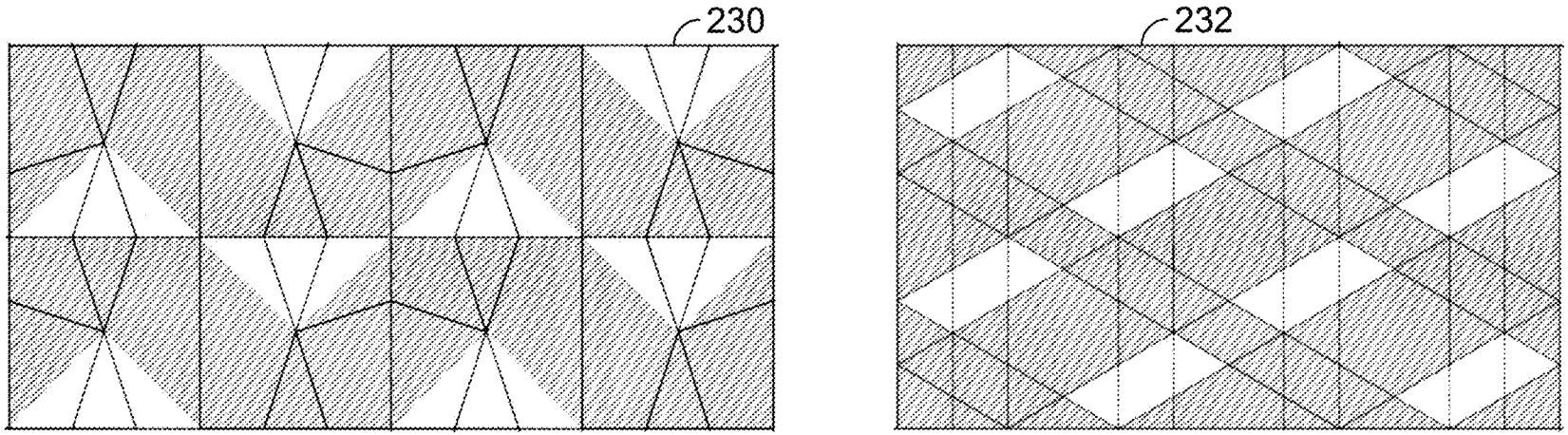
FIG. 47 shows top plan views of the connection surfaces of FIG. 46.

FIGS. 46-54 show alternate configurations and features for connection surfaces. FIGS. 46-47 shows two units 230, 232 having connection surfaces with geometric surface features that are angled to provide a hexagonal configuration. In unit 230, like connection surfaces directly face one another to mate and next. In unit 232, like connection surfaces may be respectively turned at multiples of 45 degrees and still mate.

As provided above, it is not required for all mating connection surfaces to be perfect reflections or rotations. Further, the surface profile of some complementary segments may be independent of the surface profiles of other complementary segments.

Figure 48:
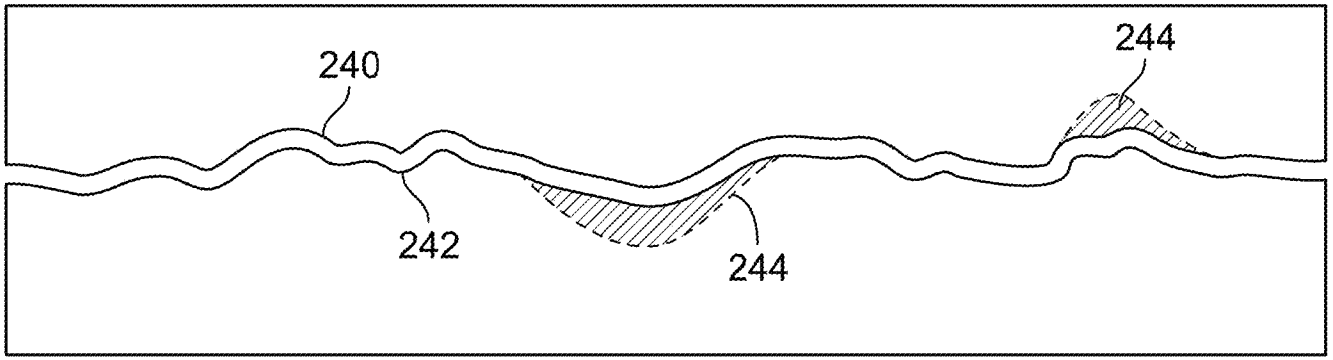
FIG. 48 shows a section of a pair of joined connection surfaces according to an eleventh embodiment of the invention, in which selective portions are removed to create intentional gaps between the joined connection surfaces, while permitting mating.

Portions of one or more connection surfaces can be removed, while still permitting structural units to mate. FIG. 48 shows, in section, a pair of mated connection surfaces 240, 242 in which portions 244 of the connection surfaces are removed to change the respective depth or height of features, while permitting mating. Different faces can be provided with different connection surfaces that still mate with one another, or with a portion of one another. Even for similar connection surfaces, variations can be formed by removing different respective portions from otherwise matching connection surfaces.

Figure 49:
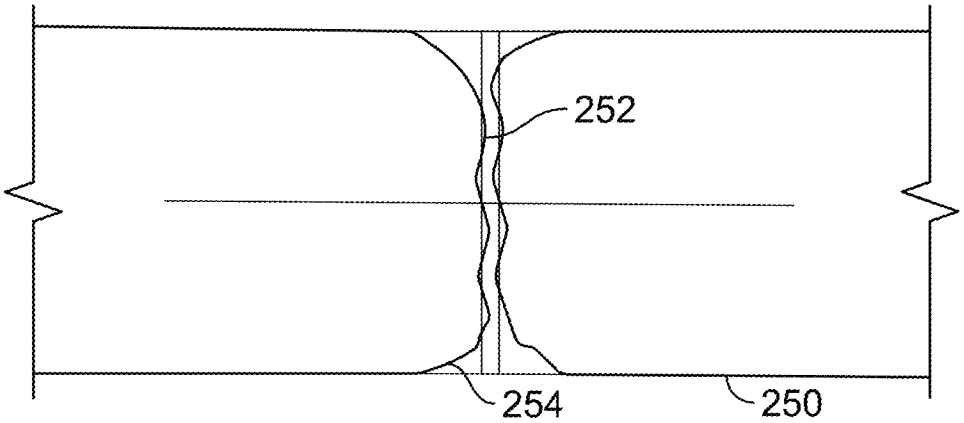
FIG. 49 shows a simplified section of a structural unit having a hewn connection surface according to a twelfth embodiment of the invention.
Figure 50:
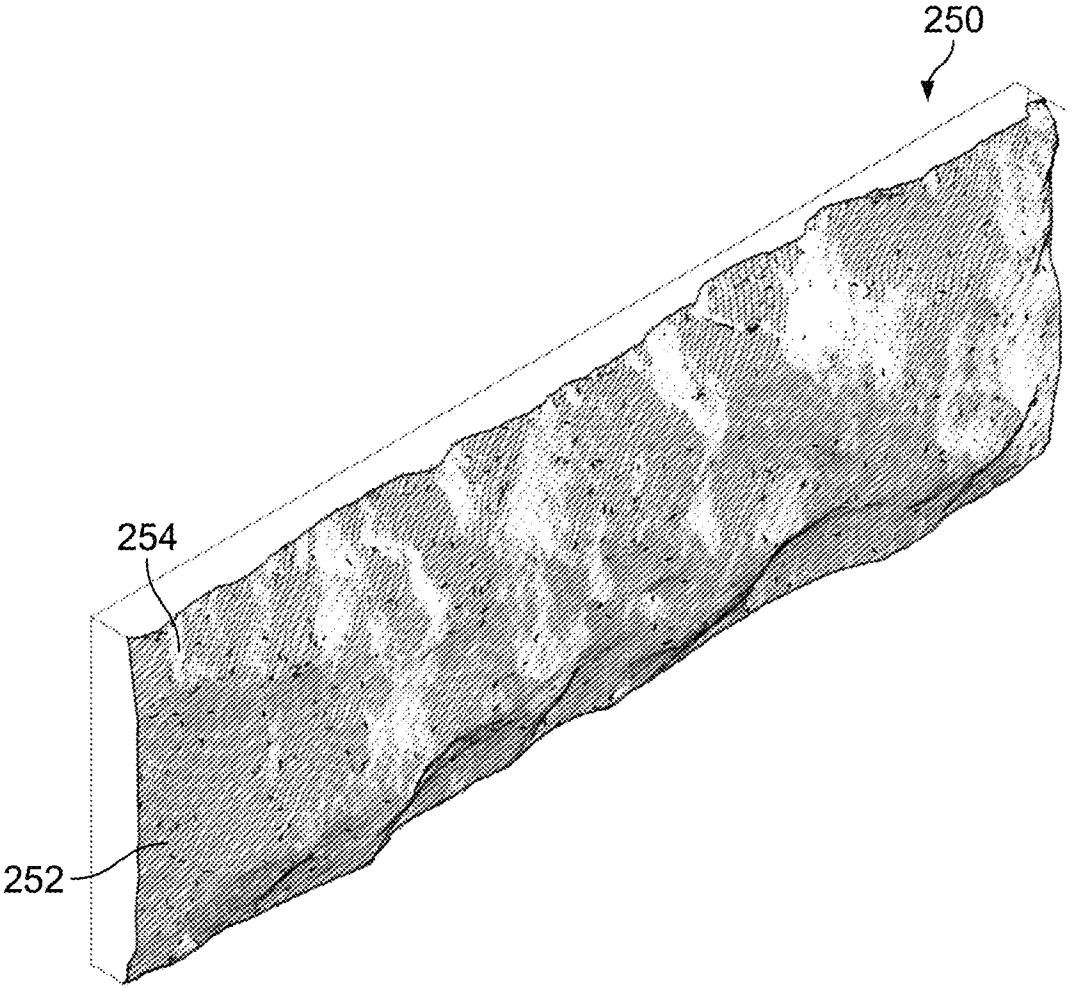
FIG. 50 is a perspective view of a structural unit having a hewn connection surface.
Figure 51:
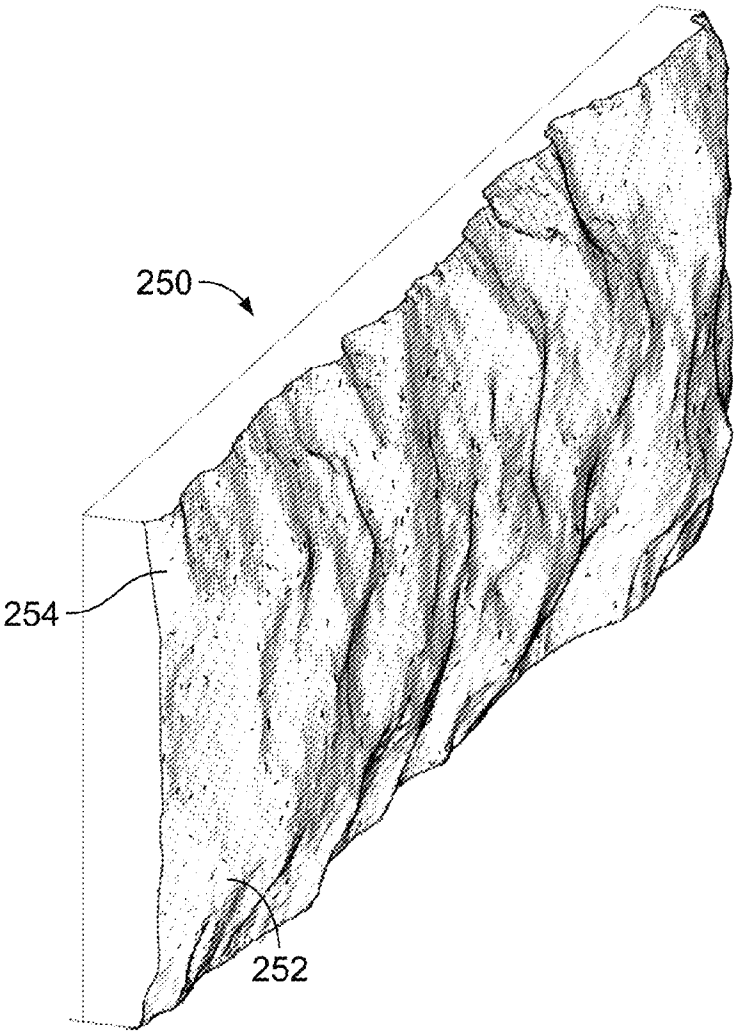
FIG. 51 is another perspective view of the structural unit of FIG. 50.

FIGS. 49-51 show a hewn structural unit 250 having a connection surface 252 according to an example embodiment, where FIG. 49 is a simplified view illustrating certain features. Though connection surface features 252 of facing structural units 250 mate that are centrally disposed along a face of each unit, as shown in FIG. 49, a connection surface along outer portions 254 of the face is fully or partially removed or omitted, giving the exposed surface of the structural unit a generally rounded appearance, while still being able to connect to other units.

Figure 52:
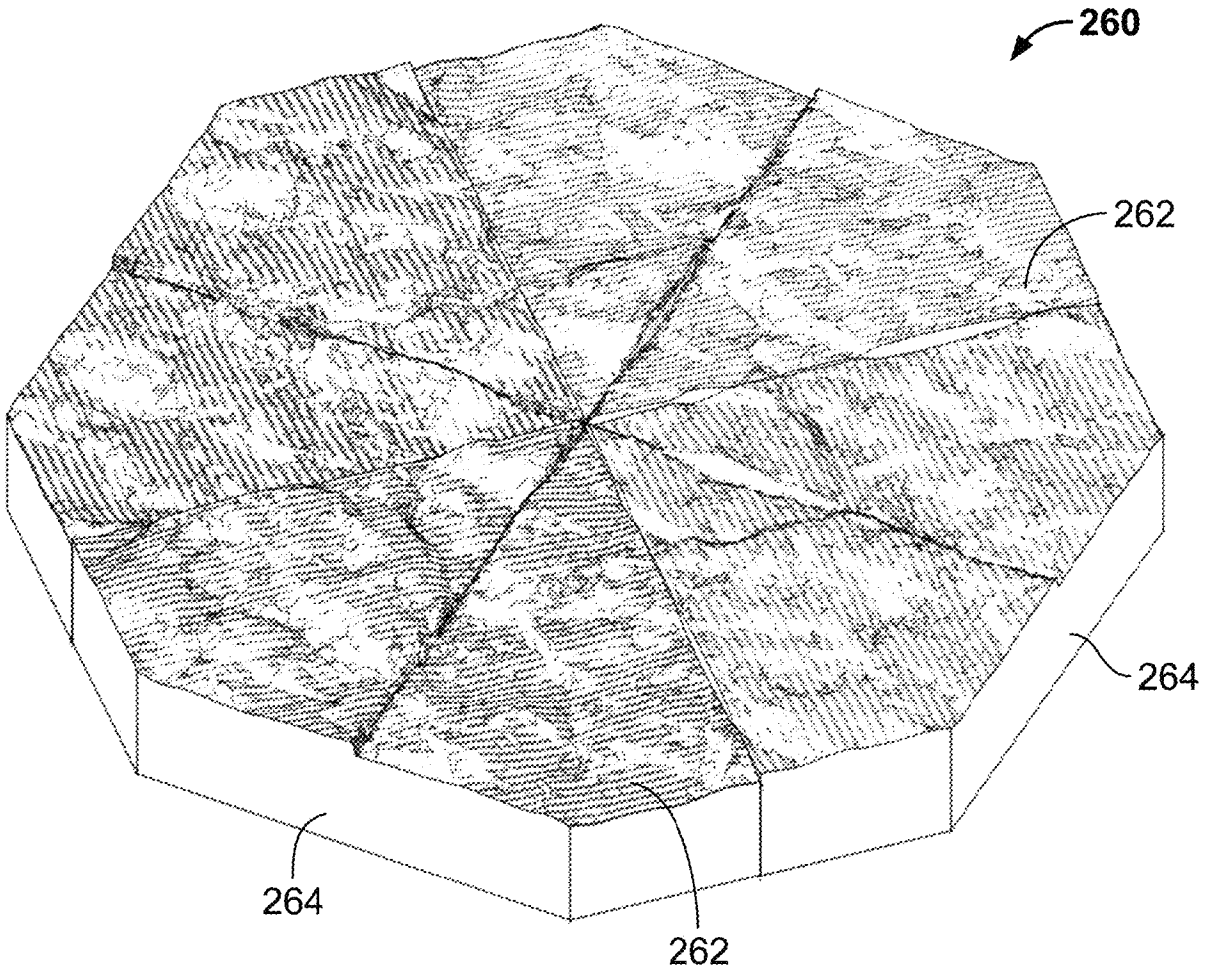
FIG. 52 is a perspective view of a connection surface in which symmetrical portions are arranged at 45 degree angles.

FIG. 52 shows a connection surface 260 according to another example embodiment, in which complementary segments 262 are disposed at 45 degree angles to one another, as shown by the left half of pattern 210*d* in FIG. 41. Facing like connection surfaces 260 can mate when the surfaces are respectively rotated at multiples of 45 degrees. As shown in this example, once a connection surface is formed, all or part of the connection surface, in any shape, can be removed, such as removed corners from a rectangular pattern to form surfaces 264.

Figure 53:
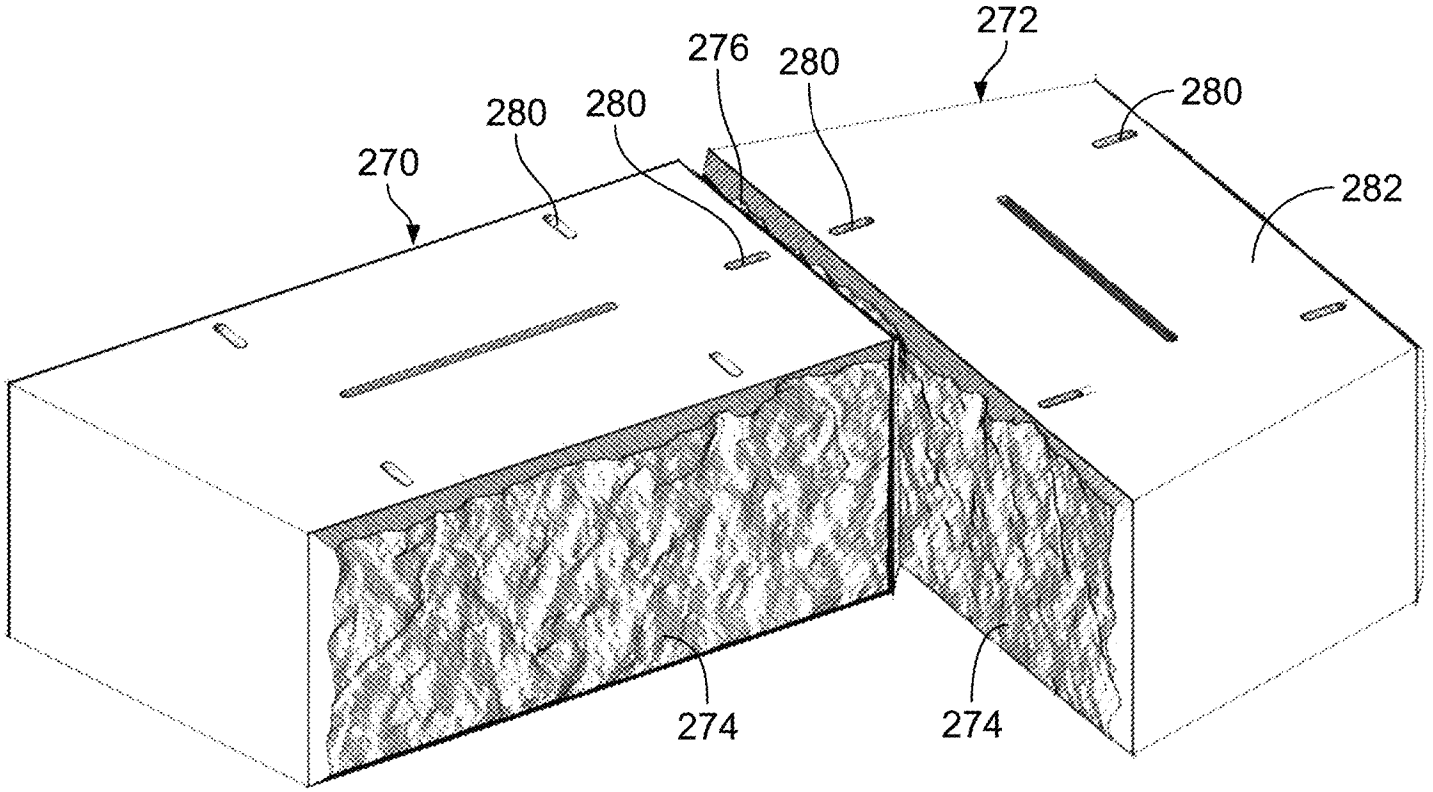
FIG. 53 is a perspective view of two structural units according to a thirteenth embodiment of the invention joined end to side, in which top and bottom surfaces (only tops are visible) including indicators for aligning the structural units.
Figure 54:
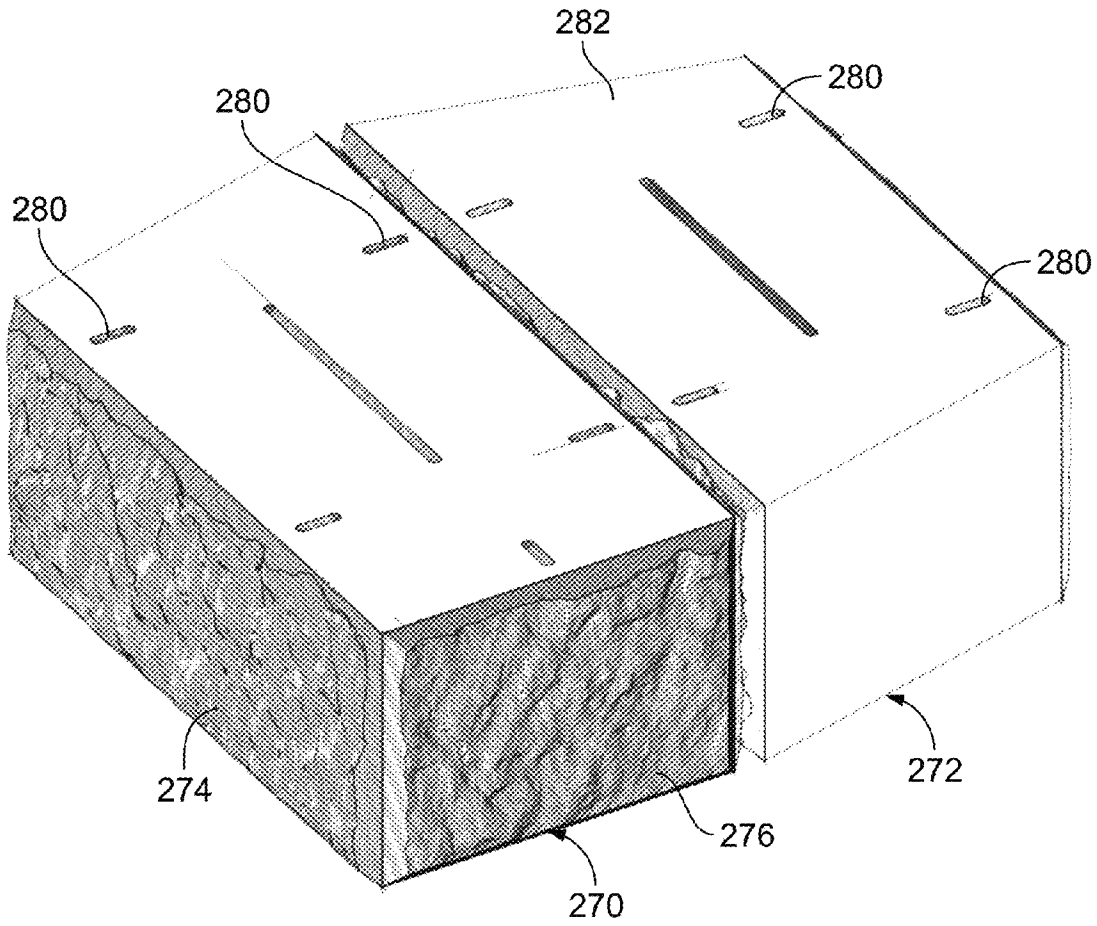
FIG. 54 is a perspective view of the two structural units of FIG. 53 joined side to side.

FIGS. 53-54 show various connections of two structural units: an orthogonal unit 270 and a trapezoidal unit 272. Each structural unit 270, 272 has a side connection surface 274. The orthogonal unit 270 also includes an end connection surface 276. Each structural unit further includes indicators 280, embodied in indents on a top face 282 (or bottom) of the structural unit 270 for aligning structural units for connection. The indicators 280 can instead be embodied in markings, ridges, or any other suitable features, in any suitable shape, size, or configuration such that, as alignment indicators, they can be referenced during assembly. The indicators 280 are aligned with center rotation points of four-segment connection surfaces in each connection surface. For example, for the end connection surface 276, the indicator 280 is aligned with a center rotation point. For the side connection surface 274, two indicators 280 are aligned with two center rotation points, respectively.

In FIG. 53, the end connection surface 276 of structural unit 270 is connected to an aligned portion of the side connection surface 274, and the indicators 280 are aligned. In FIG. 54, side connection surfaces 274 are connected to one another, and the indicators 280 are aligned. Indicators can alternatively or additionally be disposed on any surface of the structural unit, including in or on the connection surface itself, in or on faces having connection surfaces only on a portion of the face, or in or on faces lacking such a surface.

Connection surfaces may be used in any of various ways. For instance, structural units having connection surfaces may be used in material handling, including packaging, storing, and shipping. Structural units having connection surfaces may be connected with one another to provide particular structures or connections.

Various embodiments of structural units may have one or more connection surfaces. Connection surfaces can be provided as face art for panels, veneers, or blocks. As provided herein, connection surfaces need not be the same at every surface of a particular structural unit, though such surfaces can still be configured to mate with one another. Further, one or more connection surfaces may be disposed at any structural unit face (plane, curved, irregular, or other outer face of the structural unit), sidewall, or in any portion or portions of a face, and in any orientation. For example, a structural unit may have ends, sides, top, bottom, or any other face with one or more connection surfaces. Such connection surfaces can occupy an entire face of a unit, or only a portion of the structural unit face. Further, double S-connection surfaces can be centered on a face, or can be off-center. All combinations of connection surfaces, connection surface features (e.g., connection surface features shown or described in any embodiment herein), connection surface locations on a structural unit face, and orientations are contemplated including but not limited by the several embodiments shown and described herein. Structural units can be connected end to end forward, turned, or inverted, or otherwise connected in any combination to form surface coverings, walls, edges and combinations thereof. Connection surfaces can be provided on the face of the structural unit, such as but limited to by being formed, e.g., molded or otherwise formed, into one or more faces of the structural unit.

Structural units can comprise, as non-limiting examples, pavers, concrete masonry units (CMU), retaining wall blocks, patio stones and edgers. Example structural units, including connection surfaces, may be manufactured in any manner of substantially any material such as, but not limited to, concrete (including wet cast and dry cast), clay, plastic, ceramic, glass or composite materials. Wet cast and dry cast concrete are preferred for building units, such as pavers, CMU, retaining wall blocks, patio stones and edgers, curbs, caps, precast wall panels, revetment mats, and other units.

The configurations of the S-connections need not be exactly the same, or have the same depth dimension. In some embodiments, for instance, structural units can be configured to have a more natural appearance, and thus include imperfections, textures, slight mismatches, etc. The surfaces can have a textured or non-textured outer surface. Example surfaces can have irregular rock-like surfaces. The shapes can also vary for particular applications, as will be appreciated by those skilled in the art having reference to the present disclosure. Geometric surfaces can also be used.

Structural units can be of essentially any shape. Example shapes include rectangular, trapezoidal, cruciform, glides, hexagonal or other polygonal, other geometric shapes, and irregularly shaped units. Connection surfaces can be advantageously employed to connect and interlock adjacent structural units in a wide variety of structures, including but not limited to interior and exterior walls, retaining walls, precast wall panels, caps, columns and other vertical structures, as shown for example in U.S. Pat. Nos. 3,394,521, 4,107,894, 6,557,818, 6,615,561 and 7,011,474; pavements, patios, walkways and other surface coverings as shown for example in U.S. Pat. Nos. 4,128,357, 4,919,565 and 7,393,155; edgers and curbs, as shown for example in U.S. Pat. No.

7,637,688; revetment mats, coast fortifications, and other protective structures, as shown for example in U.S. Pat. Nos. 6,558,074 and 6,863,472. Connection surfaces can be used to join different size or shape structural units in multi-unit systems, as shown for example in U.S. Patent Publication No. 2005/0166517. All of the foregoing cited patents and publications are hereby incorporated by reference. Further, connection surfaces can be utilized to join different types of structures, such as walls-to-pavers, and pavers-to-curbs.

False joints, beveled edges, chamfers, chiseled elements, etc. can be provided to draw attention away from other features, or to add desirable aesthetics. In some embodiments, the connecting faces of structural units do not engage tightly leaving gaps of variable width but substantially the same size and appearance as the false joints so that the mating faces between units are not readily apparent.

Structural units may be respectively arranged in rows, courses, columns, orthogonally, setback, rotationally, serpentine, or other arrangements. In example wall embodiments, the structural units are arranged to provide at least a second course on top of a first course. One or more connection surfaces can be provided on the top and bottom faces of the units to thereby restrain movement between units in a horizontal plane. The structural wall units may also include connection surfaces on the ends or sides of the units to thereby restrain movement between units in a vertical plane. Structural wall units in a second course can be, but need not be, staggered from left to right with respect to the structural units in the first course. Examples of staggered arrangement include, but are not limited to, running bond, half bond, quarter bond, three-quarter bond, etc. Other, non-staggered arrangements are possible, including stack bond arrangements. Blocks can be in a vertical (near vertical) or setback arrangement as well. Optionally, connection surfaces can be provided on top or bottom faces to provide connection between courses, on faces, or both for front-to-back connection. Courses with such connection surfaces can be connected in a running bond, quarter bond, three-quarter bond or other arrangements.

Connection surfaces can be disposed on all sides of a unit, or fewer than all sides, and in some embodiments can be disposed on an interior portion of a particular side or sides. It is not required for all surfaces of connected structural units to touch, and gaps can be provided between units.

Structural units connected by example connection surfaces may be of the same type, or of different types. Any combinations of one or more structural unit types are contemplated herein. Non-limiting examples include wall systems to paver systems, retaining wall systems to paver systems, edger systems to patios, walls to pavers and edgers, walls to caps, pavers to curbings, precast wall panels to pavers, walls to revetment mats, clamping systems for lifting and turning, etc. Those of ordinary skill in the art will appreciate suitable positions for connection surfaces for mating or moving structural units of different types.

The position of the connection surface on a face of a structural unit can be over the entire face, or a portion of a face. Further, where the connection surface is disposed on a portion of a face, the connection surface can be disposed at any location on the structural unit face.

Structural units can have more than one connection surface on a single face. It is also contemplated to split the connection surface in half vertically, or horizontally, e.g., by separating quadrants by a distance along a face of a structural unit. Third, fourth, or additional connection surfaces can also be provided on a single building unit surface or on a combination of faces.

Example connection surfaces can be configured to allow some movement in one direction providing a tighter restraint in another direction.

Connection surfaces according to embodiments of the invention can be formed in or on, for example, the structural units disclosed in U.S. Pat. App. Publication No. 2014/0140766 A1, which is incorporated by reference herein in its entirety, as well as U.S. Provisional Patent Application No. 62/119,914, filed Feb. 24, 2015, which is incorporated by reference herein in its entirety.

Example connection surfaces, structural units, and structures can include any combination of features shown and/or described herein. The particular connection surface shown and described herein are merely examples, and those of ordinary skill in the art will appreciate that many other configurations for connection surfaces are possible, and such additional configurations are intended to fall under the scope of the present invention.

Structures can be or include vertical, horizontal, flat, curved, complex or irregular, largely two-dimensional, and/or largely three-dimensional structures. Structures can include a plurality of structural units, including any of the structural units shown or described herein, including any combinations of structural units, and including any of the connection surfaces, including combinations of connection surfaces, shown or described herein. The structure may be a complete, stand-alone structure, or may be combined with other structural units to provide a larger structure. Example structures include, but are not limited to, walls (e.g., retaining walls, interior walls, exterior walls, sound walls, etc.), wall veneers, wall panels, column blocks highway panels, fence panels, other panels, pavements, edges or combinations thereof.

While various embodiments of the present invention have been shown and described, it should be understood that other modifications, substitutions, and alternatives are apparent to one of ordinary skill in the art. Such modifications, substitutions, and alternatives can be made without departing from the spirit and scope of the invention.

What is claimed is:

1. A connection surface disposed on a face of a structural unit, the face of the structural unit extending generally along a plane, the connection surface comprising:

a first segment having a three dimensional surface profile including a plurality of positive outer surface features extending outwardly along a normal direction from the plane and a plurality of negative outer surface features extending inwardly along the normal direction from the plane, wherein at least two of the plurality of positive outer surfaces are separated from one another along both vertical and horizontal directions and at least two of the plurality of negative outer surfaces are separated from one another along vertical and horizontal directions;

a second segment opposing the first segment with respect to an axis;

wherein the second segment is a substantial reflection of the first segment across the axis, but reversed along the normal direction;

wherein when identical connection surfaces face and engage one another in the same vertical orientation, the positive outer surfaces of the first segment nest with the negative outer surfaces of the second segment, and the positive outer surfaces of the second segment nest with the negative outer surfaces of the first segment.

2. The connection surface of claim 1, wherein the two dimensional surfaces of the first and second segments comprise at least one irregular positive or negative surface feature.

3. The connection surface of claim 2, wherein the two dimensional surfaces of the first and second segments comprise surfaces having a natural appearance.

4. The connection surface of claim 1, wherein the first and second segments are adjacent to one another.

5. The connection surface of claim 4, wherein edges of the first and second segments define a seam; and wherein the first and second segments have portions removed on or adjacent to the seam.

6. A structural unit comprising:

top and bottom faces;

first and second side faces;

first and second end faces; and the connection surface of claim 1 disposed on at least one of the faces.

7. The structural unit of claim 6, wherein the structural unit comprises a structural wall unit.

8. The structural unit of claim 6, wherein the structural unit comprises a paver, concrete masonry unit, retaining wall block, patio stone, paver, edger, curb, cap, fence panel, precast wall panel, wall covering, interior wall panel, and or revetment mat.

9. A connection surface disposed on a face of a structural unit, the face of the structural unit extending generally along a plane, the connection surface comprising:

a first segment having a three dimensional surface profile including a plurality of positive outer surface features extending outwardly along a normal direction from the plane and a plurality of negative outer surface features extending inwardly along the normal direction from the plane, wherein at least two of the plurality of positive outer surfaces are separated from one another along both vertical and horizontal directions and at least two of the plurality of negative outer surfaces are separated from one another along vertical and horizontal directions;

a second segment opposing the first segment with respect to an axis;

wherein the second segment is a substantial reflection of the first segment across the axis, but reversed along the normal direction;

wherein when identical connection surfaces face and engage one another in the same vertical orientation, the positive outer surfaces of the first segment nest with the negative outer surfaces of the second segment, and the positive outer surfaces of the second segment nest with the negative outer surfaces of the first segment;

wherein the first and second segments define a first pair of segments, and wherein the axis defines a first axis; and further comprising:

a second pair of segments including a first segment and a second segment, the second pair of segments opposing the first pair with respect to a second axis;

wherein the second pair of segments are a substantial reflection of the first pair of segments with respect to the second axis, but reversed along the normal direction.

10. The connection surface of claim 9, wherein the connection surface is configured such that, when identical connection surfaces mate with one another, connection profiles are defined along at least two different sections through the mated connection surfaces;

wherein each of the connection profiles defines a 180-degree rotation about a center point.

11. The connection surface of claim 9, wherein the first and second axes are parallel to one another to provide a book fold between identical connection surfaces.

12. The connection surface of claim 9, wherein the first and second axes are perpendicular to one another;

wherein the first axis provides a vertical axis and the second axis provides a horizontal axis;

wherein the first and second segments of the first pair of segments provide first and second quadrants, respectively, and wherein the first and second segments of the second pair of segments provide third and fourth quadrants, respectively;

wherein the first and third quadrants are substantial reflections of one another with respect to the horizontal axis, but reversed along the normal direction; and wherein the second and fourth quadrants are substantial reflections of one another with respect to the horizontal axis, but reversed along the normal direction.

13. The connection surface of claim 12, wherein the connection surface is configured such that, when identical connection surfaces face one another, the identical connection surfaces nest with one another when the connection surfaces are in the same vertical orientation or reversed in vertical orientation.

14. The connection surface of claim 9, further comprising:

a third pair of segments including first and second segments opposing one another with respect to the first axis and separated from one another by the first and second pairs of segments, the first segment of the third pair being a substantial reflection of the second segment of the third pair with respect to the first axis, but reversed along the normal direction; and a fourth pair of segments including first and second segments opposing one another with respect to the first axis and separated from one another by the first and second pairs of segments, the first segment of the fourth pair being a substantial reflection of the second segment of the fourth pair with respect to the first axis, but reversed along the normal direction;

wherein the first segment of the third pair and the first segment of the fourth pair oppose one another with respect to the second axis, the first segment of the third pair being a substantial reflection of the first segment of the third pair with respect to the second axis, but reversed along the normal direction; and wherein the second segment of the third pair and the second segment of the fourth pair oppose one another with respect to the second axis, the second segment of the third pair being a substantial reflection of the second segment of the third pair with respect to the second axis, but reversed along the normal direction.

15. The connection surface of claim 14, wherein the first and second segments of the third and fourth pairs of segments are substantially identical to the first and second segments of the first and second pairs of segments.

16. A connection surface disposed on a face of a structural unit, the face of the structural unit extending generally along a plane, the connection surface comprising:

a first segment having a three dimensional surface profile including a plurality of positive outer surface features extending outwardly along a normal direction from the plane and a plurality of negative outer surface features extending inwardly along the normal direction from the plane, wherein at least two of the plurality of positive outer surfaces are separated from one another along both vertical and horizontal directions and at least two of the plurality of negative outer surfaces are separated from one another along vertical and horizontal directions;

a second segment opposing the first segment with respect to an axis;

wherein the second segment is a substantial reflection of the first segment across the axis, but reversed along the normal direction;

wherein when identical connection surfaces face and engage one another in the same vertical orientation, the positive outer surfaces of the first segment nest with the negative outer surfaces of the second segment, and the positive outer surfaces of the second segment nest with the negative outer surfaces of the first segment;

wherein at least one of the plurality of positive or negative surface features in the first segment has a portion removed such that the at least one positive surface feature extends outwardly in the normal direction to a lesser amount than a complementary negative surface feature in the second segment extends inwardly;

wherein when the first and second segments of identical connection surfaces connect with one another, a gap is defined between the at least one positive surface feature and the at least one negative surface feature.

17. A method for providing a connection surface for a structural unit, the method comprising:

providing a primary surface having a three dimensional surface profile along a plane including a plurality of positive outer surfaces extending outwardly along a normal direction from the plane and a plurality of negative outer surfaces extending inwardly along the normal direction from the plane, wherein at least two of the plurality of positive outer surfaces are separated from one another along both vertical and horizontal directions and at least two of the plurality of negative outer surfaces are separated from one another along vertical and horizontal directions;

providing a secondary surface, where the secondary surface is a reflection of the primary surface and reversed along a normal direction;

assembling the primary and secondary surfaces according to a surface reflection pattern along the plane to provide a surface texture; and forming the provided surface texture on a surface of the structural unit.

18. The method of claim 17, wherein said providing a primary surface comprises extracting the primary surface from an existing surface.

19. The method of claim 17, wherein said providing a primary surface comprises generating the primary surface based on one or more parameters.

20. The method of claim 17, further comprising:

forming a plurality of surface variations on the provided surface texture.

21. The method of claim 17, further comprising:

selecting a surface reflection pattern;

wherein said surface reflection pattern comprises the selected surface reflection pattern.

* * * * *